US008114563B2

(12) United States Patent
Hirose et al.

(10) Patent No.: US 8,114,563 B2
(45) Date of Patent: Feb. 14, 2012

(54) ELECTROPHOTOGRAPHIC PHOTORECEPTOR AND METHOD OF PREPARING THE PHOTORECEPTOR, AND IMAGE FORMING METHOD, IMAGE FORMING APPARATUS AND PROCESS CARTRIDGE THEREFOR USING THE PHOTORECEPTOR

(75) Inventors: Mitsuaki Hirose, Numazu (JP); Yoshiaki Kawasaki, Susono (JP); Yoshiki Yanagawa, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 1178 days.

(21) Appl. No.: 11/834,240

(22) Filed: Aug. 6, 2007

(65) Prior Publication Data

US 2008/0038649 A1 Feb. 14, 2008

(30) Foreign Application Priority Data

Aug. 10, 2006 (JP) ..... 2006-217667

(51) Int. Cl.
*G03G 5/14* (2006.01)

(52) U.S. Cl. ..... 430/132; 430/130; 430/133

(58) Field of Classification Search ..... 430/132, 430/133, 130

See application file for complete search history.

(56) References Cited

U.S. PATENT DOCUMENTS

| | | | | |
|---|---|---|---|---|
| 5,124,219 | A | 6/1992 | Shintani et al. | |
| 6,521,387 | B2 | 2/2003 | Kawasaki | |
| 6,558,863 | B2 | 5/2003 | Rokutanzono et al. | |
| 7,212,777 | B2 | 5/2007 | Takada et al. | |
| 7,399,563 | B2 | 7/2008 | Suzuki et al. | |
| 7,718,335 | B2 * | 5/2010 | Fujiwara et al. | 430/58.7 |
| 2004/0234875 | A1 | 11/2004 | Toda et al. | |
| 2005/0141919 | A1 | 6/2005 | Kitajima et al. | |
| 2005/0158641 | A1 | 7/2005 | Yanagawa et al. | |
| 2005/0158644 | A1 | 7/2005 | Kondo et al. | |
| 2005/0181291 | A1 | 8/2005 | Kami et al. | |
| 2005/0221210 | A1 | 10/2005 | Suzuki et al. | |
| 2005/0266325 | A1 | 12/2005 | Yanagawa et al. | |
| 2005/0266328 | A1 | 12/2005 | Yanagawa et al. | |
| 2005/0282075 | A1 | 12/2005 | Ikuno et al. | |
| 2005/0287452 | A1 | 12/2005 | Tamura et al. | |
| 2006/0110668 | A1 | 5/2006 | Kawasaki et al. | |
| 2007/0116963 | A1 * | 5/2007 | Sakakibara | 428/414 |
| 2007/0185297 | A1 * | 8/2007 | Tanaka et al. | 528/10 |
| 2007/0196749 | A1 * | 8/2007 | Inaba et al. | 430/58.2 |

FOREIGN PATENT DOCUMENTS

| | | |
|---|---|---|
| JP | 56-48637 | 5/1981 |
| JP | 64-1728 | 1/1989 |
| JP | 2-191964 | 7/1990 |
| JP | 4-281461 | 10/1992 |
| JP | 2000-66425 | 3/2000 |
| JP | 3194392 | 6/2001 |
| JP | 3262488 | 12/2001 |
| JP | 2002-268246 | 9/2002 |
| JP | 2003-091082 | * 3/2003 |
| JP | 2003-241404 | 8/2003 |
| JP | 2004-4454 | 1/2004 |
| JP | 2004-302450 | 10/2004 |
| JP | 2004-302451 | 10/2004 |
| JP | 2004-302452 | 10/2004 |
| JP | 2005-41172 | 2/2005 |
| JP | 2005-241772 | 9/2005 |

OTHER PUBLICATIONS

Japanese Patent Office machine-assisted translation of JP 2003-091082 (pub. Mar. 2003).*

Grant , R., et al., ed., Grant & Hackh's Chemical Dictionary, fifth edition, McGraw-Hill Book Company, NY (1987), p. 410.*

Office Action issued Oct. 7, 2010 in JP Application No. 2006-217667.

U.S. Appl. No. 11/480,517, filed Jul. 5, 2006, Yoshiki Yanagawa, et al.

* cited by examiner

*Primary Examiner* — Janis L Dote

(74) *Attorney, Agent, or Firm* — Oblon, Spivak, McClelland, Maier & Neustadt, L.L.P.

(57) ABSTRACT

An electrophotographic photoreceptor, including:

an electroconductive substrate;

a photosensitive layer located overlying the electroconductive substrate; and a crosslinked surface layer located overlying the photosensitive layer, including:

a tri- or more functional radical polymerizable monomer having no charge transport structure; and a radical polymerizable compound having a charge transport structure, wherein the crosslinked surface layer has a surface roughness (Ra) not greater than 0.2 μm and a peel strength not less than 0.2 N/mm when measured by the SAICAS method.

10 Claims, 3 Drawing Sheets

ELECTROPHOTOGRAPHIC PHOTORECEPTOR AND METHOD OF PREPARING THE PHOTORECEPTOR, AND IMAGE FORMING METHOD, IMAGE FORMING APPARATUS AND PROCESS CARTRIDGE THEREFOR USING THE PHOTORECEPTOR

BACKGROUND OF THE INVENTION

1. Field of the Invention

The present invention relates to an electrophotographic photoreceptor and a method of preparing the photoreceptor, and to an image forming method, an image forming apparatus and a process cartridge therefor using the photoreceptor.

2. Discussion of the Background

Recently, organic photoreceptors (OPCs) have been widely used instead of inorganic photoreceptors for copiers, facsimiles, laser printers and their complex machines because of their good performances and advantages. Specific examples of the reasons include (i) optical properties such as a wide range of light absorbing wavelength and a large amount of absorbing light; (ii) electrical properties such as high sensitivity and stable chargeability; (iii) choice of the materials; (iv) good manufacturability; (v) low cost; (vi) non-toxicity, etc.

On the other hand, as image forming apparatuses become smaller, photoreceptors have smaller diameters recently. In addition, photoreceptors are required to have high durability as image forming apparatuses produce images at a higher speed and are free from maintenance. In this respect, the organic photoreceptor typically has a soft surface layer mainly formed from a low-molecular-weight charge transport material and an inactive polymer, and therefore the organic photoreceptor typically has a drawback of being mechanically abraded with an image developer and a cleaner with ease when repeated used in the electrophotographic process. In addition, as toner particles has smaller particle diameters due to requirements for high-quality images, cleaning blades need to have higher rubber hardness and higher contact pressure for the purpose of increasing cleanability, and which also accelerates abrading photoreceptors. Such abrasions of photoreceptors deteriorate electrical properties thereof such as sensitivities and chargeabilities, and cause abnormal images such as image density deterioration and background fouling. When a photoreceptor is locally abraded, images having black stripes due to defective cleaning are produced. At present, photoreceptors are exchanged because of these abrasions and damages.

Therefore, it is indispensable to decrease the abrasion amount of the organic photoreceptor so as to have high durability. This is the most pressing issue to solve in this field.

As methods of improving the abrasion resistance of a photoreceptor, (1) Japanese Published Unexamined Patent Application No. 56-48637 discloses a photoreceptor using a hardening binder in its surface layer; (2) Japanese Published Unexamined Patent Application No. 64-1728 discloses a photoreceptor using charge transport polymer material; and (3) Japanese Published Unexamined Patent Application No. 4-281461 discloses a photoreceptor having a surface layer wherein an inorganic filler is dispersed. The photoreceptor using a hardening binder of (1) tends to increase a residual potential and decrease image density because of a poor solubility of the binder with a charge transport material and impurities such as a polymerization initiator and an unreacted residual group. The photoreceptor using charge transport polymer material of (2) and the photoreceptor having a surface layer wherein an inorganic filler is dispersed of (3) have abrasion resistance to some extent, but which is not fully satisfactory. Further, the photoreceptor having a surface layer wherein an inorganic filler is dispersed of (3) tends to increase a residual potential and decrease image density because of a trap present on the surface of the inorganic filler. Any of the photoreceptors of (1) to (3) does not have fully satisfactory integrated durability such as electrical durability and mechanical durability.

To improve the abrasion resistance of the photoreceptor of (1), Japanese Patent No. 3262488 discloses a photoreceptor including hardened urethane acrylate. However, although disclosing that the photosensitive layer includes the hardened urethane acrylate, Japanese Patent No. 3262488 only discloses that a charge transport material may be included therein and does not disclose specific examples thereof. When a low-molecular-weight charge transport material is simply included in a photosensitive layer, the low-molecular-weight charge transport material is not soluble with the hardened urethane acrylate and the low-molecular-weight charge transport material separates out, and which causes deterioration of mechanical strength of the resultant photoreceptor such as a crack. In addition, Japanese Patent No. 3262488 discloses that a polycarbonate resin is included in the photosensitive layer to improve the solubility. However, a content of the hardened urethane acrylate decreases, resulting in insufficient abrasion resistance of the photoreceptor. A photoreceptor not including a charge transport material in its surface layer, which is thin against deterioration of potential of the irradiated part, has a short life. In addition, the charged potential thereof has poor stability against environment.

As an abrasion resistance technology of a photosensitive layer in place of these technologies, Japanese Patent No. 3194392 discloses a method of forming a charge transport layer using a coating liquid formed from a monomer having a carbon-carbon double bond, a charge transport material having a carbon-carbon double bond and a binder resin. The binder resin includes a binder resin having a carbon-carbon double bond and a reactivity with the charge transport material, and a binder resin having neither a carbon-carbon double bond nor a reactivity with the charge transport material. The photoreceptor has good abrasion resistance and electrical properties. However, when a binder resin not having a reactivity with a charge transport material, such as an acrylic polymer, a styrene polymer, an acrylic styrene copolymer, a polyester resin, a polycarbonate resin and an epoxy resin, a bonding amount between the monomer having a carbon-carbon double bond and the charge transport material having a carbon-carbon double bond decreases, resulting in insufficient crosslink density of the photosensitive layer. Further, since the binder resin itself does not have toughness, the resultant photosensitive layer does not have satisfactory abrasion resistance.

Japanese Published Unexamined Patent Application No. 2000-66425 discloses a photosensitive layer including a hardened positive hole transport compound having two or more chain polymerizable functional groups in the same molecule. However, since the photosensitive layer includes a bulky positive hole transport material having two or more chain polymerizable functional groups, a distortion appears in the hardened compound and an internal stress increases to cause a roughness and a crack of the surface layer, resulting in insufficient durability of the resultant photoreceptor.

Japanese Published Unexamined Patent Applications Nos. 2004-302450, 2004-302451 and 2004-302452 disclose a crosslinked charge transport layer in which a tri- or more functional radical polymerizing monomer having no charge transport structure and a monofunctional radical polymerizing compound having a charge transport structure are hardened, wherein the monofunctional radical polymerizing compound having a charge transport structure improves mechanical and electrical durability of the layer and prevents the layer from being cracked. Particularly, the photoreceptor disclosed in Japanese Published Unexamined Patent Application No. 2004-302452 has smaller surface roughness with a specified amount of a multifunctional acrylic monomer for the purpose of having good cleanability and preventing production of abnormal images. However, since the multifunctional acrylic monomer has a large volume contraction, the surface layer insufficiently adheres to the lower photosensitive layer. When such a photoreceptor is used in an image forming apparatus wherein a large mechanical stress is applied thereto, the crosslinked surface layer separates from the photosensitive layer, resulting in inability of maintaining sufficient abrasion resistance for long periods.

Because of these reasons, a need exists for an electrophotographic photoreceptor having high durability, good and stable electrical properties and good cleanability for long periods.

SUMMARY OF THE INVENTION

Accordingly, an object of the present invention is to provide an electrophotographic photoreceptor having high durability, good and stable electrical properties and good cleanability for long periods.

Another object of the present invention is to provide a method of preparing the photoreceptor. A further object of the present invention is to provide an image forming method using the photoreceptor.

Another object of the present invention is to provide an image forming apparatus using the photoreceptor.

A further object of the present invention is to provide a process cartridge therefor, using the photoreceptor.

These objects and other objects of the present invention, either individually or collectively, have been satisfied by the discovery of an electrophotographic photoreceptor, comprising:

an electroconductive substrate, a photosensitive layer located overlying the electroconductive substrate, and a surface layer located overlying the photosensitive layer;

wherein the surface layer is a crosslinked surface layer, comprising:

a tri- or more functional radical polymerizable monomer having no charge transport structure, and a radical polymerizable compound having a charge transport structure; and wherein the crosslinked surface layer has a surface roughness (Ra) not greater than 0.2 μm and a peel strength not less than 0.2 N/mm when measured by the SAICAS method.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
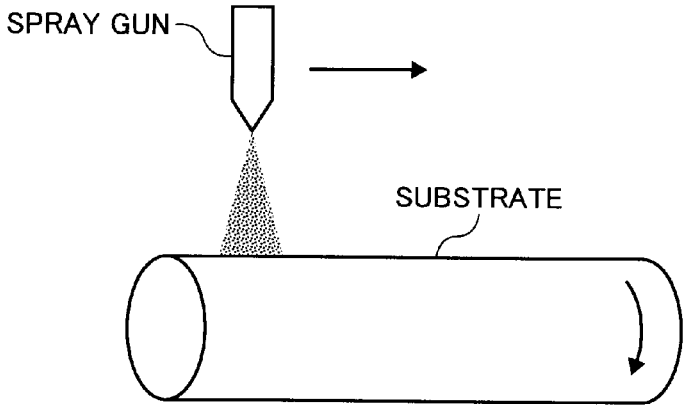
FIG. 1 is a schematic view for explaining a spray coating method of coating a crosslinked surface layer.

The present invention provides an electrophotographic photoreceptor having high durability, stable electrical properties, good cleanability and producing high-quality images, which comprises:

an electroconductive substrate, a photosensitive layer located overlying the electroconductive substrate, and a surface layer located overlying the photosensitive layer;

wherein the surface layer is a crosslinked surface layer, comprising:

a tri- or more functional radical polymerizable monomer having no charge transport structure, and a radical polymerizable compound having a charge transport structure; and wherein the crosslinked surface layer has a surface roughness (Ra) not greater than 0.2 μm and a peel strength not less than 0.2 N/mm when measured by the SAICAS method.

The photoreceptor of the present invention includes a tri- or more functional radical polymerizable monomer in its surface layer, which develops a three-dimensional network, and therefore the surface layer becomes a very hard crosslinked layer having high crosslink density and high abrasion resistance. The crosslinked surface layer of the present invention including the tri- or more functional radical polymerizable monomer having no charge transport structure and the radical polymerizable compound having a charge transport structure, which are hardened at the same time in a short time to form a crosslinked bonding having high hardness, has improved durability. Further, a uniform crosslinked film with less distortion can be formed therein. In addition, including the radical polymerizable compound having a charge transport structure, the crosslinked layer has stable electrical properties without crack.

In the present invention, a crosslinked surface layer coating liquid is formed by 2 or more oscillation spray coatings, and the droplet diameter (D50) of the first spray coating is not less than 7 μm and that of the second or subsequent spray coating is less than 7 μm. D50 is an average of half cumulative curve of 100 droplet diameter distributions when measured at an interval of 0.1 sec of sprayed droplets. The first oscillation spray coating having the larger droplet diameter slightly dissolves the droplet in a photosensitive layer to improve adherence of the resultant surface layer. The second oscillation spray coating having the microscopic droplet diameter forms a dense coating to improve surface smoothness of the surface layer. The thus prepared surface layer having a surface roughness (Ra) not greater than 0.2 μm and a peel strength not less than 0.2 N/mm when measured by the SAICAS method has good cleanability and prevents itself from peeling.

Next, constituents of a coating liquid for forming the crosslinked surface layer will be explained.

The tri- or more functional monomers having no charge transport structure mean monomers which have three or more radical polymerizable groups and which do not have a charge transport structure (such as a positive hole transport structure (e.g., triarylamine, hydrazone, pyrazoline and carbazole structures); and an electron transport structure (e.g., condensed polycyclic quinine structure, diphenoquinone structure, a cyano group and a nitro group)). As the radical polymerizable groups, any radical polymerizable groups having a carbon-carbon double bond can be used. Suitable radical polymerizable groups include the following 1-substituted ethylene groups and 1,1-substituted ethylene groups.

Specific examples of the 1-substituted ethylene groups include functional groups having the following formula:

$$CH_2{=}CH{-}X_1{-}$$

wherein $X_1$ represents an arylene group (such as a phenylene group and a naphthylene group), which optionally has a substituent, a substituted or unsubstituted alkenylene group, a —CO— group, a —COO— group, a —CON($R^{10}$) group (wherein $R^{10}$ represents a hydrogen atom, an alkyl group (e.g., a methyl group, and an ethyl group), an aralkyl group (e.g., a benzyl group, a naphthylmethyl group and a phenetyl group) or an aryl group (e.g., a phenyl group and a naphthyl group)), or a —S— group.

Specific examples of the substituents include a vinyl group, a styryl group, 2-methyl-1,3-butadienyl group, a vinylcarbonyl group, acryloyloxy group, acryloylamide, vinylthioether, etc.

Specific examples of the 1,1-substituted ethylene groups include functional groups having the following formula:

$$CH_2{=}C(Y){-}X_2{-}$$

wherein Y represents a substituted or unsubstituted alkyl group, a substituted or unsubstituted aralkyl group, a substituted or unsubstituted aryl group (such as phenyl and naphthyl groups), a halogen atom, a cyano group, a nitro group, an alkoxyl group (such as methoxy and ethoxy groups), or a —$COOR_{31}$ group (wherein $R_{31}$ represents a hydrogen atom, a substituted or unsubstituted alkyl group (such as methyl and ethyl groups), a substituted or unsubstituted aralkyl group (such as benzyl and phenethyl groups), a substituted or unsubstituted aryl group (such as phenyl and naphthyl groups) or a —$CONR_{32}R_{33}$ group (wherein each of $R_{32}$ and $R_{33}$ represents a hydrogen atom, a substituted or unsubstituted alkyl group (such as methyl and ethyl groups), a substituted or unsubstituted aralkyl group (such as benzyl, naphthylmethyl and phenethyl groups), a substituted or unsubstituted aryl group (such as phenyl and naphthyl groups); and $X_2$ represents a group selected from the groups mentioned above for use in $X_1$ and an alkylene group, wherein at least one of Y and $X_2$ is an oxycarbonyl group, a cyano group, an alkenylene group or an aromatic group.

Specific examples of the substituents include an α-chloroacryloyloxy group, a methacryloyloxy group, an α-cyanoethylene group, an α-cyanoacryloyloxy group, an α-cyanophenylene group, a methacryloylamino group, etc.

Specific examples of the substituents for use in the groups $X_1$, $X_2$ and Y include halogen atoms, a nitro group, a cyano group, alkyl groups (such as methyl and ethyl groups), alkoxy groups (such as methoxy and ethoxy groups), aryloxy groups (such as a phenoxy group), aryl groups (such as phenyl and naphthyl groups), aralkyl groups (such as benzyl and phenethyl groups), etc.

The acryloyloxy groups and methacryloyloxy groups are preferably used as the radical polymerizable functional groups. Radical polymerizable monomers having three or more radical polymerizable functional groups, i.e., acryloyloxy groups or methacryloyloxy groups are preferably used in terms of improving the abrasion resistance of the resultant surface layer. Compounds having three or more acryloyloxy groups can be prepared by subjecting (meth)acrylic acid (salts), (meth)acrylhalides and (meth)acrylates, which have three or more hydroxyl groups, to an ester reaction or an ester exchange reaction. The three or more radical polymerizable groups included in a radical polymerizable tri- or more functional monomer are the same as or different from the others therein.

Specific examples of the radical polymerizable tri- or more functional monomers include, but are not limited to, trimethylolpropane triacrylate (TMPTA), trimethylolpropane trimethacrylate, trimethylolpropane alkylene-modified triacrylate, trimethylolpropane ethyleneoxy-modified triacrylate, trimethylolpropane propyleneoxy-modified triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified triacrylate, glycerol ethyleneoxy-modified triacrylate, glycerol propyleneoxy-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol tetraacrylate, alkylated dipentaerythritol triacrylate, dimethylolpropane tetraacrylate (DTMPTA), pentaerythritol ethoxytriacrylate, ethyleneoxy-modified triacryl phosphate, 2,2,5,5-tetrahydroxymethylcyclopentanone tetraacrylate, etc. These monomers are used alone or in combination. These are modified because the viscosities thereof are decreased to be easily handled.

In order to form a dense crosslinked network in the crosslinked surface layer, the ratio (Mw/F) of the molecular weight (Mw) of the tri- or more functional monomer to the number of functional groups (F) included in a molecule of the monomer is preferably not greater than 250. When the number is too large, the resultant protective becomes soft and thereby the abrasion resistance of the layer slightly deteriorates. In this case, it is not preferable to use only one monomer having a functional group having a long chain group such as ethylene oxide, propylene oxide and caprolactone.

The content of the unit obtained from the tri- or more functional monomers in the crosslinked surface layer is preferably from 20 to 80% by weight, and more preferably from 30 to 70% by weight based on the total weight of the surface layer. When the content is too low, the three dimensional crosslinking density is low, and thereby good abrasion resistance cannot be imparted to the surface layer. In contrast, when the content is too high, the content of the charge transport compound decreases, good charge transport property cannot be imparted to the surface layer. In order to balance the abrasion resistance and charge transport property of the crosslinked surface layer, the content of the unit obtained from the tri- or more functional monomers in the surface layer is preferably from 30 to 70% by weight.

The radical polymerizable compound having a charge transport structure for use in the present invention is a compound which has a positive hole transport structure such as triarylamine, hydrazone, pyrazoline and carbazole or an electron transport structure such as condensed polycyclic quinone, diphenoquinone, a cyano group and an electron attractive aromatic ring having a nitro group, and has a radical polymerizable functional group. Specific examples of the radical polymerizable functional group include the above-mentioned radical polymerizable monomers, and particularly the acryloyloxy groups and methacryloyloxy groups are effectively used. In addition, a triarylamine structure is effectively used as the charge transport structure.

Further, when a compound having the following formula (1) or (2), electrical properties such as a sensitivity and a residual potential are preferably maintained.

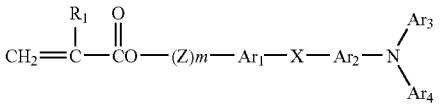

(1)

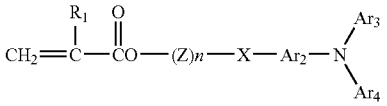

(2)

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_2$ wherein $R_2$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_3R_4$ wherein $R_3$ and $R_4$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ independently represent a substituted or an unsubstituted arylene group; $Ar_3$ and $Ar_4$ independently represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom and vinylene group; Z represents a substituted or an unsubstituted alkylene group, a substituted or an unsubstituted alkyleneether group and alkyleneoxycarbonyl group; and m and n represent 0 and an integer of from 1 to 3.

In the formulae (1) and (2), among substituted groups of $R_1$, the alkyl groups include methyl groups, ethyl groups, propyl groups, butyl groups, etc.; the aryl groups include phenyl groups, naphtyl groups, etc.; aralkyl groups include benzyl groups, phenethyl groups, naphthylmethyl groups, etc.; and alkoxy groups include methoxy groups, ethoxy groups, propoxy groups, etc. These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups.

The substituted group of $R_1$ is preferably a hydrogen atom and a methyl group.

$Ar_3$ and $Ar_4$ independently represent a substituted or an unsubstituted aryl group, and specific examples thereof include condensed polycyclic hydrocarbon groups, non-condensed cyclic hydrocarbon groups and heterocyclic groups.

The condensed polycyclic hydrocarbon group is preferably a group having 18 or less carbon atoms forming a ring such as a fentanyl group, a indenyl group, a naphthyl group, an azulenyl group, a heptalenyl group, a biphenylenyl group, an As-indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a crycenyl group and a naphthacenyl group.

Specific examples of the non-condensed cyclic hydrocarbon groups and heterocyclic groups include monovalent groups of monocyclic hydrocarbon compounds such as benzene, diphenylether, polyethylenediphenylether, diphenylthioether, and diphenylsulfone; monovalent groups of non-condensed hydrocarbon compounds such as biphenyl, polyphenyl, diphenylalkane, diphenylalkene, diphenylalkine, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene.

Specific examples of the heterocyclic groups include monovalent groups such as carbazole, dibenzofuran, dibenzothiophene, oxadiazole and thiadiazole.

Specific examples of the substituted or unsubstituted aryl group represented by $Ar_3$ and $Ar_4$ include the following groups:

(1) a halogen atom, a cyano group and a nitro group;

(2) a straight or a branched-chain alkyl group having 1 to 12, preferably from 1 to 8, and more preferably from 1 to 4 carbon atoms, and these alkyl groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkyl groups include methyl groups, ethyl groups, n-butyl groups, i-propyl groups, t-butyl groups, s-butyl groups, n-propyl groups, trifluoromethyl groups, 2-hydroxyethyl groups, 2-ethoxyethyl groups, 2-cyanoethyl groups, 2-methocyethyl groups, benzyl groups, 4-chlorobenzyl groups, 4-methylbenzyl groups, 4-phenylbenzyl groups, etc.

(3) alkoxy groups (—$OR_2$) wherein $R_2$ represents an alkyl group specified in (2). Specific examples thereof include methoxy groups, ethoxy groups, n-propoxy groups, I-propoxy groups, t-butoxy groups, s-butoxy groups, I-butoxy groups, 2-hydroxyethoxy groups, benzyloxy groups, trifluoromethoxy groups, etc.

(4) aryloxy groups, and specific examples of the aryl groups include phenyl groups and naphthyl groups. These aryl group may include an alkoxy group having 1 to 4 carbon atoms, an alkyl group having 1 to 4 carbon atoms or a halogen atom as a substituent. Specific examples of the aryloxy groups include phenoxy groups, 1-naphthyloxy groups, 2-naphthyloxy groups, 4-methoxyphenoxy groups, 4-methylphenoxy groups, etc.

(5) alkyl mercapto groups or aryl mercapto groups such as methylthio groups, ethylthio groups, phenylthio groups and p-methylphenylthio groups.

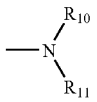

(6)

wherein $R_{10}$ and $R_{11}$ independently represent a hydrogen atom, an alkyl groups specified in (2) and an aryl group, and specific examples of the aryl groups include phenyl groups, biphenyl groups and naphthyl groups, and these may include an alkoxy group having 1 to 4 carbon atoms, an alkyl group having 1 to 4 carbon atoms or a halogen atom as a substituent, and $R_{10}$ and $R_{11}$ may form a ring together. Specific examples of the groups having this formula include amino groups, diethylamino groups, N-methyl-N-phenylamino groups, N,N-diphenylamino groups, N-N-di(tolyl)amino groups, dibenzylamino groups, piperidino groups, morpholino groups, pyrrolidino groups, etc.

(7) a methylenedioxy group, an alkylenedioxy group such as a methylenedithio group or an alkylenedithio group.

(8) a substituted or an unsubstituted styryl group, a substituted or an unsubstituted β-phenylstyryl group, a diphenylaminophenyl group, a ditolylaminophenyl group, etc.

The arylene group represented by $Ar_1$ and $Ar_2$ are derivative divalent groups from the aryl groups represented by $Ar_3$ and $Ar_4$.

The above-mentioned X represents a single bond, a substituted or an unsubstituted alkylene group, a substituted or an unsubstituted cycloalkylene group, a substituted or an unsubstituted alkylene ether group, an oxygen atom, a sulfur atom and vinylene group.

The substituted or unsubstituted alkylene group is a straight or a branched-chain alkylene group having 1 to 12, preferably from 1 to 8, and more preferably from 1 to 4 carbon atoms, and these alkylene groups may further includes a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkylene groups include methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methocyethylene groups, benzylidene groups, phenylethylene groups, 4-chlorophenylethylene groups, 4-methylphenylethylene groups, 4-biphenylethylene groups, etc.

The substituted or unsubstituted cycloalkylene group is a cyclic alkylene group having 5 to 7 carbon atoms, and these alkylene groups may include a fluorine atom, a hydroxyl group, a cyano group, an alkoxy group having 1 to 4 carbon atoms. Specific examples thereof include cyclohexylidine groups, cyclohexylene groups and 3,3-dimethylcyclohexylidine groups, etc.

Specific examples of the substituted or unsubstituted alkyleneether groups include ethylene oxy, propylene oxy, ethylene glycol, propylene glycol, diethylene glycol, tetraethylene glycol and tripropylene glycol. The alkylene group of the alkyleneether group may include a substituent such as a hydroxyl group, a methyl group and an ethyl group. The vinylene group has the following formula:

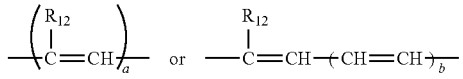

wherein $R_{12}$ represents a hydrogen atom, an alkyl group (same as those specified in (2)), an aryl group (same as those represented by $Ar_3$ and $Ar_4$); a represents 1 or 2; and b represents 1, 2 or 3.

Z represents a substituted or an unsubstituted alkylene group, a substituted or an unsubstituted divalent alkyleneether group and a divalent alkyleneoxycarbonyl group. Specific examples of the substituted or unsubstituted alkylene group include those of X. Specific examples of the substituted or unsubstituted divalent alkyleneether group include those of X. Specific examples of the divalent alkyleneoxycarbonyl group include caprolactone-modified groups.

In addition, the radical polymerizable compound having a charge transport structure of the present invention is more preferably a compound having the following formula (3):

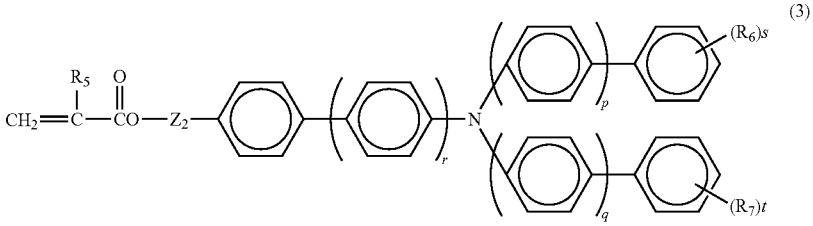

(3)

wherein o, p and q independently represent 0 or 1; $R_5$ represents a hydrogen atom or a methyl group; each of $R_6$ and $R_7$ represents a substituent besides a hydrogen atom and an alkyl group having 1 to 6 carbon atoms, and may be different from each other when having plural carbon atoms; s and t represent 0 or an integer of from 1 to 3; Za represents a single bond, a methylene group, ethylene group,

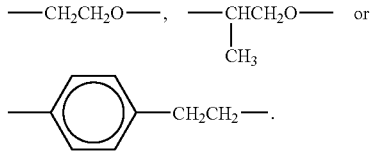

The compound having the formula (3) are preferably a compound having an methyl group or a ethyl group as a substituent of $R_6$ and $R_7$.

The radical polymerizable compound having a charge transport structure can be monofunctional. The monofunctional radical polymerizable compound having a charge transport structure of the formulae (1), (2) and particularly (3) for use in the present invention does not become an end structure because a double bonding between the carbons is polymerized while opened to the both sides, and is built in a chain polymer. In a crosslinked polymer polymerized with a radical polymerizable monomer having three or more functional groups, the compound is present in a main chain and in a crosslinked chain between the main chains (the crosslinked chain includes an intermolecular crosslinked chain between a polymer and another polymer and an intramolecular crosslinked chain wherein a portion having a folded main chain and another portion originally from the monomer, which is polymerized with a position apart therefrom in the main chain are polymerized). Even when the compound is present in a main chain or a crosslinked chain, a triarylamine structure suspending from the chain has at least three aryl groups radially located from a nitrogen atom, is not directly bonded with the chain and suspends through a carbonyl group or the like, and is sterically and flexibly fixed although bulky. The triarylamine structures can spatially be located so as to be moderately adjacent to one another in a polymer, and has less structural distortion in a molecule. Therefore, it is supposed that the monofunctional radical polymerizable compound having a charge transport structure in a surface layer of an electrophotographic photoreceptor can have an intramolecular structure wherein blocking of a charge transport route is comparatively prevented.

Further, in the present invention, a specific acrylic acid ester compound having the following formula (4) is preferably used as the monofunctional radical polymerizable compound having a charge transport structure as well:

$$B_1—Ar_5—CH=CH—Ar_6—B_2 \quad (4)$$

wherein $Ar_5$ represents a substituted or an unsubstituted monovalent group or bivalent group formed of an aromatic hydrocarbon skeleton. Specific examples of the monovalent group or bivalent group formed of an aromatic hydrocarbon skeleton include monovalent or bivalent groups such as benzene, naphthalene, phenanthrene, biphenyl and 1,2,3,4-tetrahydronaphthalene.

Specific examples of substituents of the aromatic hydrocarbon skeleton include an alkyl group having 1 to 12 carbon atoms, an alkoxy group having 1 to 12 carbon atoms, a benzyl group and a halogen atom. The alkyl group and alkoxy group may further have a halogen atom or a phenyl group as a substituent.

$Ar_6$ represents a monovalent group or a bivalent group formed of an aromatic hydrocarbon skeleton or heterocyclic compound skeleton having one or more tertiary amino group. The aromatic hydrocarbon skeleton having a tertiary amino group has the following formula (A):

(A)

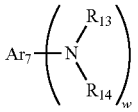

wherein $R_{13}$ and $R_{14}$ represent an acyl group, a substituted or an unsubstituted alkyl group, a substituted or an unsubstituted aryl group or a substituted or an unsubstituted alkenyl group; $Ar_7$ represents an aryl group; and h represents an integer of from 1 to 3.

Specific examples of the acyl group include an acetyl group, a propionyl group, benzoyl group, etc. Specific examples of the substituted or unsubstituted alkyl group include an alkyl group having 1 to 12 carbon atoms. Specific examples of the substituted or unsubstituted aryl group include a phenyl group, a naphthyl group, a biphenylyl group, a terphenylyl group, pyrenyl group, a fluorenyl group, 9,9-dimethyl-fluorenyl group, azulenyl group, an anthryl group, a triphenylenyl group, a chrysenyl group and groups having the following formulae:

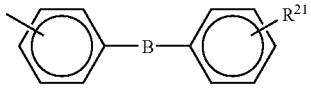

wherein B represents —O—, —S—, —SO—, —$SO_2$—, —CO— and the following bivalent groups; and $R^{21}$ represents a hydrogen atom, an alkyl group having 1 to 12 carbon atoms, an alkoxy group, a halogen atom, the above-mentioned substituted or unsubstituted aryl groups, an amino group, a nitro group and a cyano group;

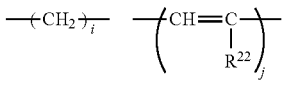

wherein $R^{22}$ represents a hydrogen atom, an alkyl group having 1 to 12 carbon atoms and the above-mentioned substituted or unsubstituted aryl groups; i represents an integer of from 1 to 12; and j represents an integer of from 1 to 3.

Specific examples of the alkoxy group include a methoxy group, an ethoxy group, a n-propoxy group, an i-propoxy group, a n-butoxy group, an i-butoxy group, a s-butoxy group, a t-butoxy group, a 2-hydroxyethoxy group, 2-cyanoethoxy group, a benzyloxy group, a 4-methylbenzyloxy group, a trifluoromethoxy group, etc.

Specific examples of the halogen atom include a fluorine atom, a chlorine atom, a bromine atom and an iodine atom.

Specific examples of the amino group include a diphenylamino group, a ditolylamino group, a dibenzylamino group, a 4-methylbenzyl group, etc.

Specific examples of the aryl group include a phenyl group, a naphthyl group, a biphenylyl group, a terphenylyl group, pyrenyl group, a fluorenyl group, 9,9-dimethyl-fluorenyl group, azulenyl group, an anthryl group, a triphenylenyl group and a chrysenyl group.

$Ar_7$, $R_{13}$ and $R_{14}$ may have an alkyl group having 1 to 12 carbon atoms, an alkoxy group and a halogen atom as a substituent.

Specific examples of the heterocyclic compound skeleton having one or more tertiary amino group include heterocyclic compounds having an amine structure such as pyrrole, pyrazole, imidazole, triazole, dioxazole, indole, isoindole, indoline, benzimidazole, benzotriazole, benzoisoxadine, carbazole and phenoxadine. These may have an alkyl group having 1 to 12 carbon atoms, an alkoxy group and a halogen atom as a substituent.

At least $B_1$ or $B_2$ is a hydrogen atom, and the other is an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group.

The acrylic acid ester compound having formula (4) is preferably a compound having the following formula (5):

(5)

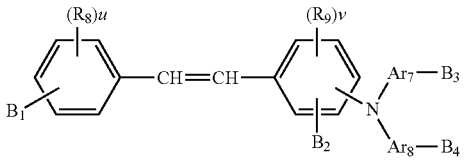

wherein $R_8$ and $R_9$ represent a substituted or an unsubstituted alkyl group, a substituted or an unsubstituted alkoxy group and a halogen atom; and $Ar_7$ and $Ar_8$ represent a substituted or an unsubstituted aryl group or arylene group, and a substituted or an unsubstituted benzyl group; $B_1$ to $B_4$ are the same groups as $B_1$ and $B_2$ in the formula (1), and only one of them is present; represents 0 or an integer of from 1 to 5; and v represents 0 or an integer of from 1 to 4.

The acrylic acid ester compound has the following characteristics. The acrylic acid ester compound is a tertiary amine compound having a developed stilbene conjugate structure. Such a charge transport compound having a developed conjugate structure very much improves charge injection at an interface of the crosslinked layer. Further, even when fixed between crosslinked bond, intermolecular interactions are difficult to impair and has good charge transportability. Having a highly radical-polymerizable acryloyloxy group or a methacryloyloxy group, the ester acrylic acid ester compound quickly gelates when radical-polymerized and does not have an excessive crosslink distortion. The double-bonding of the stilbene conjugate structure partially participates in the polymerization, and less polymerizes than the acryloyloxy group or methacryloyloxy group, which causes a time difference in the crosslinking reaction and the strain is not maximized. In addition, the double-bonding participating in the polymerization can increase the number of crosslinking reactions per a molecular weight, resulting in higher crosslink density. Further, the double-bonding can control the polymerization with the crosslinking conditions, and can easily form a most suitable crosslinked film. Such a reaction can be performed with the esteracrylate compound of the present invention, but cannot be performed with e.g., an α-phenylstilbene double bonding.

The charge transport compound having a radical polymerizable functional group and formula (4), particularly formula (5), can form a highly-crosslinked film maintaining good electrical properties without being cracked, which prevents particulate materials such as silica from sticking to a photoreceptor and decreases defective white-spotted images.

The number of radical polymerizable functional groups is preferably less for the uniformity of a crosslinked structure, and preferably more for the abrasion resistance. In the present invention, the number thereof is determined in consideration of the balance.

NO. 1

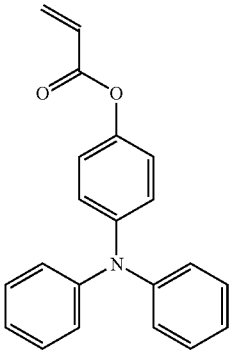

NO. 2

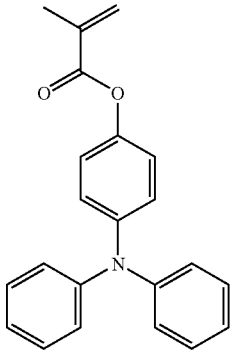

NO. 3

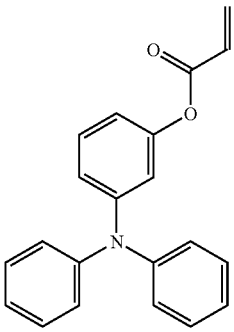

NO. 4

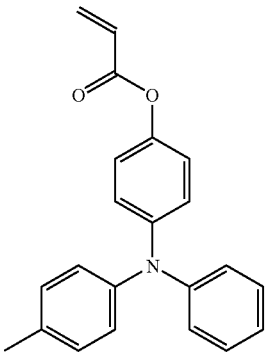

NO. 5

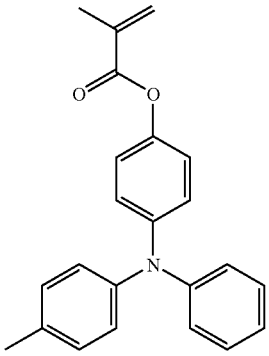

NO. 6

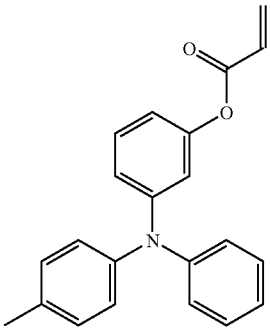

-continued
NO. 7
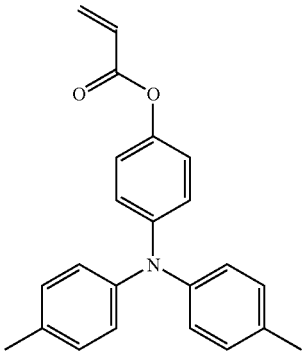
NO. 8
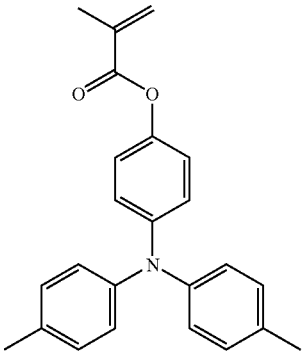
NO. 9
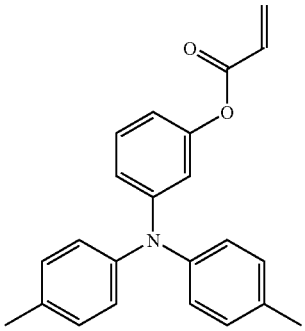
NO. 10
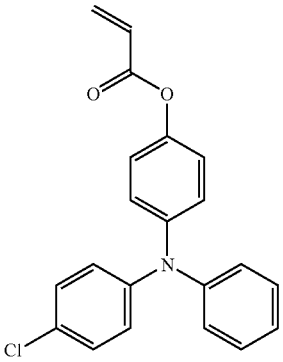
NO. 11
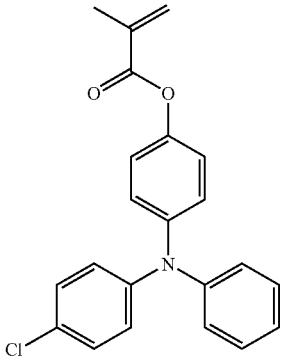
NO. 12
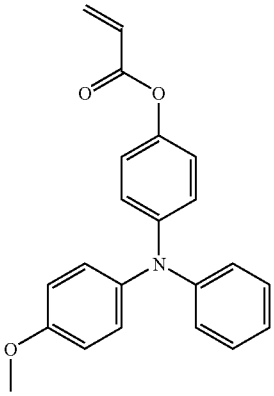
NO. 13
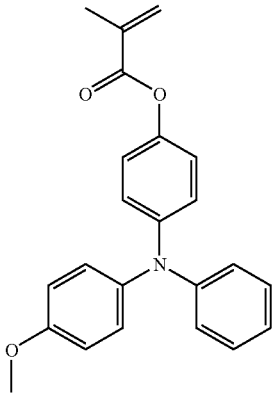
NO. 14
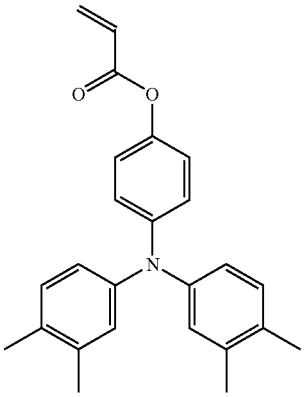

-continued
NO. 15
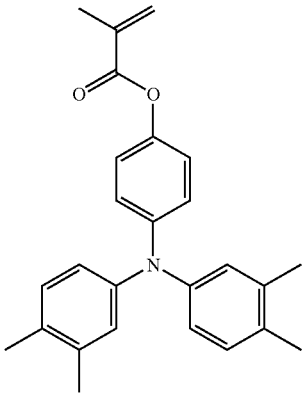
NO. 16
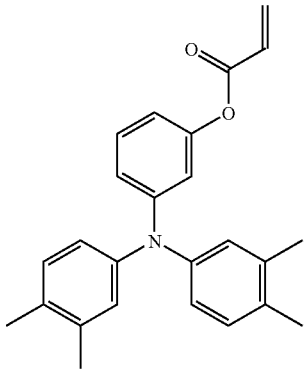
NO. 17
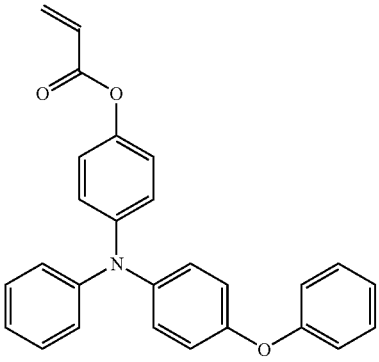
NO. 18
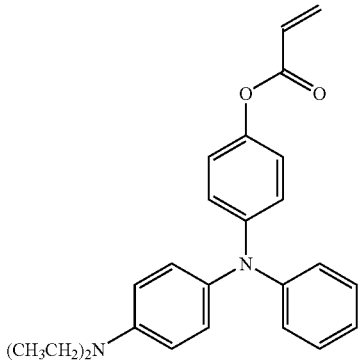
NO. 19
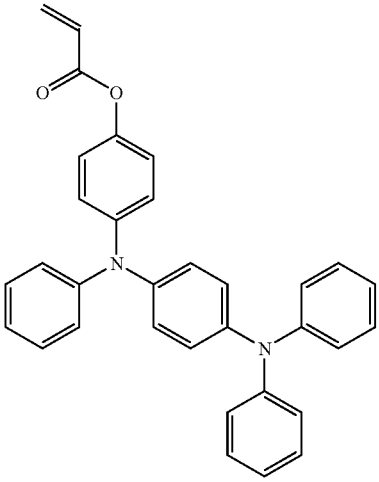
NO. 20
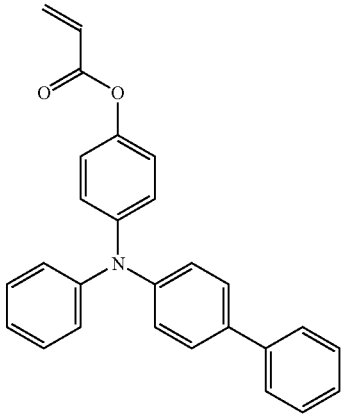
NO. 21
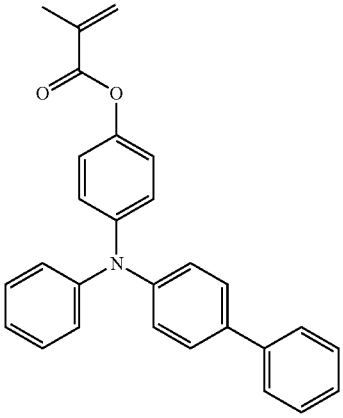
NO. 22
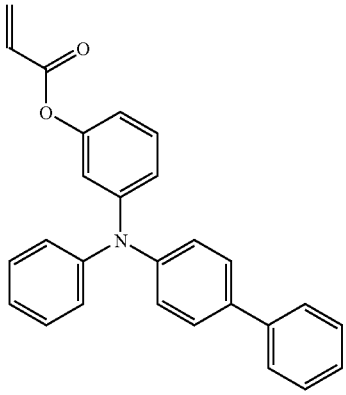

-continued
NO. 23
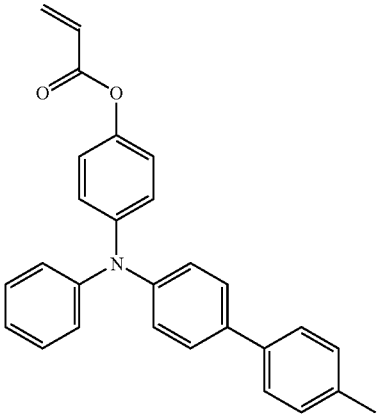
NO. 24
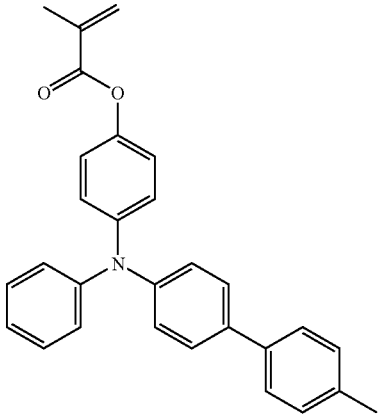
NO. 25
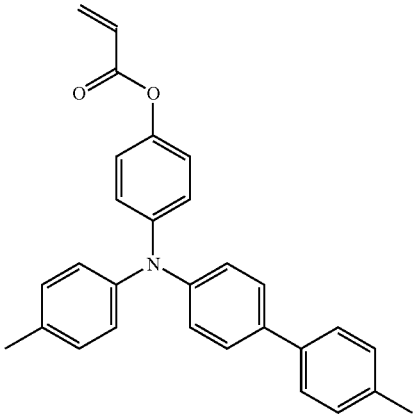
NO. 26
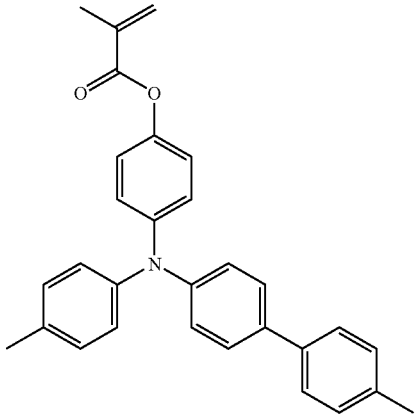
NO. 27
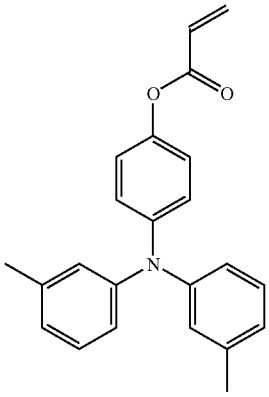
NO. 28
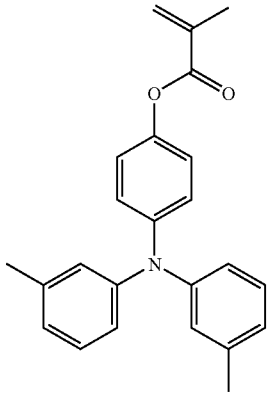
NO. 29
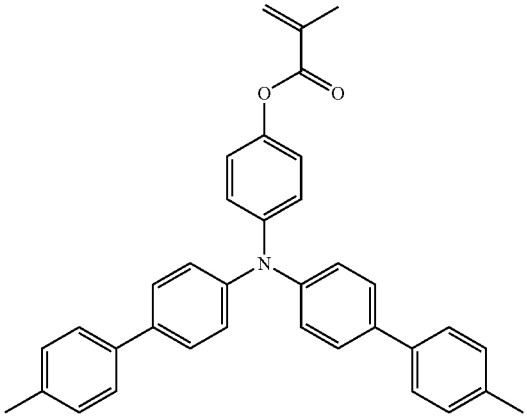
NO. 30
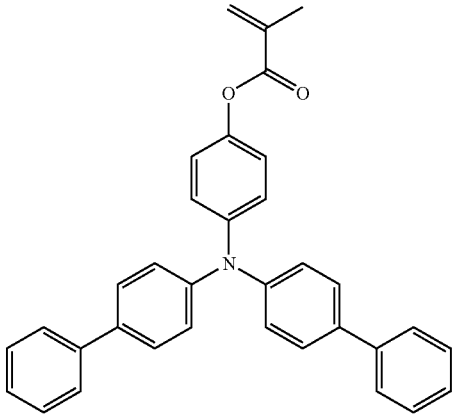

-continued
NO. 31
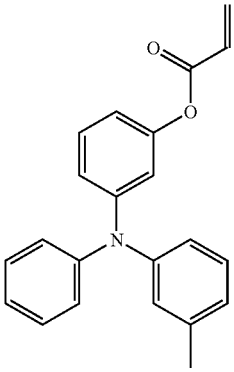
NO. 32
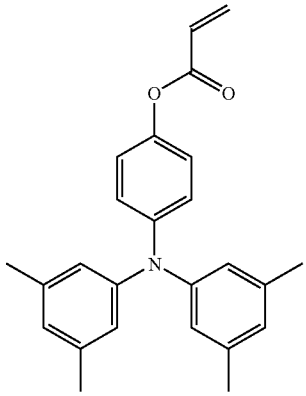
NO. 33
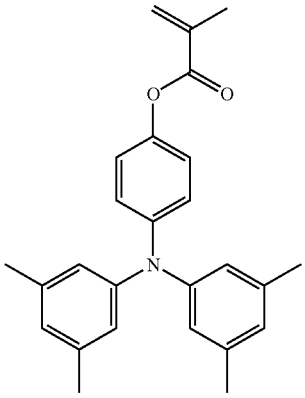
NO. 34
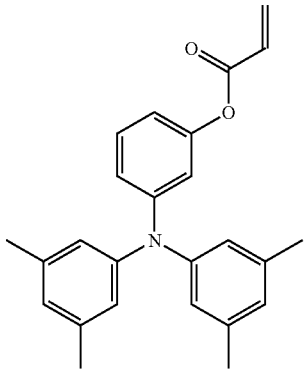
NO. 35
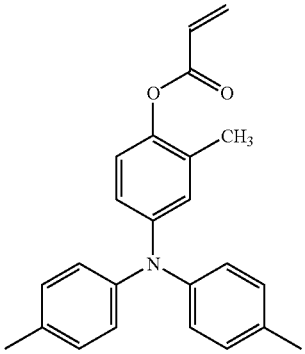
NO. 36
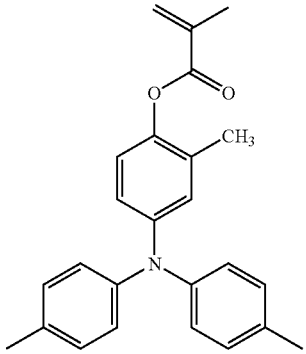
NO. 37
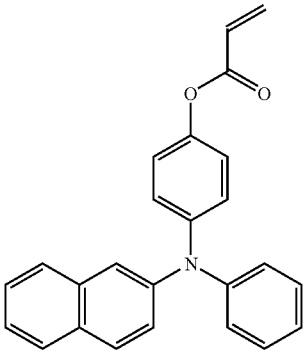
NO. 38
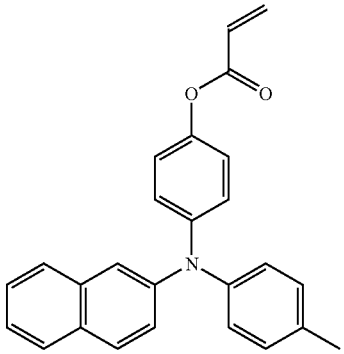

-continued
NO. 39
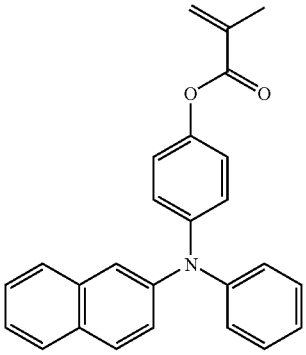
NO. 40
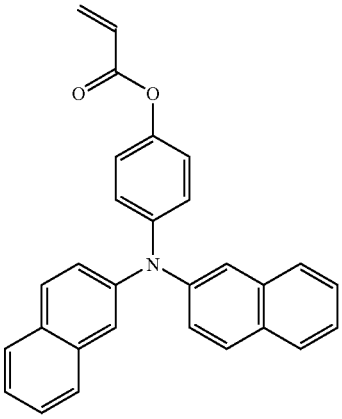
NO. 41
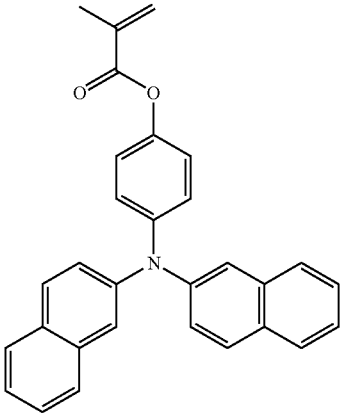
NO. 42
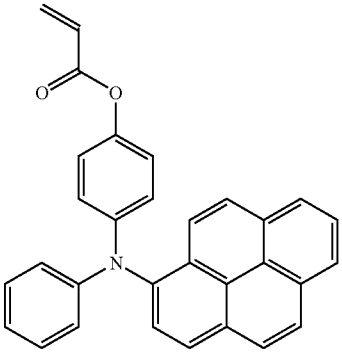
NO. 43
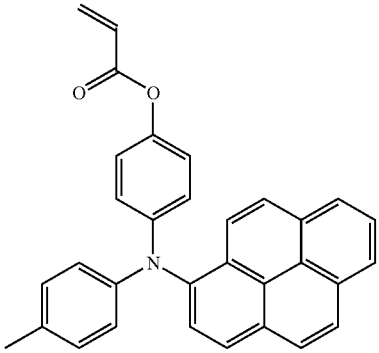
NO. 44
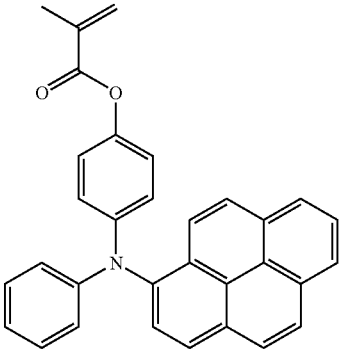
NO. 45
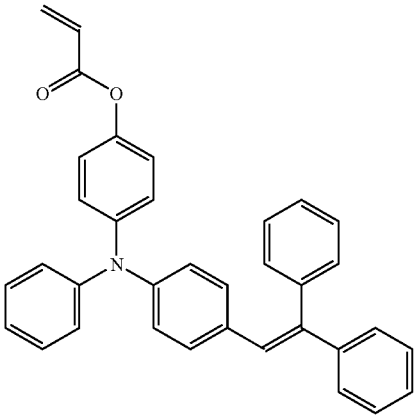
NO. 46
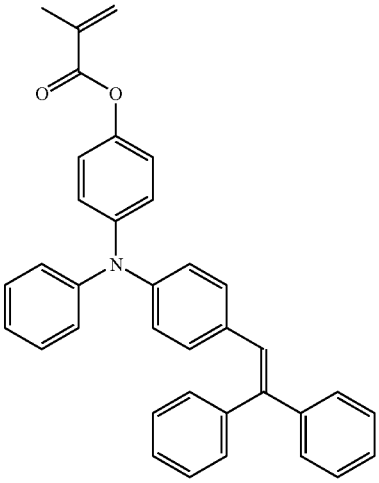

-continued
NO. 47
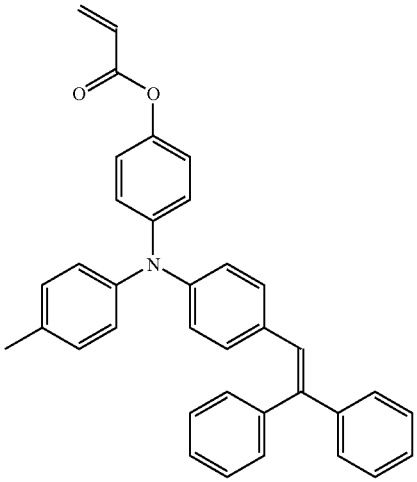
NO. 48
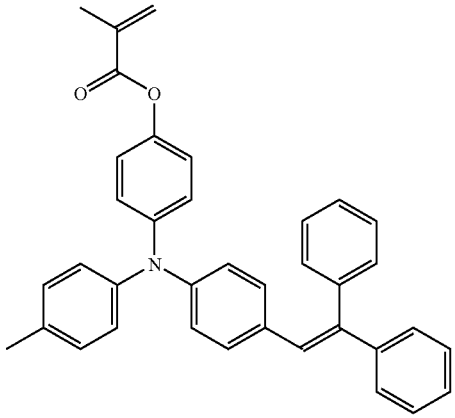
NO. 49
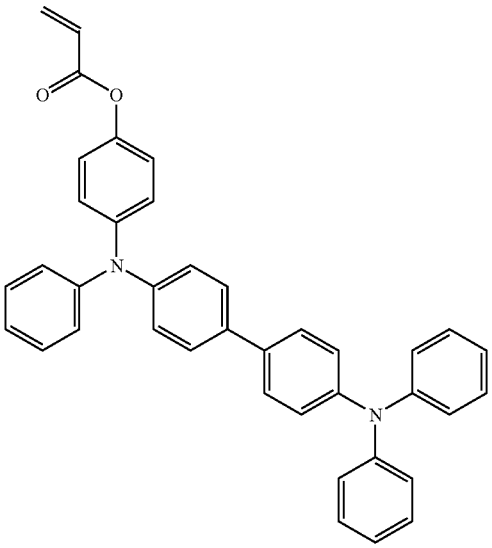
NO. 50
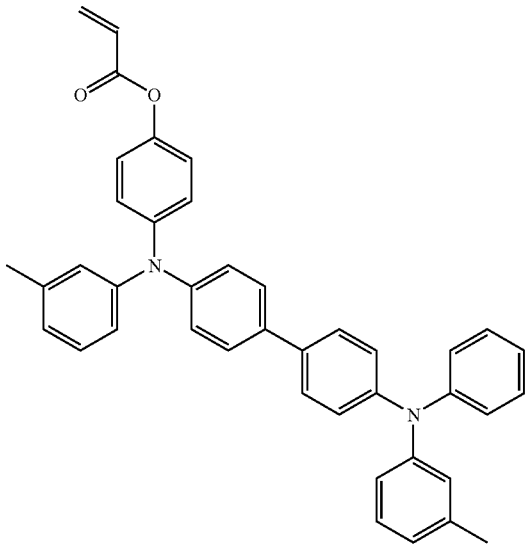
NO. 51
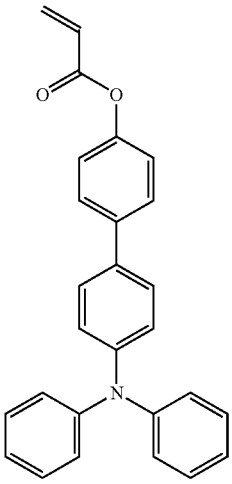
NO. 52
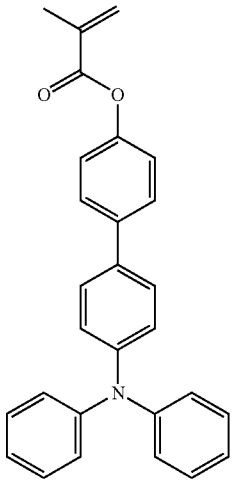

-continued
NO. 53
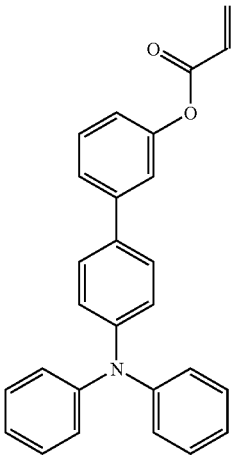
NO. 54
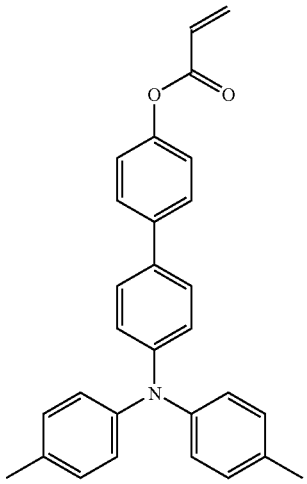
NO. 55
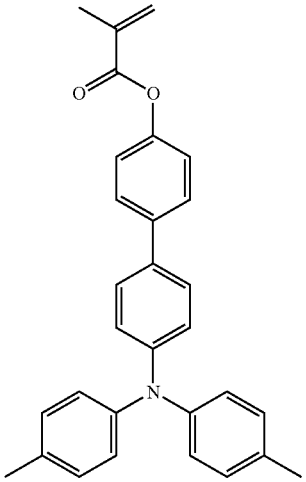
NO. 56
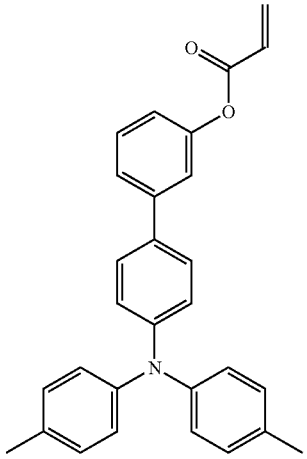
NO. 57
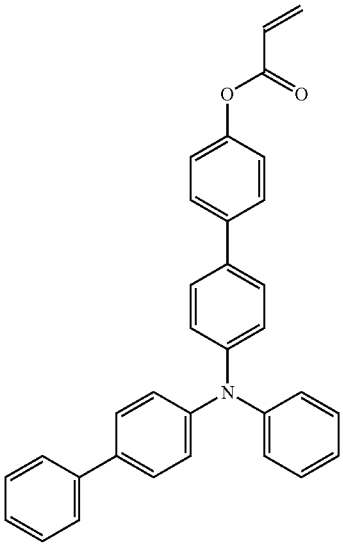
NO. 58
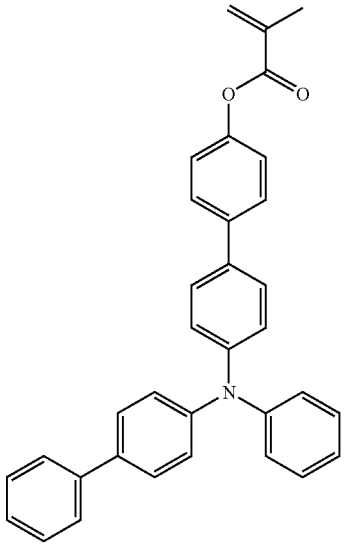

-continued
NO. 59
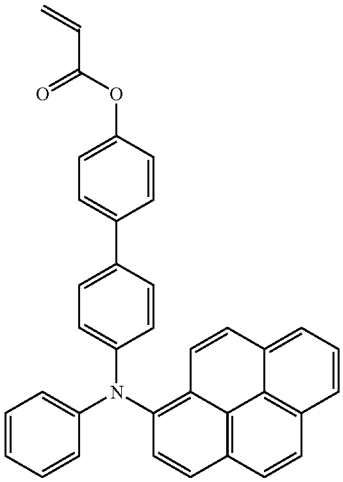
NO. 60
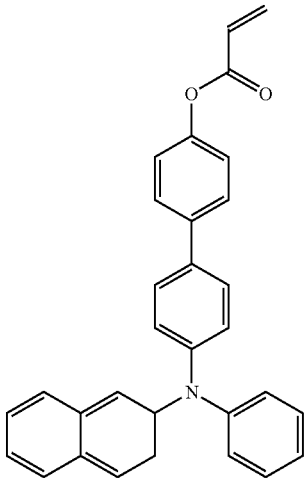
NO. 61
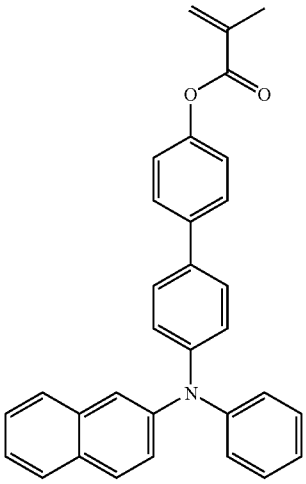
NO. 62
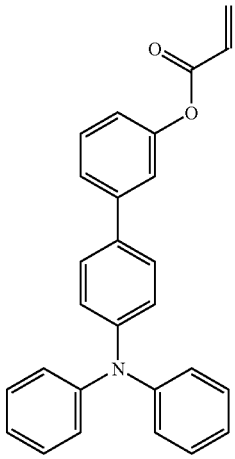
NO. 63
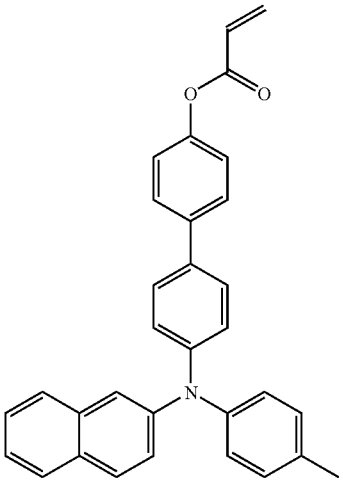
NO. 64
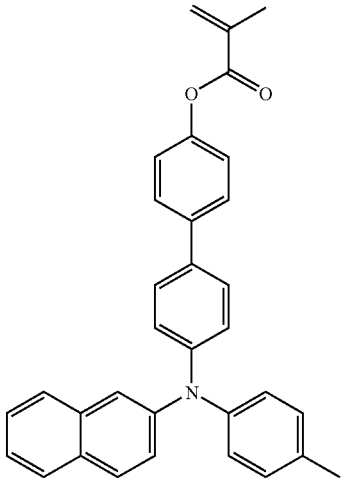

-continued
NO. 65
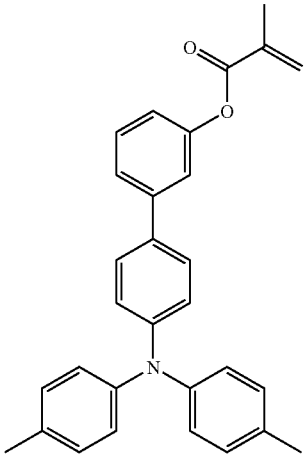
NO. 66
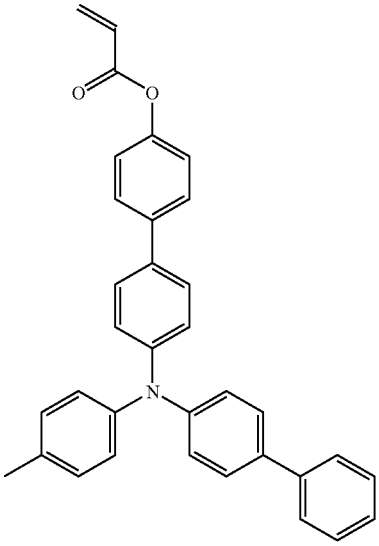
NO. 67
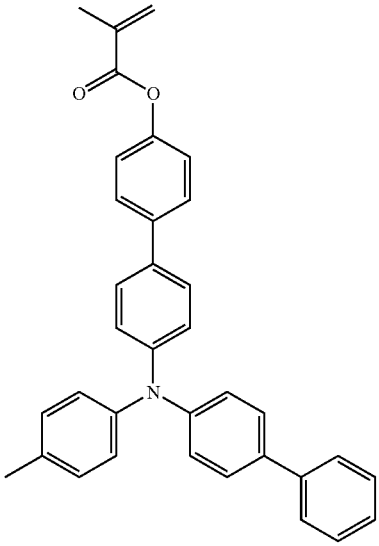
NO. 68
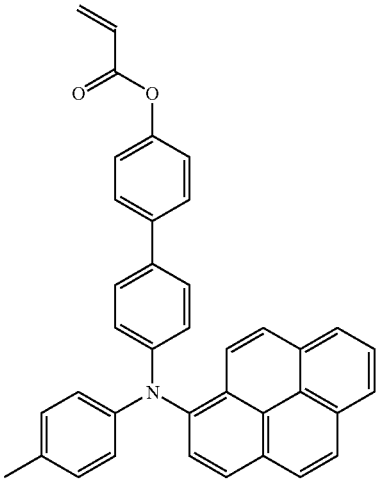
NO. 69
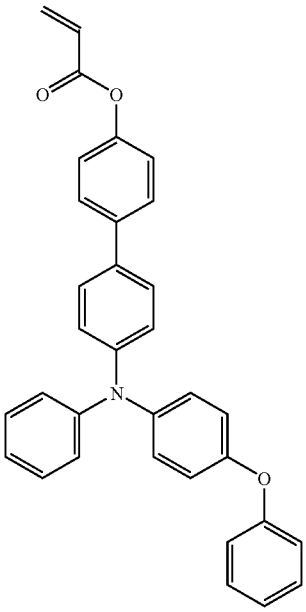
NO. 70
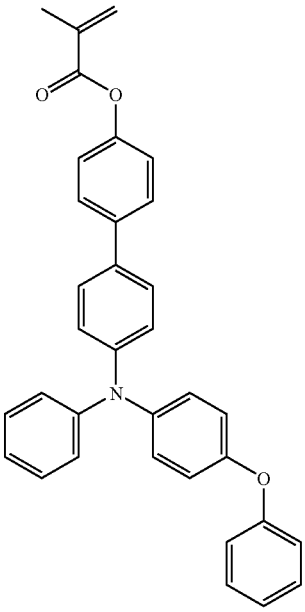

-continued
NO. 71
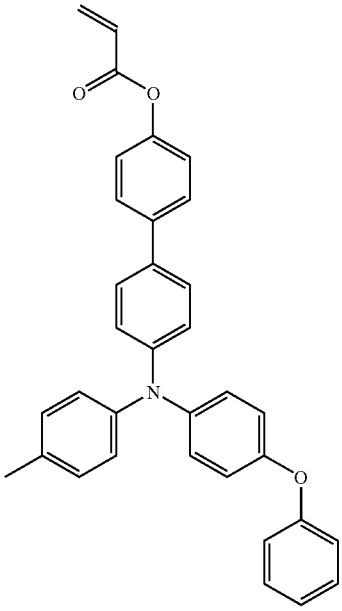
NO. 72
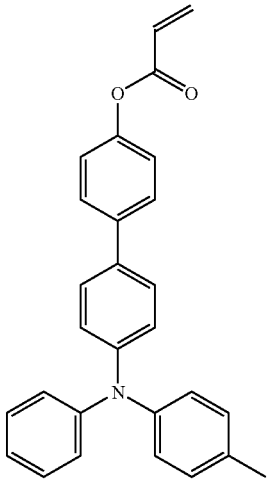
NO. 73
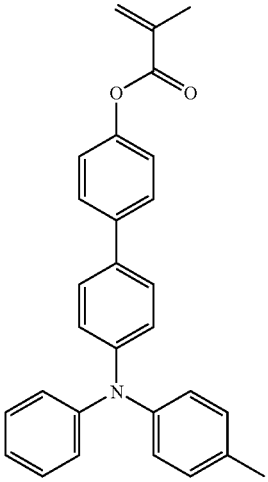
NO. 74
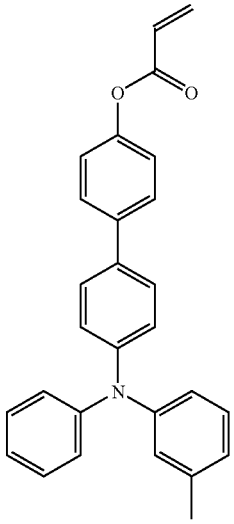
NO. 75
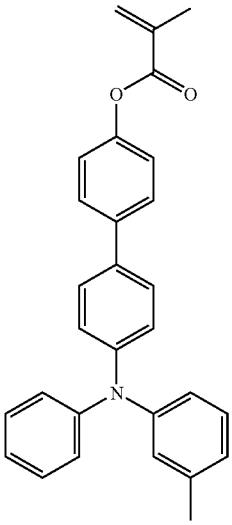
NO. 76
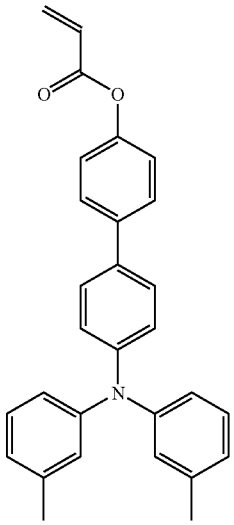

-continued
NO. 77
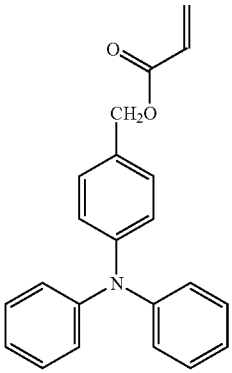
NO. 78
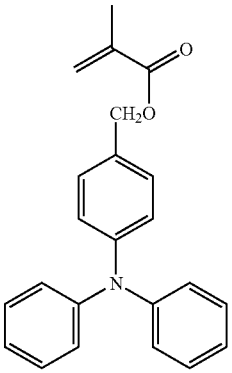
NO. 79
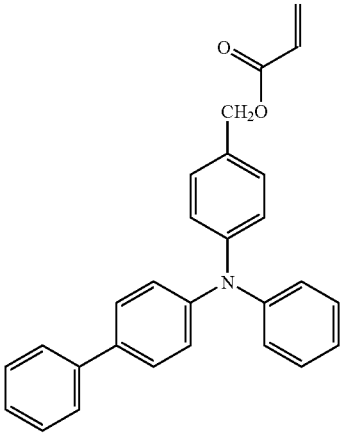
NO. 80
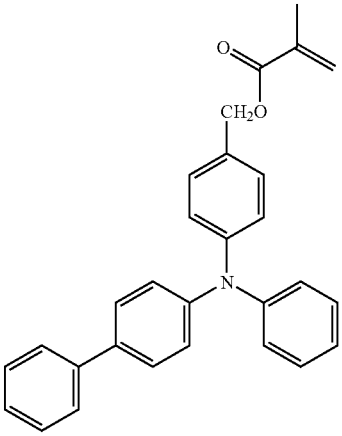
NO. 81
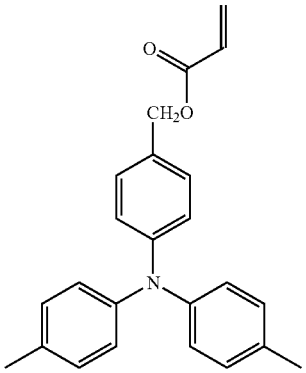
NO. 82
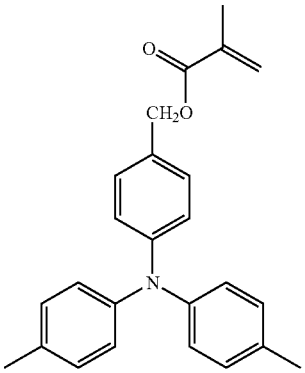
NO. 83
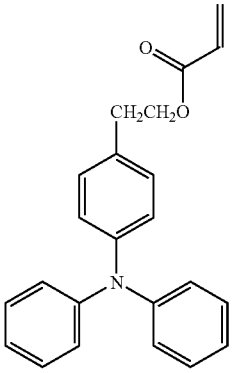
NO. 84
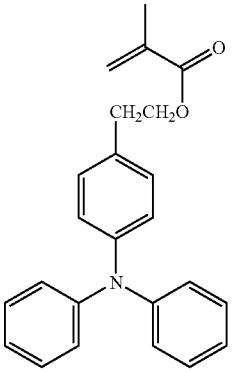

-continued
NO. 85
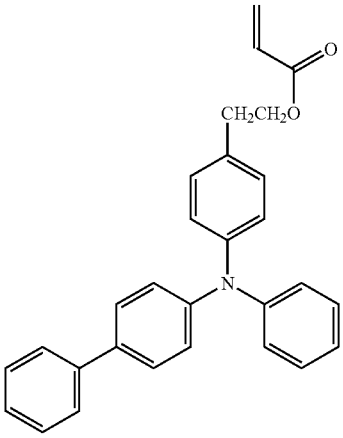
NO. 86
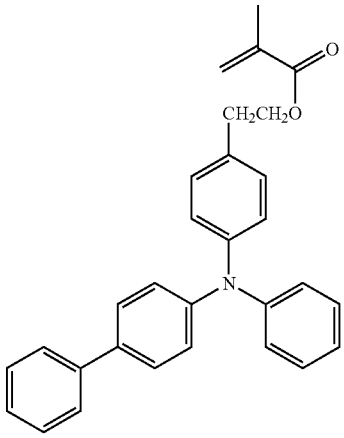
NO. 87
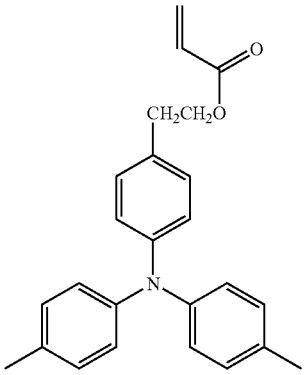
NO. 88
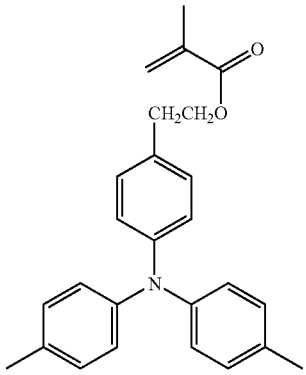
NO. 89
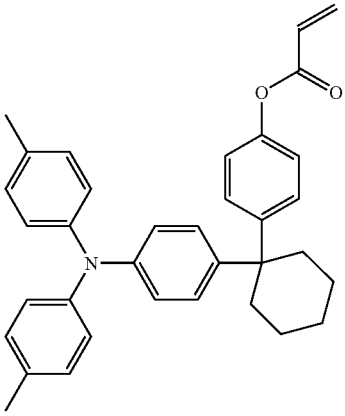
NO. 90
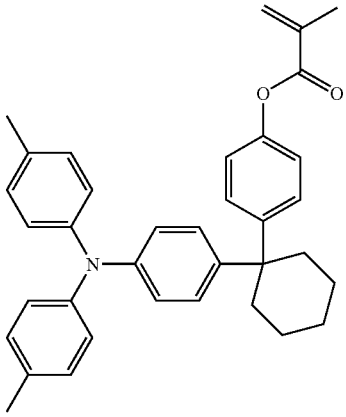

-continued
NO. 91
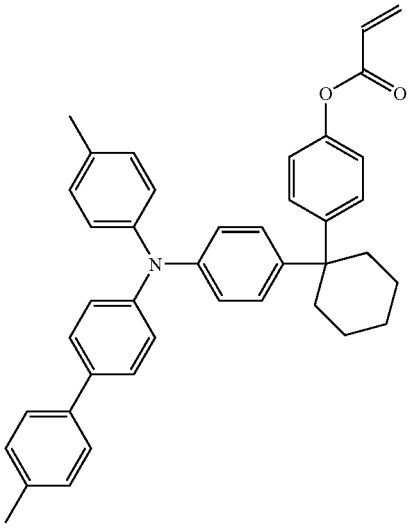
NO. 92
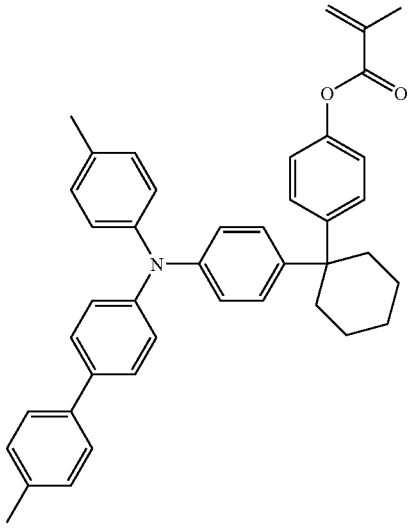
NO. 93
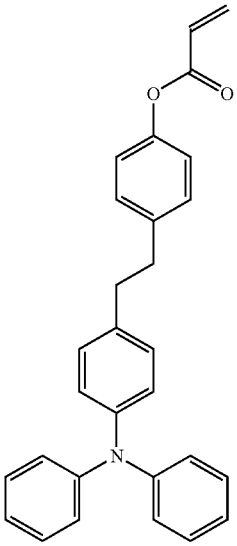
NO. 94
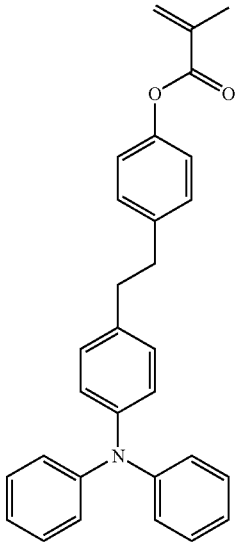
NO. 95
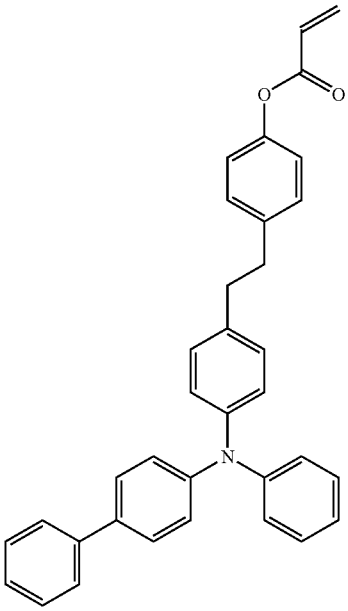
NO. 96
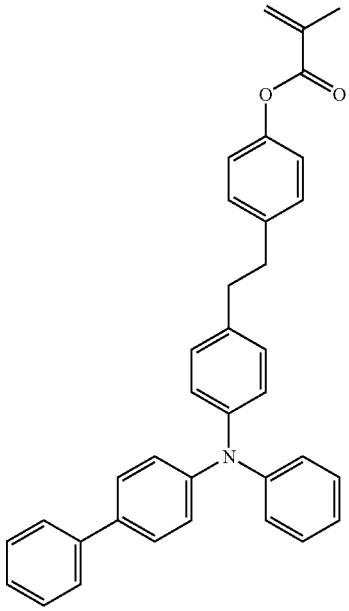

-continued
NO. 97
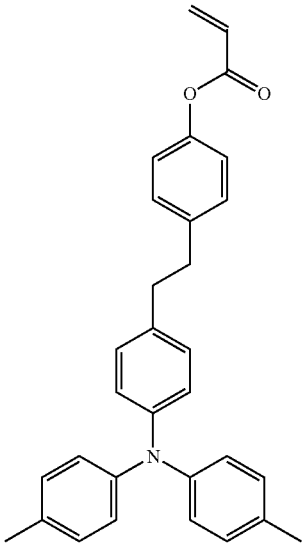
NO. 98
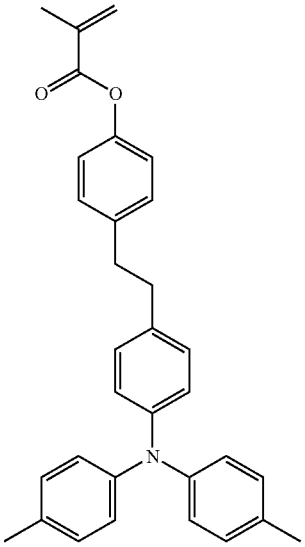
NO. 99
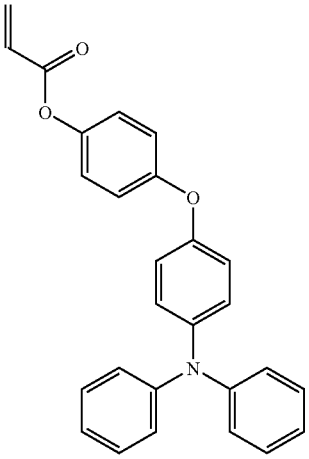
NO. 100
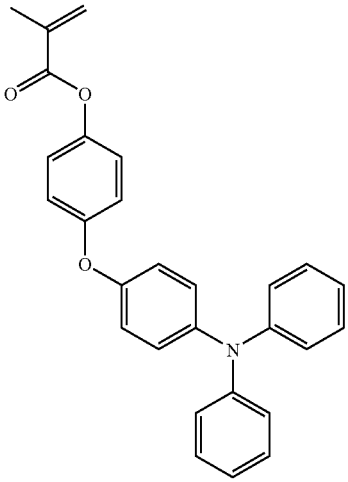
NO. 101
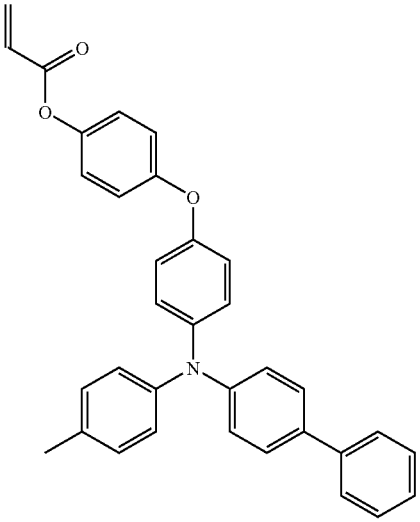
NO. 102
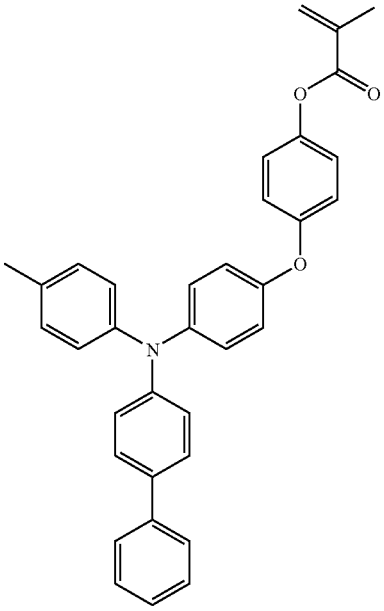

-continued
NO. 103
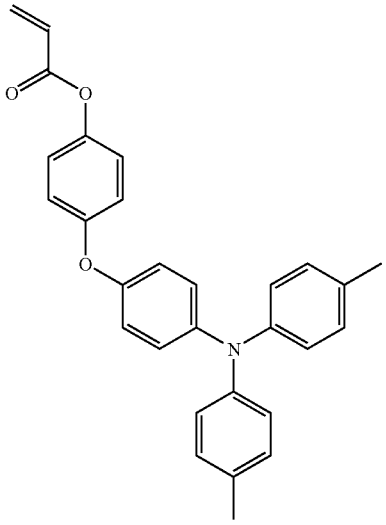
NO. 104
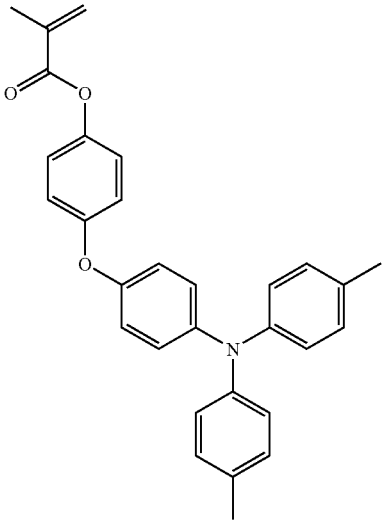
NO. 105
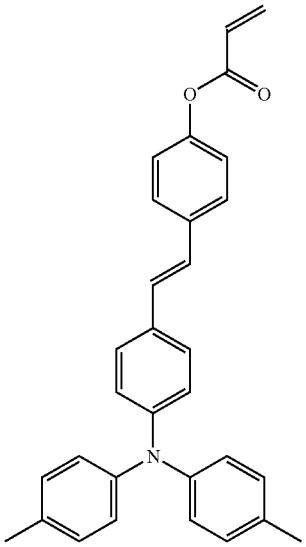
NO. 106
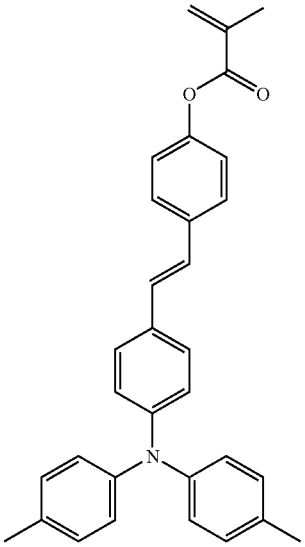
NO. 107
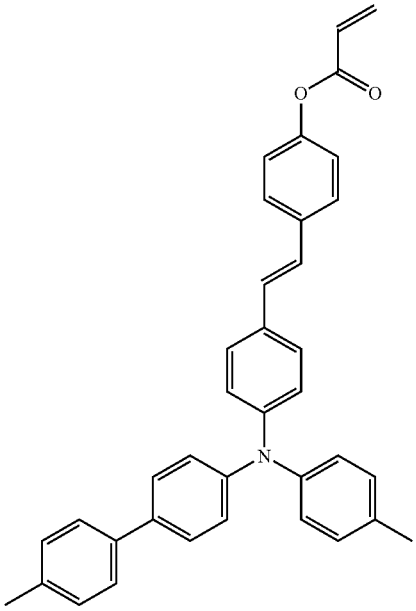
NO. 108
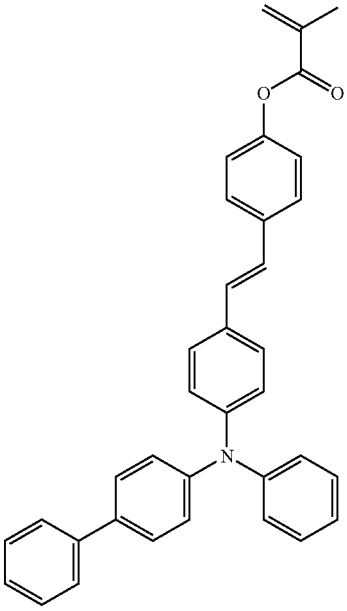

-continued
NO. 109
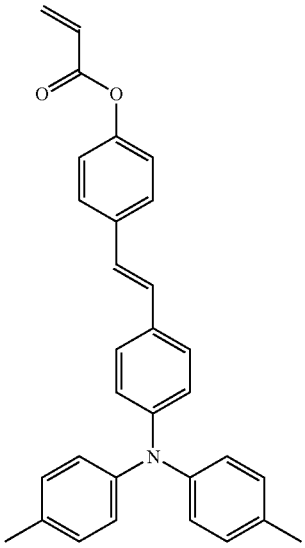
NO. 110
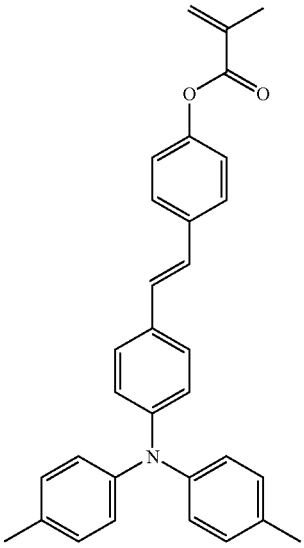
NO. 111
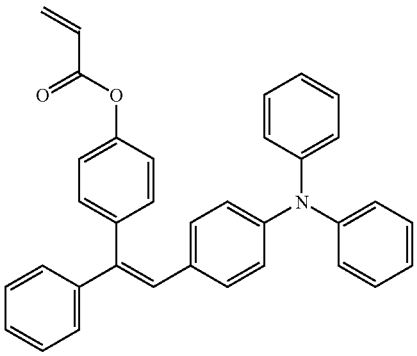
NO. 112
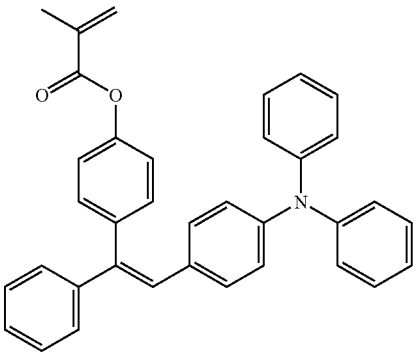
NO. 113
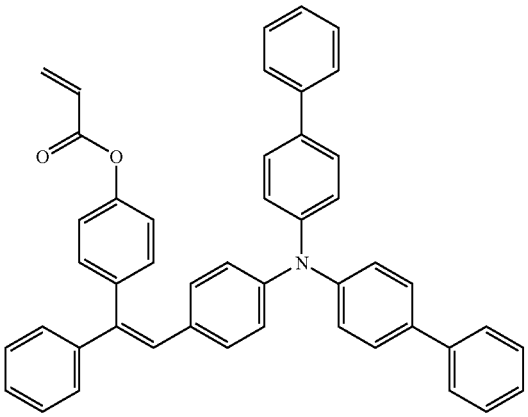
NO. 114
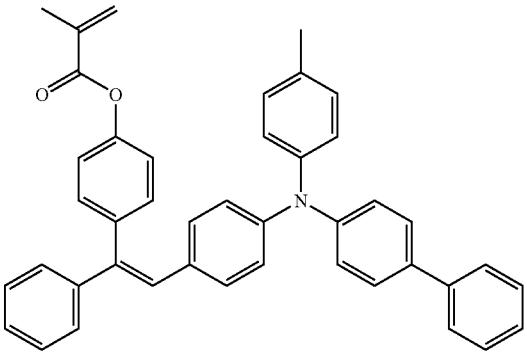

-continued
NO. 115
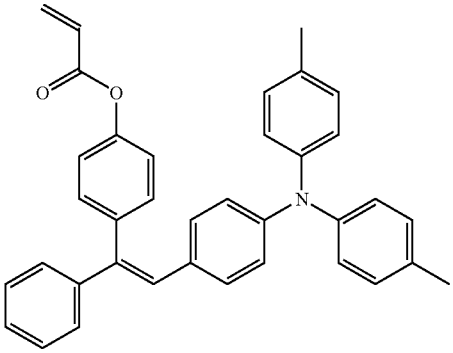
NO. 116
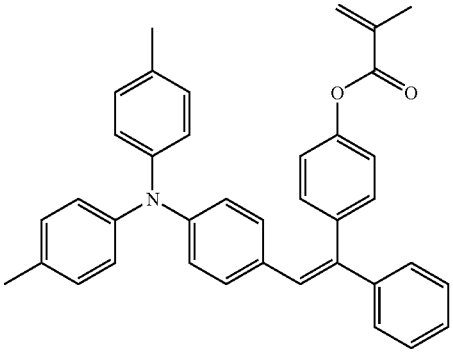
NO. 117
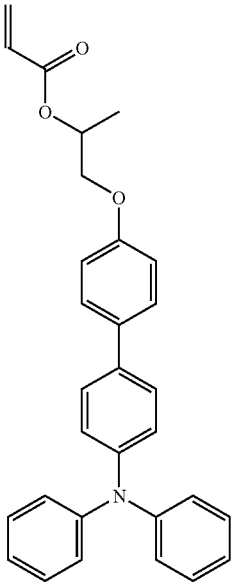
NO. 118
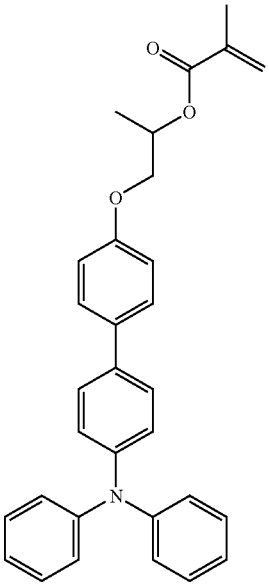
NO. 119
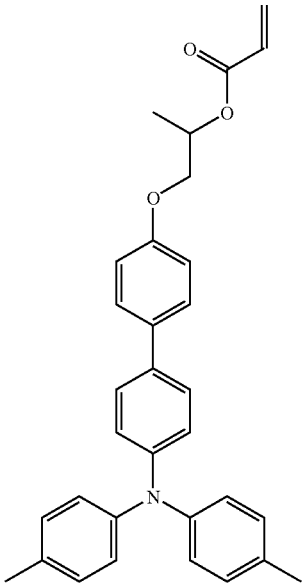
NO. 120
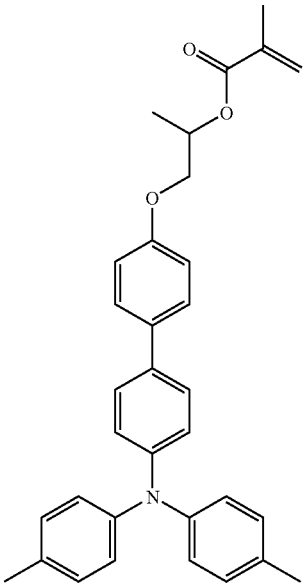

-continued
NO. 121
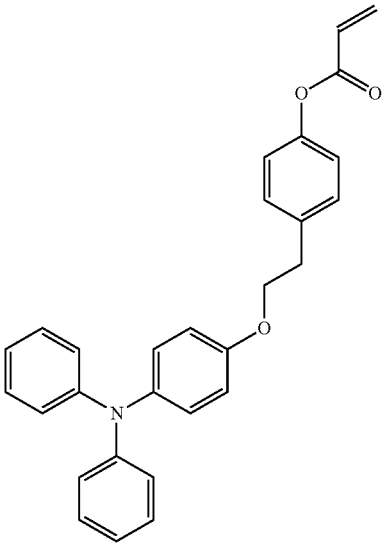
NO. 122
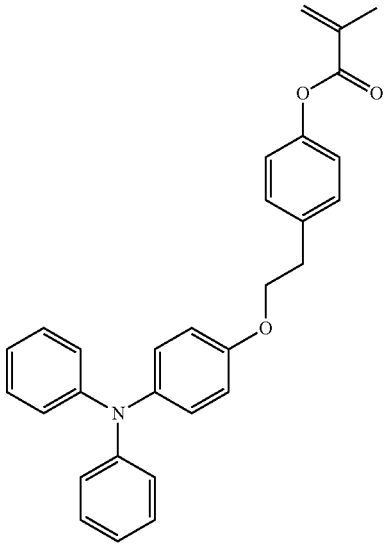
NO. 123
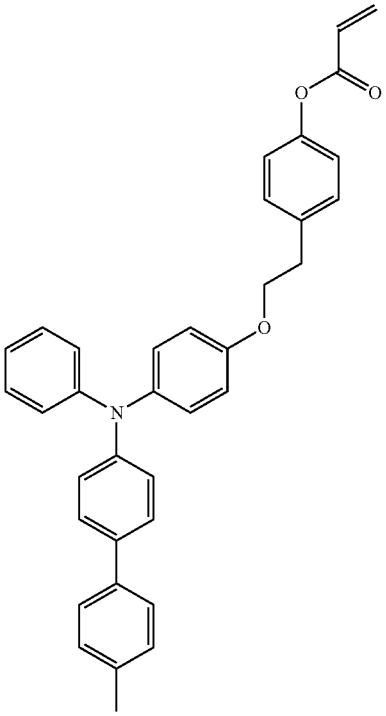
NO. 124
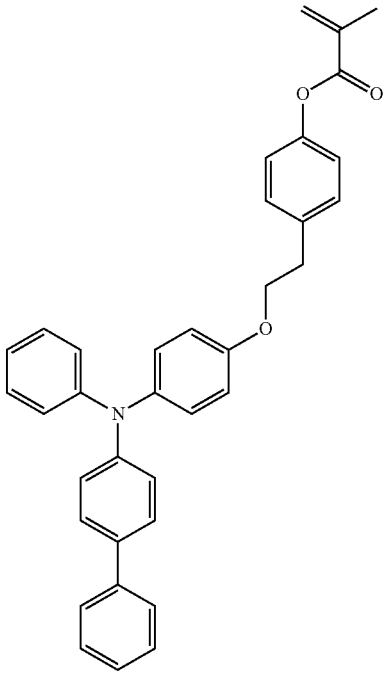

-continued
NO. 125
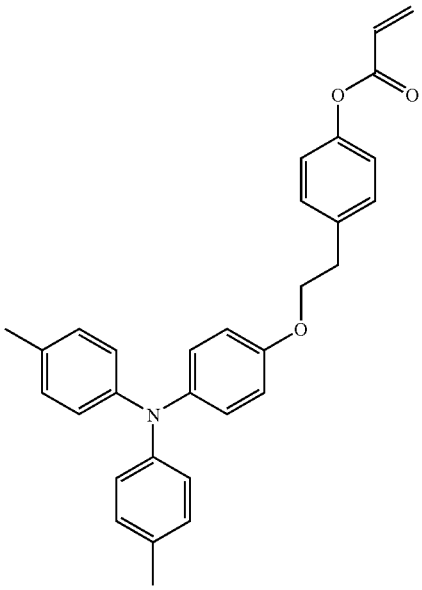
NO. 126
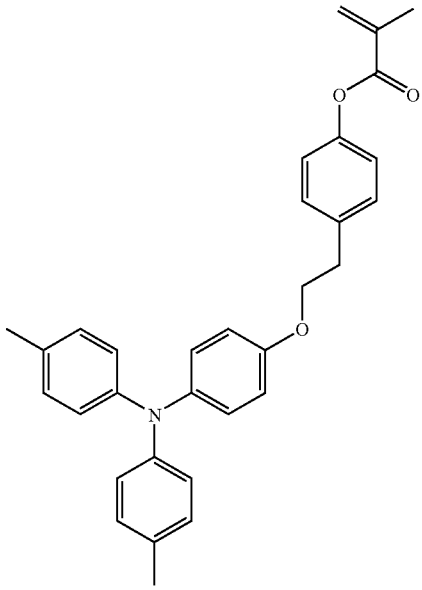
NO. 127
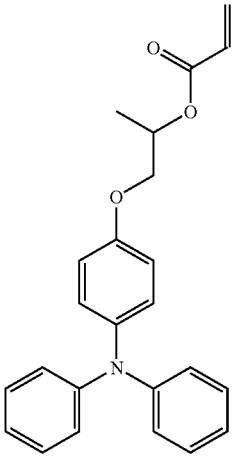
NO. 128
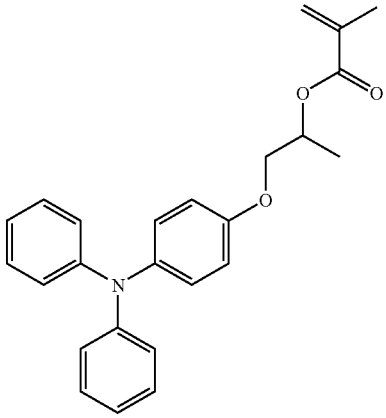
NO. 129
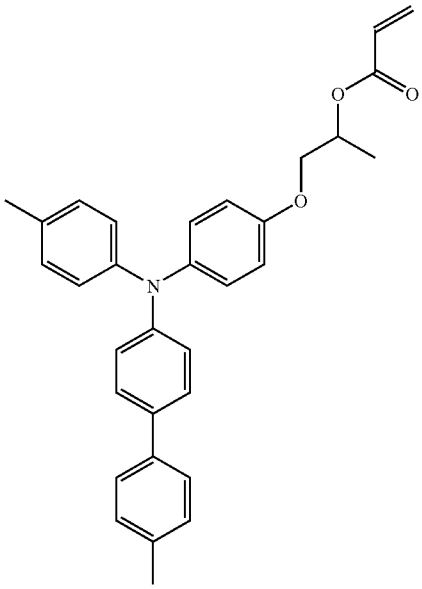
NO. 130
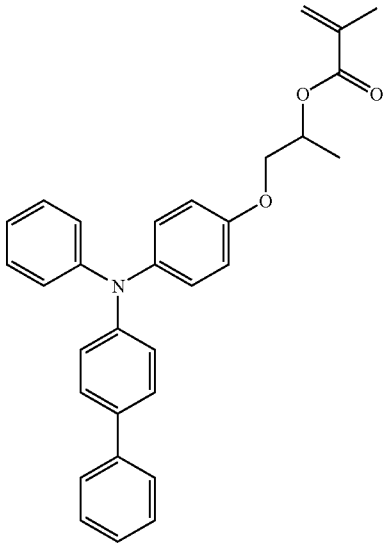

-continued
NO. 131
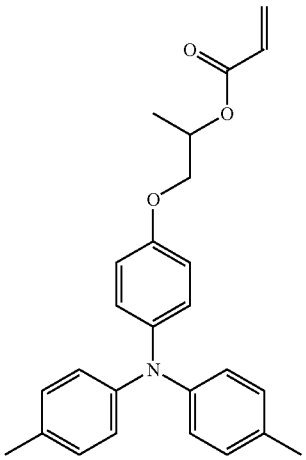
NO. 132
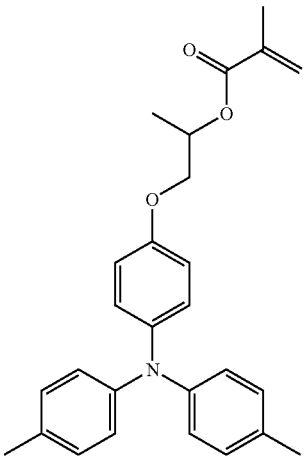
NO. 133
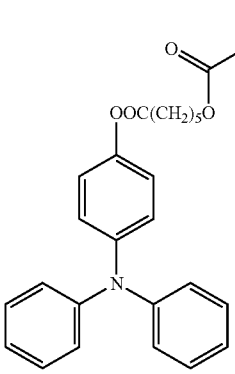
NO. 134
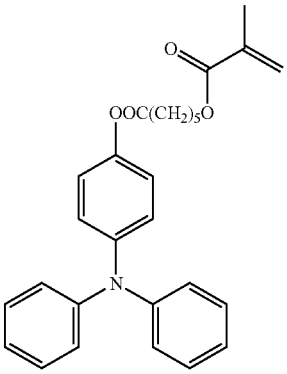
NO. 135
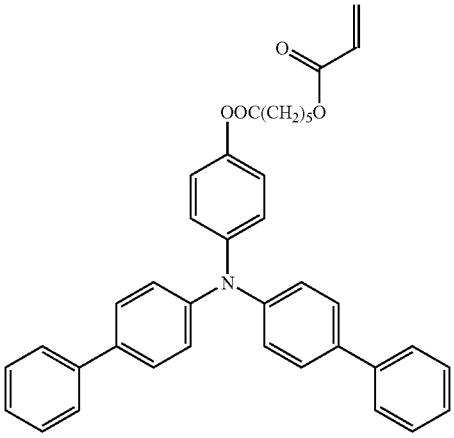
NO. 136
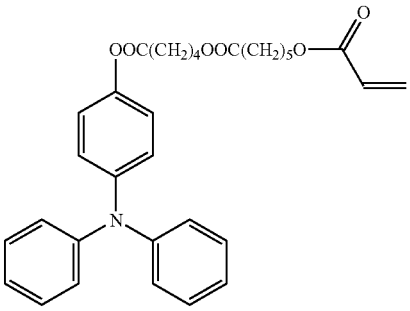

-continued
NO. 137
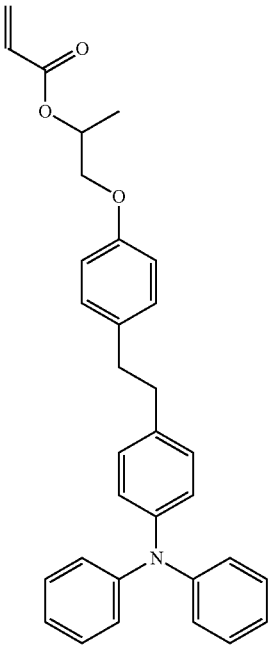
NO. 138
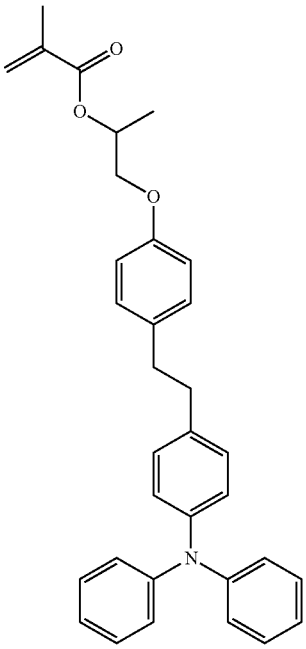
NO. 139
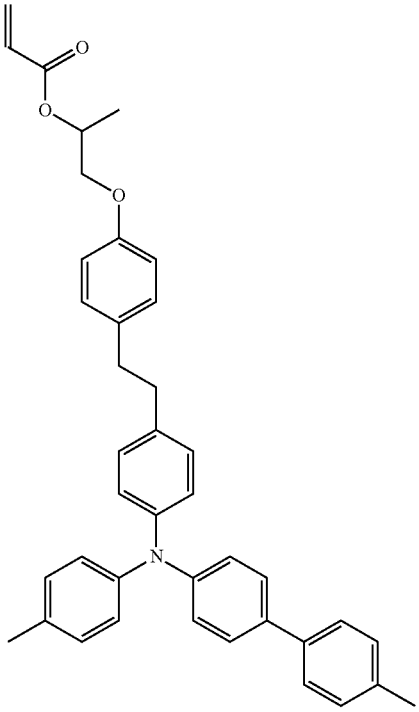
NO. 140
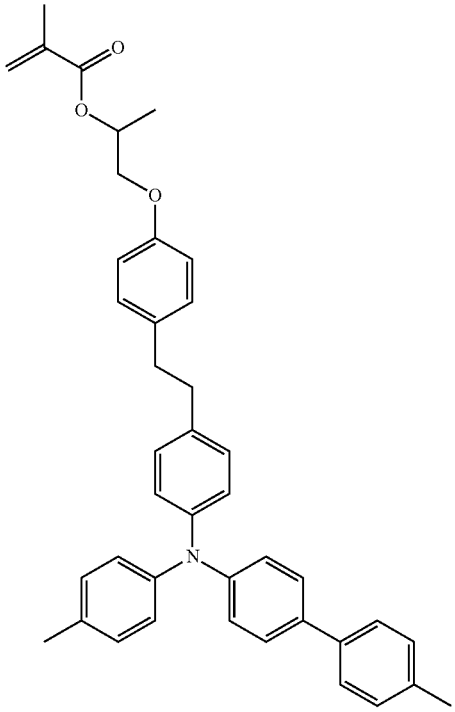
NO. 141
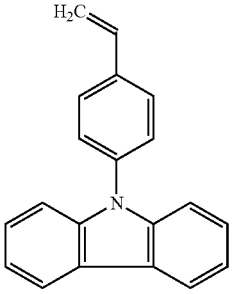

-continued
NO. 142
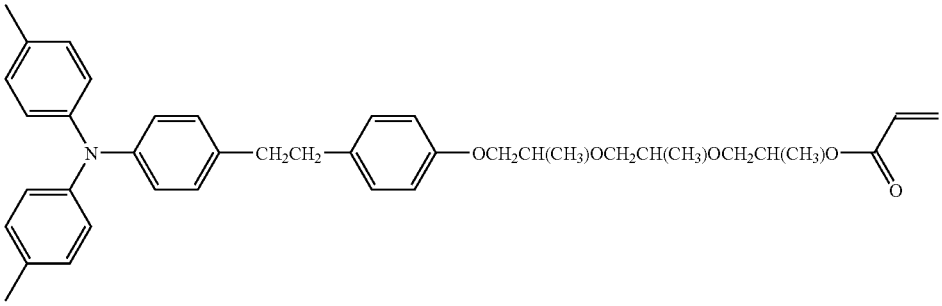
NO. 143
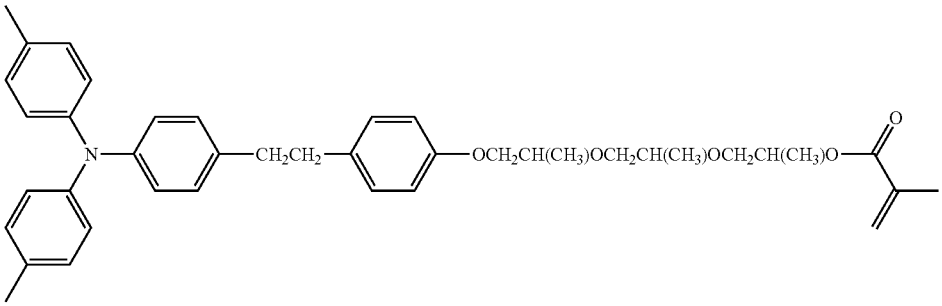
NO. 144
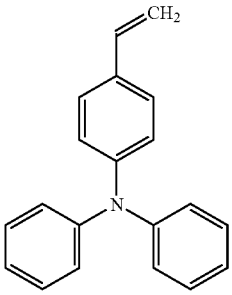
NO. 145
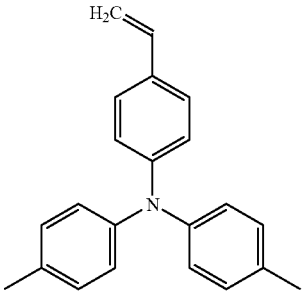
NO. 146
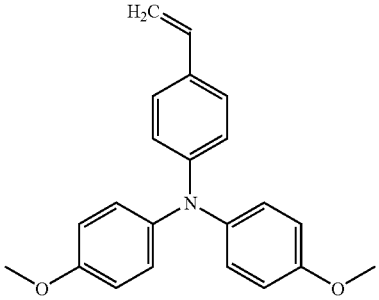
NO. 147
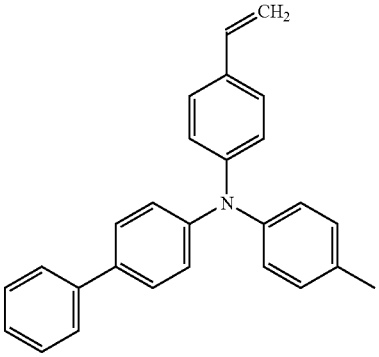
NO. 148
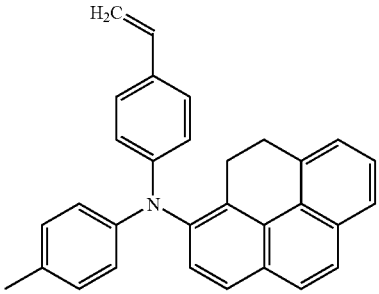
NO. 149
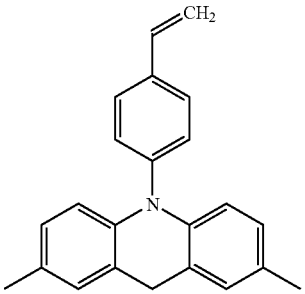

-continued
NO. 150
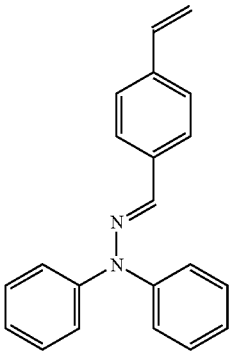
NO. 151
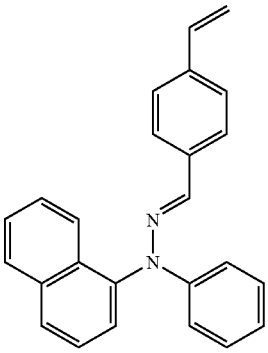
NO. 152
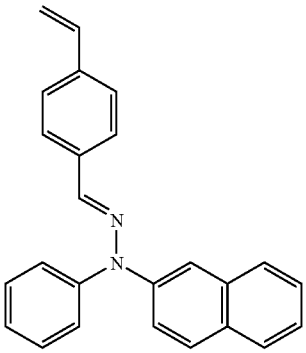
NO. 153
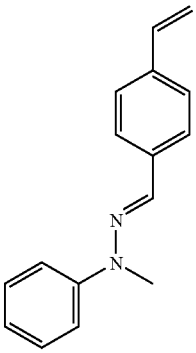
NO. 154
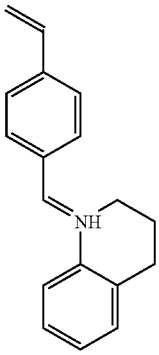
NO. 155
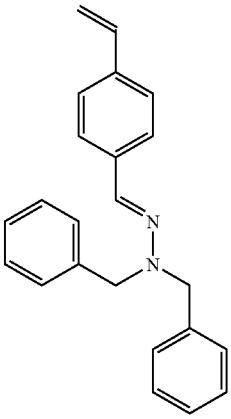
NO. 156
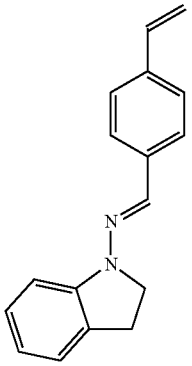
NO. 157
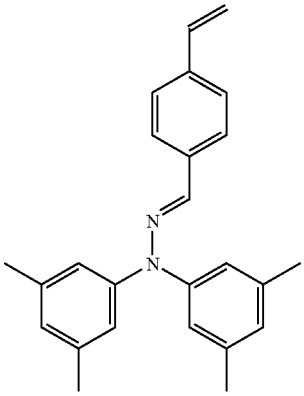

-continued
NO. 158
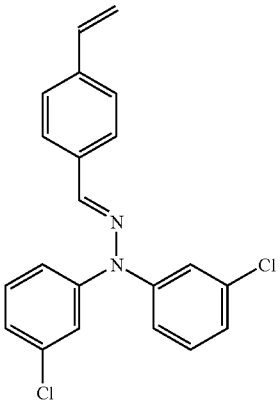
NO. 159
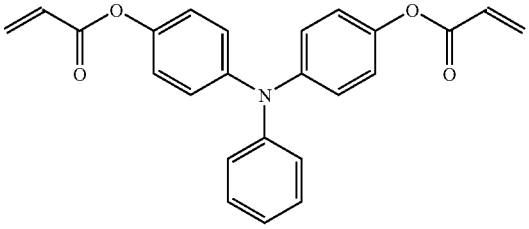
NO. 160
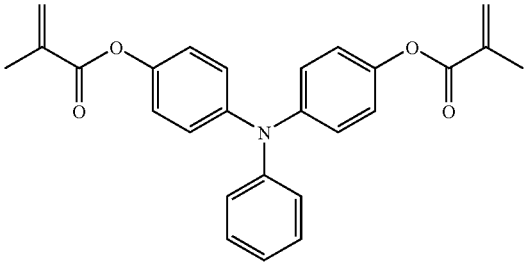
NO. 161
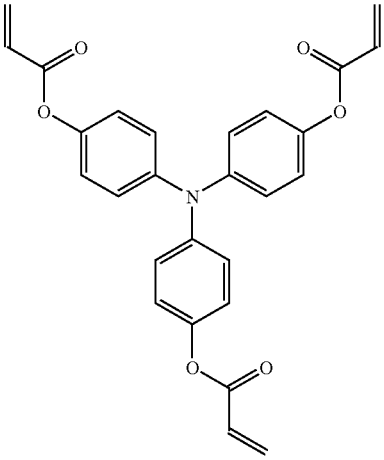
NO. 162
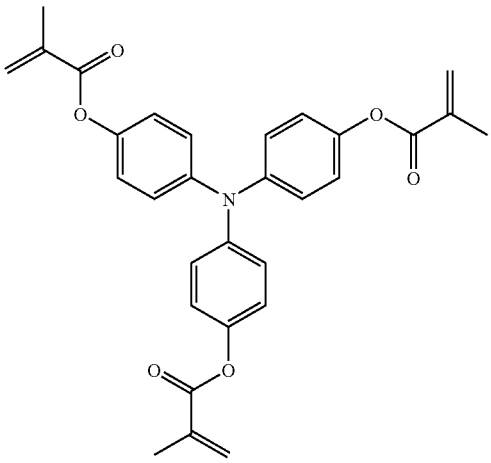
NO. 163
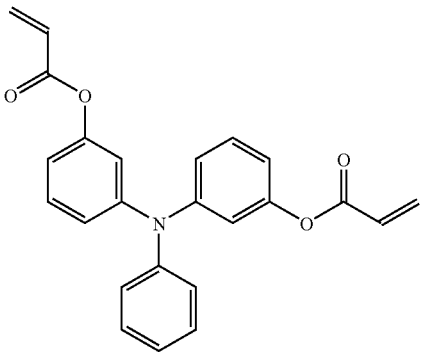

-continued
NO. 164
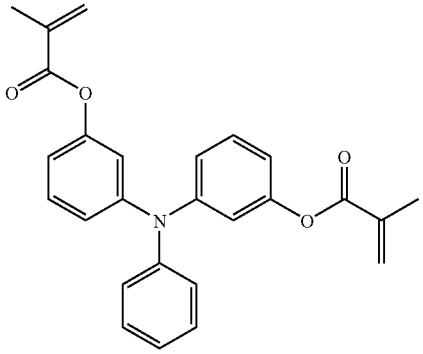
NO. 165
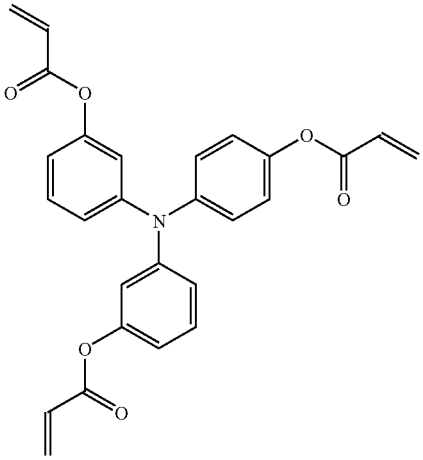
NO. 166
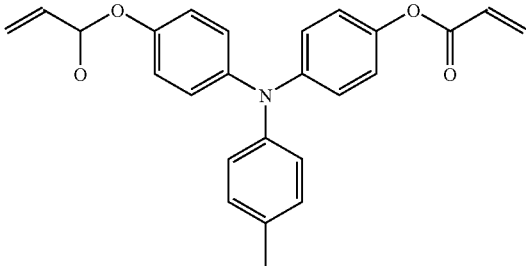
NO. 167
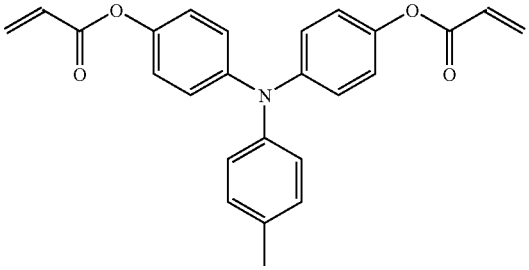
NO. 168
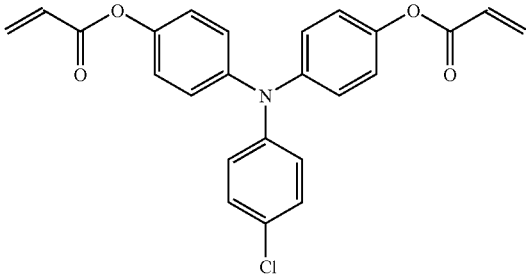
NO. 169
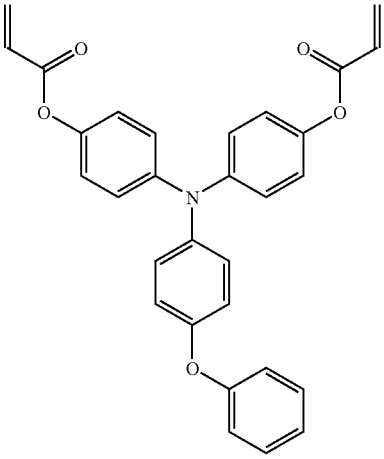

-continued
NO. 170
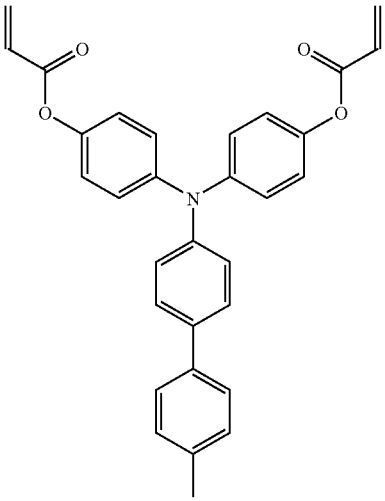
NO. 171
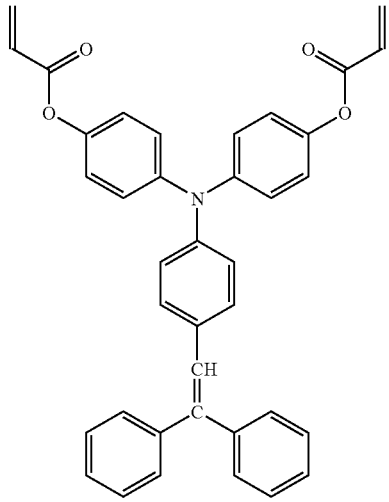
NO. 172
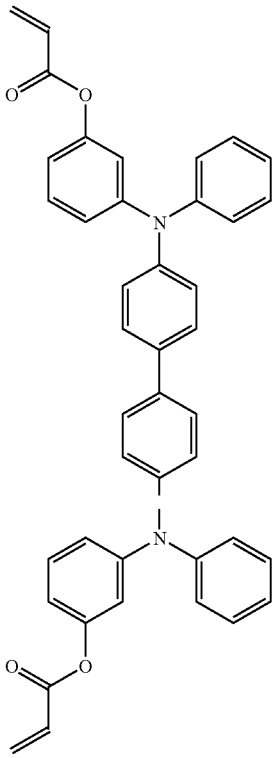

-continued
NO. 173
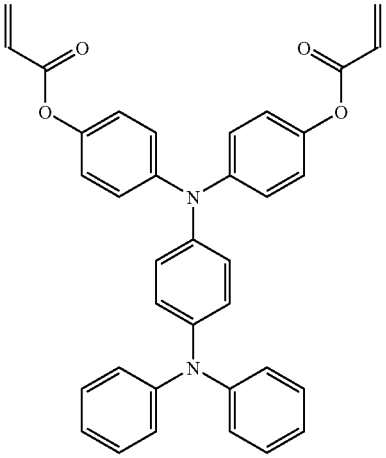
NO. 174
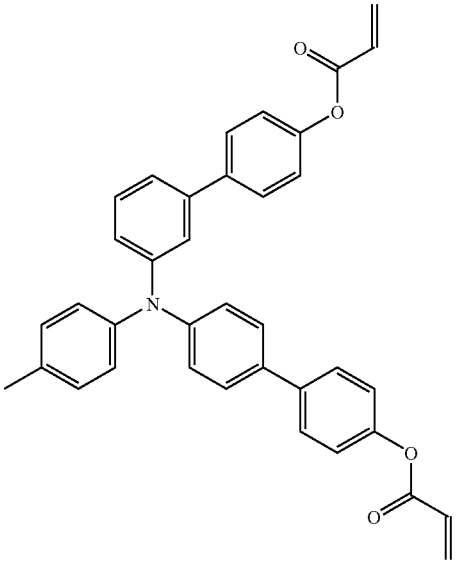
NO. 175
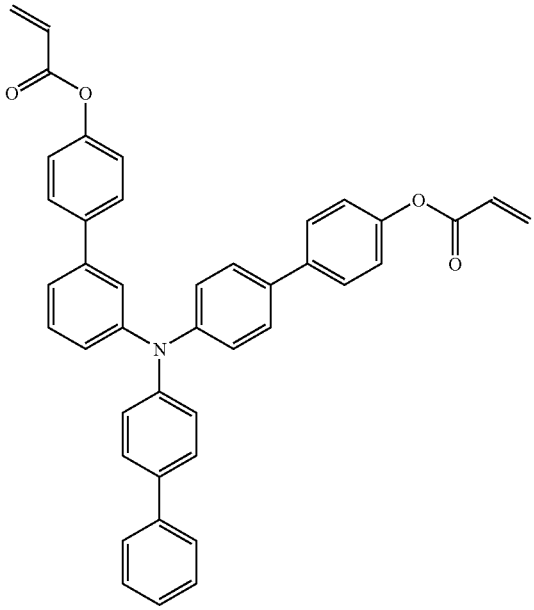
NO. 176
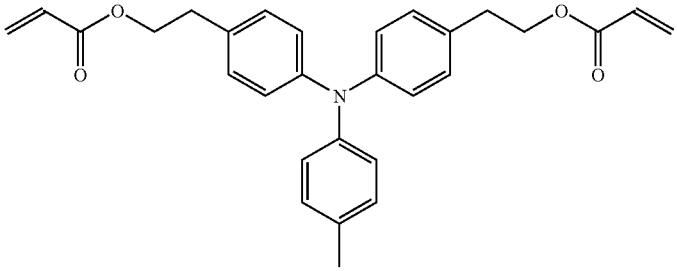

-continued
NO.177
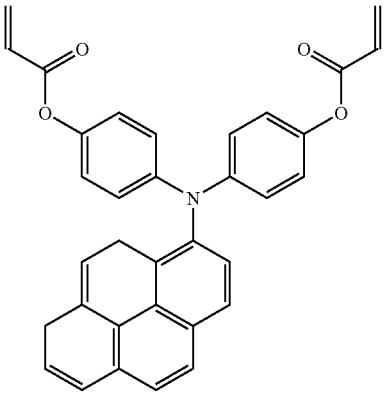
NO. 178
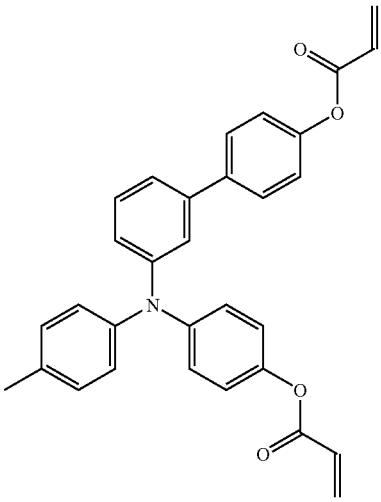
NO. 179
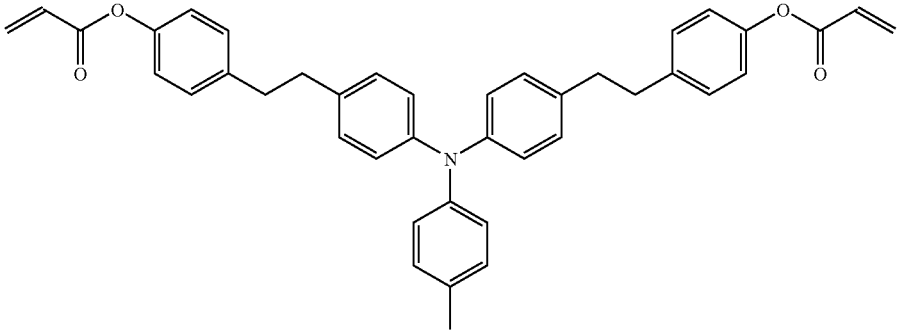
NO. 180
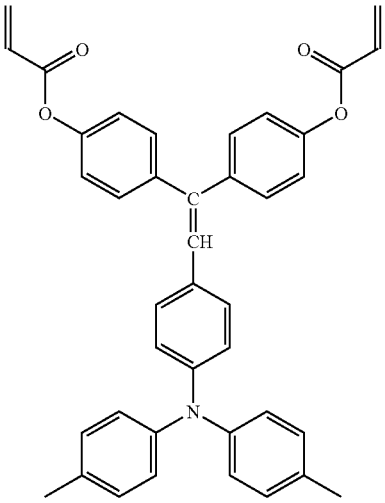
NO. 181
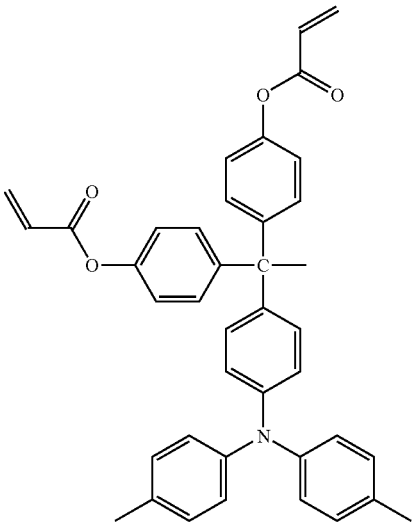

-continued
NO. 182
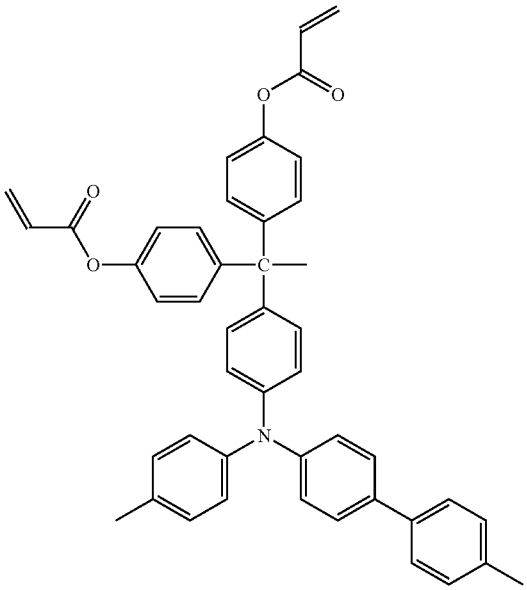
NO. 183
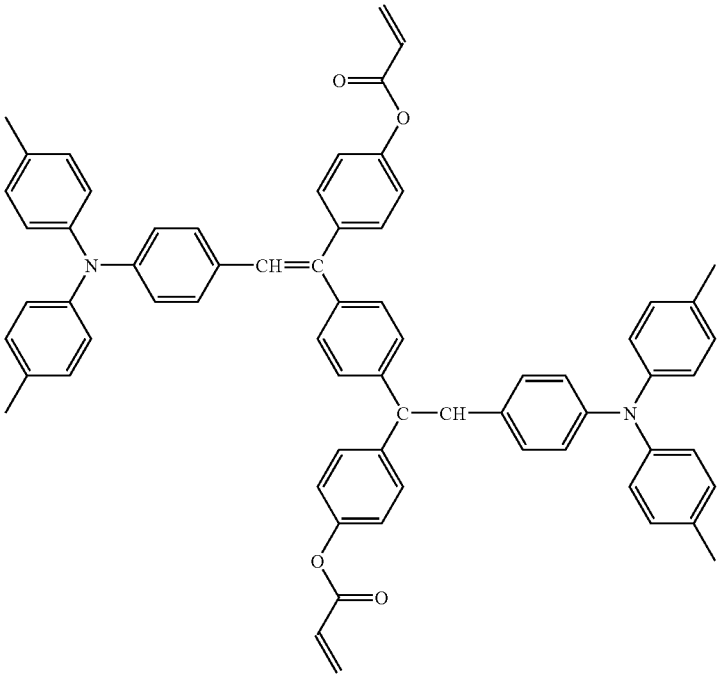
NO. 184
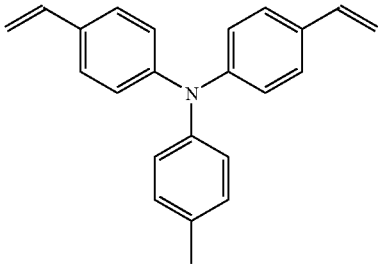
NO. 185
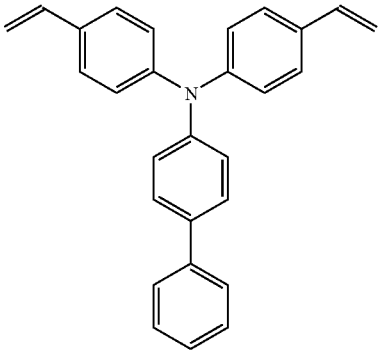

The radical polymerizable compound having a charge transporting structure for use in the present invention is essential for imparting a charge transportability to the crosslinked surface layer, and is preferably included therein is an mount of 20 to 80% by weight, and more preferably from 30 to 70% by weight based on total weight thereof. When less than 20% by weight, the crosslinked surface layer cannot maintain the charge transportability, a sensitivity of the resultant photoreceptor deteriorates and a residual potential thereof increases in repeated use. When greater than 80% by weight, a content of the tri- or more functional monomer having no charge transport structure decreases and the crosslinked density deteriorates, and therefore the resultant photoreceptor does not have a high abrasion resistance. Although it depends on a required abrasion resistance and electrical properties, in consideration of a balance therebetween, a content of the monofunctional radical polymerizable compound having a charge transport structure is most preferably from 30 to 70% by weight.

The crosslinked surface layer of the present invention is formed by preparing a solution (coating liquid) including at least a tri- or more functional radical polymerizable monomer having no charge transport structure and a radical polymerizable compound having a charge transport structure, coating and drying the solution, and hardening (crosslinking) the solution. Besides these, the coating liquid can include a monofunctional and bifunctional radical polymerizable monomer, a functional monomer and a radical polymerizable oligomer as well to control a viscosity of the surface layer when coated, reduce a stress of thereof, impart a low surface free energy thereto and reduce friction coefficient thereof. Known radical polymerizable monomers and oligomers can be used.

Specific examples of the monofunctional radical monomer include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, styrene monomer, etc.

Specific examples of the bifunctional radical monomer include 1,3-butanediolacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate, etc.

Specific examples of the functional monomer include octafluoropentylacrylate, 2-perfluorooctylethylacrylate, 2-perfluorooctylethylmethacrylate, 2-perfluoroisononylethylacrylate, etc., wherein a fluorine atom is substituted; vinyl monomers having a polysiloxane group having a siloxane repeat unit of from 20 to 70 disclosed in Japanese Published Examined Patent Application Nos. 5-60503 and 6-45770, such as acryloylpolydimethylsiloxaneethyl, methacryloylpolydimethylsiloxaneethyl, acryloylpolydimethylsiloxanepropyl, acryloylpolydimethylsiloxanebutyl and diacryloylpolydimethylsiloxanediethyl; acrylate; and methacrylate.

Specific examples of the radical polymerizable oligomer includes epoxyacrylate oligomers, urethaneacrylate oligomers and polyesteracrylate oligomers.

However, when the crosslinked surface layer includes a large amount of the radical polymerizable monomer and radical polymerizable oligomer having one or two functional groups, the three-dimensional crosslinked bonding density thereof substantially deteriorates, resulting in deterioration of the abrasion resistance thereof. Therefore, the surface layer of the present invention preferably includes the monomers and oligomers in an amount not greater than 50 parts by weight, and more preferably not greater than 30 parts by weight per 100 parts by weight of the radical polymerizable monomer having three or more functional groups.

The crosslinked surface layer of the present invention is formed by preparing a solution (coating liquid) including at least a tri- or more functional radical polymerizable monomer having no charge transport structure and a monofunctional radical polymerizable compound having a charge transport structure, coating and drying the solution, and hardening (crosslinking) the solution. The coating liquid may optionally a polymerization initiator such as a heat polymerization initiator and a photo polymerization initiator to effectively proceed the crosslinking reaction.

Specific examples of the heat polymerization initiator include peroxide initiators such as 2,5-dimethylhexane-2,5-dihydrooxide, dicumylperoxide, benzoylperoxide, t-butylcumylperoxide, 2,5-dimethyl-2,5-di(peroxybenzoyl)hexyne-3, di-t-butylbeloxide, t-butylhydrobeloxide, cumenehydobeloxide and lauroylperoxide; and azo initiators such as azobisisobutylnitrile, azobiscyclohexanecarbonitrile, azobisisomethylbutyrate, azobisisobutylamidinehydorchloride and 4,4'-azobis-4-cyanovaleric acid.

Specific examples of the photo polymerization initiator include acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-1-phenylpropane-1-one and 1-phenyl-1,2-propanedion-2-(o-ethoxycarbonyl)oxime; benzoinether photo polymerization initiators such as benzoin, benzoinmethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds and imidazole compounds. Further, a material having a photo polymerizing effect can be used alone or in combination with the above-mentioned photo polymerization initiators. Specific examples of the materials include triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone.

These polymerization initiators can be used alone or in combination. The crosslinked surface layer of the present invention preferably includes the polymerization initiators in an amount of 0.5 to 40 parts by weight, and more preferably from 1 to 20 parts by weight per 100 parts by weight of the radical polymerizable compounds.

Further, the coating liquid may optionally include various additives such as plasticizers (to soften a stress and improve adhesiveness thereof), leveling agents and low-molecular-weight charge transport materials without a radical reactivity. Known additives can be used, and specific examples of the plasticizers include plasticizers such as dibutylphthalate and dioctylphthalate used in typical resins. The content thereof is preferably not greater than 20% by weight, and more preferably not greater than 10% based on total weight of solid contents of the coating liquid. Specific examples of the leveling agents include silicone oil such as dimethylsilicone oil and methylphenylsilicone oil; and polymers and oligomers having a perfluoroalkyl group in the side chain. The content thereof is preferably not greater than 3% by weight.

The crosslinked surface layer of the present invention is formed by coating a coating liquid including the tri- or more functional radical polymerizable monomer having no charge transport structure and the radical polymerizable compound having a charge transport structure with a spray and hardening upon application of external energy. The coating liquid is diluted with a solvent, e.g., alcohols such as methanol, ethanol, propanol and butanol; ketones such as acetone, methyl ethyl ketone, methyl isobutyl ketone and cyclohexanone; esters such as ethylacetate and butylacetate; ethers such as tetrahydrofuran, dioxane and propylether; halogens such as dichloromethane, dichloroethane, trichloroethane and chlorobenzene; aromatics such as benzene, toluene and xylene; and cellosolves such as methylcellosolve, ethylcellosolve and cellosolve acetate. These solvents can be used alone or in combination. The dilution rate thereof depends on solubility of the constituents and thickness of the layer, but preferably from 5 to 40% by weight in terms of controlling the spray droplet diameter.

In the present invention, the crosslinked surface layer has a surface roughness (Ra) not greater than 0.2 μm and a peel strength not less than 0.2 N/mm or a surface roughness not greater than 0.15 μm and a peel strength not less than 0.3 N/mm when measured by the SAICAS method.

The surface roughness Ra of the crosslinked surface layer of the present invention is measured according to JIS B0601-1994, and SURFCOM 1400D from TOKYO SEIMITSU CO., LTD. is used in the present invention. However, any apparatus having a capability equivalent thereto can be used. When greater than 0.2 μm, the resultant photoreceptor tend to produce images having background fouling and stripes due to poor cleaning of thereof.

The peel strength is measure by cutting and peeling at an ultralow-velocity the surface with a single crystal diamond cutting blade having a knife angle of 60°, a rake angle of 20° and a grinding undercut angle of 10°. Specifically, a horizontal force, a perpendicular force and a perpendicular displacement applied to the cutting blade are measured, and the peel strength is determined as a horizontal force applied to the width of the cutting blade. The peel strength is measured at constant temperature and humidity. In the present invention, the peel strength is measured at 22° C. and 55% Rh.

In the present invention, SAICAS DN-20 from DAIPLA WINTES Co., Ltd., having a cutting blade 0.5 mm wide. Any apparatus having similar capability thereto can be used. In the present invention, a photoreceptor of the present invention is properly cut on an aluminum cylinder. The crosslinked surface layer having a peel strength not less than 0.2 N/mm has sufficient adhesiveness to the lower layer without peeling.

In the present invention, the crosslinked surface layer formed by 2 or more oscillation spray coatings, wherein the droplet diameter (D50) of the first spray coating is not less than 7 μm and that of the second or subsequent spray coating is less than 7 μm, has a surface roughness (Ra) not greater than 0.2 μm and a peel strength not less than 0.2 N/mm. In addition, the droplet diameter (D50) of the first spray coating is preferably from 10 to 15 μm and that of the second or subsequent spray coating is not greater than 5 μm in terms of preventing the constituents in the photosensitive layer from migrating into the surface layer and the adhesive strength thereof. The first spray coating slightly dissolves the photosensitive layer to improve adherence between the photosensitive layer and the crosslinked surface layer. When D50 is less than 7 μm, the peel strength is too small to prevent the surface layer from peeling. The second or subsequent spray coating improves the surfaceness thereof. When D50 is not less than 7 μm, the resultant surface layer is not expected to have smoothness.

In the present invention, any spray guns such as an air spray gun, an airless spray gun and an electrostatic spray gun can be used.

FIG. 1 is a schematic view for explaining a spray coating method of coating a crosslinked surface layer. In FIG. 1, the substrate is a cylindrical photoreceptor on which a photosensitive layer is coated. The substrate rotates in the direction of an arrow, and the spray gun moves in the direction of arrow atomizing the coating liquid to coat the substrate therewith. The first coating is a process of from starting coating with the spray gun to finishing coating until the substrate is wholly coated. The spray coating is performed twice or more in the present invention and an interval between the coatings is preferably not greater than 1 min. It is preferable that the spray gun has a traveling speed not faster than 10 mm/s and the he substrate has a rotation speed not faster than 80 rpm in terms of preventing irregular coatings.

Figure 2:
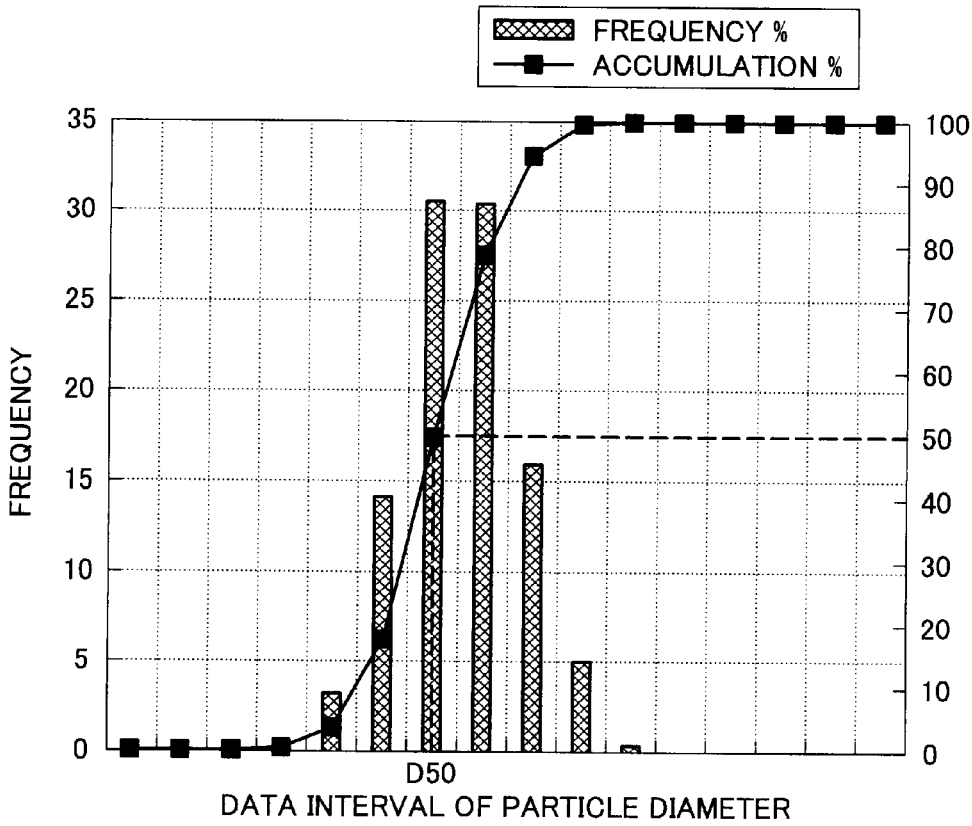
FIG. 2 is a diagram showing a particle diameter distribution of sprayed droplets, which is measured by a laser light scattering particle diameter distribution measurer.

In the present invention, the spray droplet diameter distribution is measured with a laser light scattering particle diameter distribution measurer LDSA-3500A from Tohnichi Computer Applications Co., Ltd., but any measurers having performances equivalent thereto can be used. When measuring the droplet diameter distribution, a distance between the spray gun and the laser is set to have the same distance between the nozzle and the substrate when coating the surface layer, and the droplet diameter when atomized with the spray gun is read by the laser to measure the droplet diameter distribution. The measurement is continuously performed 100 times at an interval of 0.1 sec. FIG. 2 is a droplet diameter distribution histogram. D50 is an average of half cumulative curve of 100 droplet diameter distributions.

The spray droplet diameter can be controlled with any of a solvent for the coating liquid, a viscosity thereof, a dilution rate thereof, a discharge amount of the spray gun, an atomizing pressure and a distance between the nozzle and the substrate. In the present invention, the spray conditions such as the discharge amount of the spray gun, atomizing pressure and distance between the nozzle and the substrate are preferably controlled because a single coating liquid can be used. Specifically, it is preferable that the discharge amount is not greater than 0.8 ml/s, the atomizing air pressure is not less than 1.5 kgf/cm$^2$ and the distance between the nozzle and the substrate is from 20 to 100 mm. The first spray coating preferably forms a layer having a thickness not greater than 5 μm. When greater than 5 μm, long-term good surfaceness cannot be expected. The crosslinked surface layer preferably has a thickness of from 5 to 20 μm. When less than 5 μm, the irregular thickness causes irregular durability of the resultant photoreceptor. When greater than 20 μm, the charge scatters, resulting in deterioration of image reproducibility. The thickness is preferably controlled with the distance between the nozzle and the substrate and traveling speed of the spray gun because of less influencing the droplet diameter although the coating liquid conditions or the spray conditions.

In the present invention, after the coating liquid is coated to form a layer, an external energy is applied thereto for hardening the layer to form the crosslinked surface layer. The external energy includes a heat, a light and a radiation. A heat energy is applied to the layer from the coated side or from the substrate using air, a gaseous body such as nitrogen, a steam, a variety of heating media, infrared or an electromagnetic wave. The heating temperature is preferably from 100 to 170° C. When less than 100° C., the reaction is slow in speed and is not completely finished. When greater than 170° C., the reaction nonuniformly proceeds and a large distortion appears in the crosslinked surface layer. To uniformly proceed the hardening reaction, after heated at comparatively a low temperature less than 100° C., the reaction is effectively completed at not less than 100° C. Specific examples of the light energy include UV irradiators such as high pressure mercury lamps and metal halide lamps having an emission wavelength of UV light; and a visible light source adaptable to absorption wavelength of the radical polymerizable compounds and photo polymerization initiators. An irradiation light quantity is preferably from 50 to 1,000 mW/cm$^2$. When less than 50 mW/cm$^2$, the hardening reaction takes time. When greater than 1,000 mW/cm$^2$, the reaction nonuniformly proceeds and the crosslinked surface layer has a large surface roughness. The radiation energy includes a radiation energy using an electron beam. Among these energies, the heat and light energies are effectively used because of their simple reaction speed controls and simple apparatuses.

The electrophotographic photoreceptor for use in the present invention will be explained, referring to the drawings.

Figure 3B:
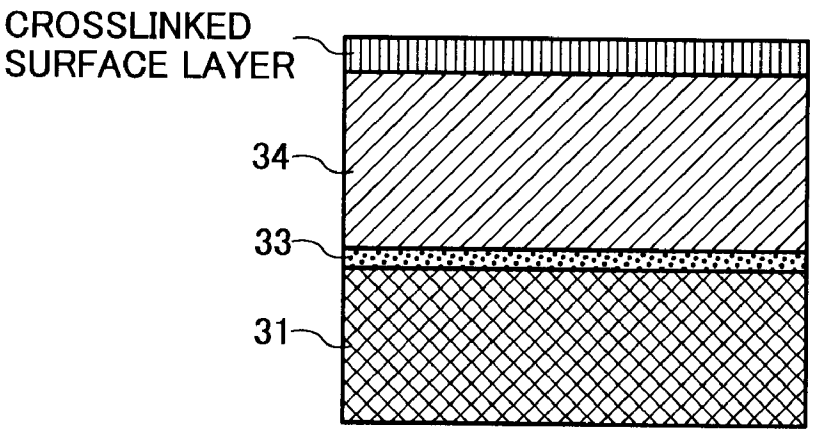
FIG. 3B is a cross-sectional view illustrating another embodiment of layer composition of the electrophotographic photoreceptor of the present invention.
Figure 3A:
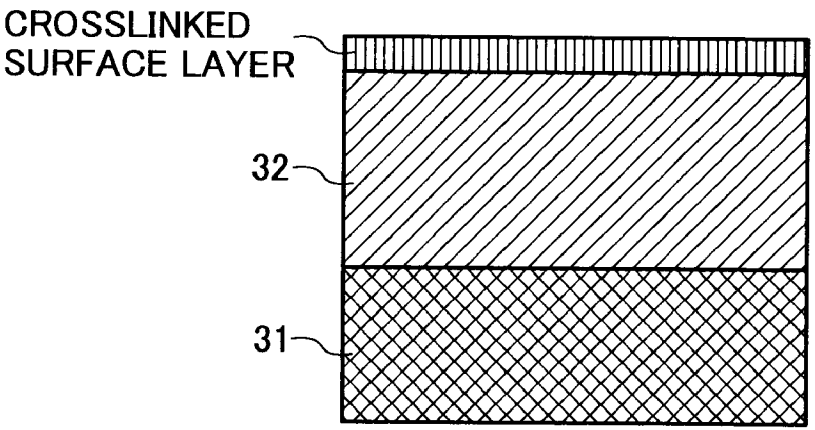
FIG. 3A is a cross-sectional view illustrating an embodiment of layer composition of the electrophotographic photoreceptor of the present invention.

FIG. 3A is a cross-sectional view illustrating an embodiment of layer composition of the electrophotographic photoreceptor of the present invention, wherein a crosslinked surface layer is overlaid on a single-layered photoreceptor formed of a photosensitive layer (32) having both a charge generation function and charge transport function and overlying an electroconductive substrate (31). FIG. 3B is a cross-sectional view illustrating another embodiment of layer composition of the electrophotographic photoreceptor of the present invention, wherein a crosslinked surface layer is overlaid on a multilayered photoreceptor formed of a charge generation layer (33) having a charge generation function and a charge transport layer (34) having a charge transport function, and which are overlying an electroconductive substrate (31).

Suitable materials for use as the electroconductive substrate (31) include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Published Unexamined Patent Application No. 52-36016, can also be used as the substrate (31).

Furthermore, substrates, in which a coating liquid including a binder resin and an electroconductive powder is coated on the substrates mentioned above, can be used as the substrate (31).

Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and TEFLON (registered trademark), with an electroconductive material, can also be preferably used as the substrate (31).

Next, the photosensitive layer will be explained. The photosensitive layer may be a single-layered or a multilayered. The multilayered photosensitive layer is formed of a charge generation layer having a charge generation function and a charge transport layer having a charge transport function. The single-layered photosensitive layer is a layer having both the charge generation function and charge transport function.

Hereinafter, the multilayered photosensitive layer and single-layered photosensitive layer will be explained respectively.

The charge generation layer (CGL) (33) is mainly formed of a charge generation material, and optionally includes a binder resin. Suitable charge generation materials include inorganic materials and organic materials.

Specific examples of the inorganic charge generation materials include crystalline selenium, amorphous selenium, selenium-tellurium alloys, selenium-tellurium-halogen alloys, selenium-arsenic alloys, amorphous silicon, etc. The amorphous silicon includes a dangling bond terminated with a hydrogen atom or a halogen atom, a doped boron atom, a doped phosphorus atom, etc.

Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments, etc. These charge generation materials can be used alone or in combination.

Specific examples of the binder resin optionally used in the CGL (33) include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination. In addition, a charge transport polymer material can also be used as the binder resin in the CGL besides the above-mentioned binder resins. Specific examples thereof include polymer materials such as polycarbonate resins, polyester resins, polyurethane resins, polyether resins, polysiloxane resins and acrylic resins having an arylamine skeleton, a benzidine skeleton, a hydrazone skeleton, a carbazole skeleton, a stilbene skeleton, a pyrazoline skeleton, etc.; and polymer materials having polysilane skeleton.

Specific examples of the former polymer materials include charge transport polymer materials disclosed in Japanese Published Unexamined Patent Applications Nos. 01-001728, 01-009964, 01-013061, 01-019049, 01-241559, 04-011627, 04-175337, 04-183719, 04-225014, 04-230767, 04-320420, 05-232727, 05-310904, 06-234838, 06-234839, 06-234840, 06-234839, 06-234840, 06-234841, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, 09-328539, etc.

Specific examples of the latter polymer materials include polysilylene polymers disclosed in Japanese Published Unexamined Patent Applications Nos. 63-285552, 05-19497, 05-70595, 10-73944, etc.

The CGL (33) can also include a low-molecular-weight charge transport material.

The low-molecular-weight charge transport materials include positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoquinone derivatives, etc. These electron transport materials can be used alone or in combination.

Specific examples of the positive hole transport materials include electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other known materials. These positive hole transport materials can be used alone or in combination.

Suitable methods for forming the charge generation layer (33) are broadly classified into a vacuum thin film forming method and a solvent dispersion casting method.

Specific examples of the former vacuum thin film forming method include a vacuum evaporation method, a glow discharge decomposition method, an ion plating method, a sputtering method, a reaction sputtering method, CVD (chemical vapor deposition) methods, etc. A layer of the above-mentioned inorganic and organic materials can be formed by these methods.

The casting method for forming the charge generation layer typically includes the following steps:

(1) preparing a coating liquid by mixing one or more inorganic or organic charge generation materials mentioned above with a solvent such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate, etc., optionally with a binder resin and a leveling agent such as a dimethylsilicone oil and methylphenyl silicone oil, and then dispersing the materials with a ball mill, an attritor, a sand mill, beads mill, etc. to prepare a CGL coating liquid;

(2) coating the CGL coating liquid, which is diluted if necessary, on a substrate by a method such as dip coating, spray coating, bead coating and ring coating; and (3) drying the coated liquid to form a CGL.

The thickness of the CGL is preferably from 0.01 to 5 μm, and more preferably from 0.05 to 2 μm.

The charge transport layer (CTL) (34) is a layer having a charge transportability, and is formed by coating the CGL (33) with a coating liquid wherein a charge transport material having a charge transportability and a binder resin are dispersed in a proper solvent to form a coated layer thereon, and drying the coated layer.

Specific examples of the charge transport materials include electron transport materials, positive hole transport materials and charge transport polymer materials used in the CGL (33). Particularly, the charge transport polymer materials are effectively used to reduce a solution of a lower layer when a surface layer is coated thereon.

Specific examples of the binder resins include thermoplastic or thermosetting resins such as a polystyrene resin, a styrene-acrylonitrile copolymer, a styrene-butadiene copolymer, a styrene-maleic anhydride copolymer, a polyester resin, a polyvinylchloride resin, a vinylchloride-vinylacetate copolymer, a polyvinylacetate resin, a polyvinylidenechloride resin, a polyarylate resin, a phenoxy resin, a polycarbonate resin, a cellulose acetate resin, an ethylcellulose resin, a polyvinylbutyral resin, a polyvinylformal resin, a polyvinyltoluene resin, a poly-N-vinylcarbazole resin, an acrylicresin, a silicone resin, an epoxy resin, a melamine resin, a urethane resin, a phenol resin and an alkyd resin.

The CTL preferably includes the charge transport material in an amount of from 20 to 300 parts by weight, and more preferably from 40 to 150 parts by weight per 100 parts by weight of the binder resin. However, the charge transport polymer material can be used alone or in combination with the binder resin.

Specific examples of a solvent used for coating the CTL include the solvents used for coating the CGL (33), and particularly the solvents solving the charge transport material and binder resin well are preferably used. These solvents can be used alone or in combination. The CTL can be formed by the same coating methods used for coating the CGL (33).

The CTL may optionally include a plasticizer and a leveling agent.

Specific examples of the plasticizer include plasticizers for typical resins, such as dibutylphthalate and dioctylphthalate, and the content thereof is preferably from 0 to 30 parts by weight per 100 parts by weight of the binder resin.

Specific examples of the leveling agents include silicone oil such as dimethyl silicone oil and methylphenyl silicone oil; and polymers or oligomers having a perfluoroalkyl group in the side chain, and the content thereof is preferably from 0 to 1 part by weight per 100 parts by weight of the binder resin.

The CTL preferably has a thickness of from 5 to 40 μm, and more preferably from 10 to 30 μm.

The crosslinked surface layer is formed by coating the CTL (34) with a coating liquid including the above-mentioned radical polymerizable compositions of the present invention to form a coated layer thereon, and crosslinking and hardening the coated layer with an external energy such as an irradiated UV light energy.

The single-layered photosensitive layer (32) has both a charge generation function and a charge transport function, and is formed by dissolving or dispersing a charge generation material having charge generatability, a charge transport material having charge transportability and a binder resin in a proper solvent, and coating and drying the resultant solution or dispersion. A plasticizer, a leveling agent, etc. can optionally be added thereto. The method of dispersing the charge generation material, the charge generation material, the charge transport material, the plasticizer and the leveling agent are mentioned above in the CGL (33) and the CTL (34). The binder resin used in the CTL (34) and the CGL (33) can be used. In addition, the charge transport polymer material can effectively be used in terms of decreasing incorporation of the constituents of the lower photosensitive layer in the crosslinked surface layer. The underlayer of the photosensitive layer preferably has a thickness of from 5 to 30 μm, and more preferably from 10 to 25 μm.

The crosslinked surface layer is formed by coating the single-layered photosensitive layer (32) with a coating liquid including the above-mentioned radical polymerizable compositions of the present invention to form a coated layer thereon, and crosslinking and hardening the coated layer with an external energy such as an irradiated UV light energy.

The single-layered photosensitive layer preferably includes a charge generation material in an amount of from 1 to 30% by weight, a binder resin of from 20 to 80% by weight and a charge transport material of from 10 to 70 parts by weight based on total weight thereof.

The photoreceptor of the present invention can have an intermediate layer between the crosslinked surface layer and the photosensitive layer when the crosslinked surface layer overlies the photosensitive layer. The intermediate layer prevents components of the lower photosensitive layer from mixing in the crosslinked surface layer to avoid a hardening reaction inhibition and concavities and convexities thereof. In addition, the intermediate layer can improve the adhesiveness between the crosslinked surface layer and photosensitive layer.

The intermediate layer includes a resin as a main component. Specific examples of the resin include polyamides, alcohol-soluble nylons, water-soluble polyvinyl butyral, polyvinyl butyral, polyvinyl alcohol, etc. The intermediate layer can be formed by one of the above-mentioned known coating methods. The intermediate layer preferably has a thickness of from 0.05 to 2 μm.

The photoreceptor of the present invention may have an undercoat layer between the substrate (31) and photosensitive layer. The undercoat layer includes a resin as a main component. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moire in the recorded images and to decrease residual potential of the photoreceptor.

The undercoat layer can also be formed by coating a coating liquid using a proper solvent and a proper coating method similarly to those for use in formation of the photosensitive layer mentioned above. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. Besides these materials, known materials can be used. The thickness of the undercoat layer is preferably from 0 to 5 μm.

In the present invention, an antioxidant can be included in each of the layers, i.e., the crosslinked surface layer, charge generation layer, charge transport layer, undercoat layer and intermediate layer to improve the stability to withstand environmental conditions, namely to avoid decrease of photosensitivity and increase of residual potential.

Specific examples of the antioxidant for use in the present invention include the following compound.

(Phenolic Compounds)

2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)b enzene, tetrakis-[methylene-3-(3',5'-di-t-butyl-4'-hydroxyphenyl)pr opionate]methane, bis[3,3'-bis(4'-hydroxy-3'-t-butylphenyl)butyric acidlglycol ester, tocophenol compounds, etc.

(Paraphenylenediamine Compounds)

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(Hydroquinone Compounds)

2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc..

(Organic Sulfur-Containing Compounds)

Dilauryl-3,3'-thiodipropionate, distearyl-3,3'-thiodipropionate, ditetradecyl-3,3'-thiodipropionate, etc.

(Organic Phosphorus-Containing Compounds)

Triphenylphosphine, tri(nonylphenyl)phosphine, tri(dinonylphenyl)phosphine, tricresylphosphine, tri(2,4-dibutylphenoxy)phosphine, etc.

These compounds are known as antioxidants for rubbers, plastics, fats, etc., and marketed products thereof can easily be obtained.

Each of the layers preferably includes the antioxidant in an amount of from 0.01 to 10% by weight based on total weight thereof.

Next, the image forming method and image forming apparatus of the present invention will be explained in detail, referring to the drawings.

The image forming method and image forming apparatus of the present invention include a photoreceptor having a smooth transporting crosslinked surface layer having a low surface energy, wherein the photoreceptor is charged and irradiated with an imagewise light to forman electrostatic latent image thereon; the electrostatic latent image is developed to form a toner image; the toner image is transferred onto an image bearer (transfer sheet) and fixed thereon; and a surface of the photoreceptor is cleaned.

The process is not limited thereto in such a method as to directly transfer an electrostatic latent image onto a transfer sheet and develop the electrostatic latent image thereon.

Figure 4:
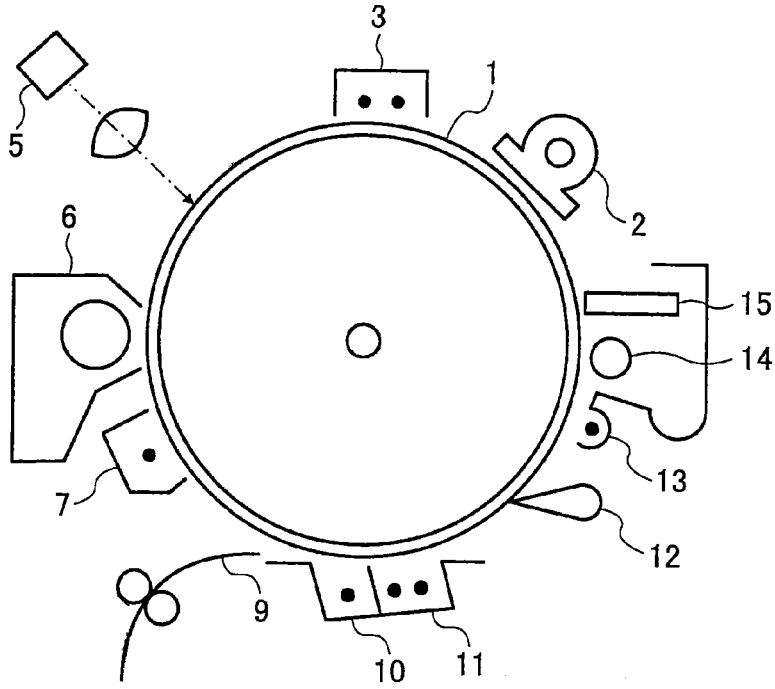
FIG. 4 is a schematic view illustrating a partial cross-section of an embodiment of the image forming apparatus of the present invention.

FIG. 4 is a schematic view illustrating a partial cross-section of an embodiment of the image forming apparatus of the present invention. A charger (3) is used to uniformly charge a photoreceptor (1). Specific examples of the charger include known chargers such as a corotron device, a scorotron device, a solid state charger, a needle electrode device, a roller charging device and an electroconductive brush device.

Contact chargers or non-contact chargers can be used in the present invention. The contact chargers include a charging roller, a charging brush, a charging blade, etc. directly contacting a photoreceptor. The non-contact chargers include, e.g., a charging roller located close to a photoreceptor with a gap not longer than 200 μm therebetween. When the gap is too long, the photoreceptor is not stably charged. When too short, the charging member, e.g., a charging roller is contaminated with a toner remaining on the photoreceptor. Therefore, the gap preferably has a length of from 10 to 200 μm, and more preferably from 10 to 100 μm.

Next, an imagewise light irradiator (5) is used to form an electrostatic latent image on the photoreceptor (1). Suitable light sources thereof include typical light emitters such as a fluorescent lamp, a tungsten lamp, a halogen lamp, a mercury lamp, a sodium lamp, a light emitting diode (LED), a laser diode (LD), a light source using electroluminescence (EL), etc. In addition, to obtain light having a desired wave length range, filters such as a sharp-cut filter, a band pass filter, a near-infrared cutting filter, a dichroic filter, an interference filter and a color temperature converting filter can be used.

Next, a developing unit (6) is used to visualize an electrostatic latent image formed on the photoreceptor (1). The developing methods include a one-component developing method and a two-component developing method using a dry toner; and a wet developing method using a wet toner. When the photoreceptor positively or negatively charged is exposed to imagewise light, an electrostatic latent image having a positive or negative charge is formed on the photoreceptor. When the latent image having a positive charge is developed with a toner having a negative charge, a positive image can be obtained. In contrast, when the latent image having a positive charge is developed with a toner having a positive charge, a negative image can be obtained.

Next, a transfer charger (10) is used to transfer a toner image visualized on the photoreceptor onto a transfer sheet (9). A pre-transfer charger (7) may be used to perform the transfer better. Suitable transferees include a transferer charger, an electrostatic transferer using a bias roller, an adhesion transferer, a mechanical transferer using a pressure and a magnetic transferee. The above-mentioned chargers can be used for the electrostatic transferer.

Next, a separation charger (11) and a separation pick (12) are used to separate the transfer sheet (9) from the photoreceptor (1). Other separation means include an electrostatic absorption induction separator, a side-edge belt separator, a tip grip conveyor, a curvature separator, etc. The above-mentioned chargers can be used for the separation charger (11).

Next, a fur brush (14) and a cleaning blade (15) are used to remove a toner left on the photoreceptor after transferred therefrom. A pre-cleaning charger (13) may be used to perform the cleaning more effectively. Other cleaners include a web cleaner, a magnet brush cleaner, etc., and these cleaners can be used alone or in combination.

Next, a discharger is optionally used to remove a latent image in the photoreceptor. The discharger includes a discharge lamp (2) and a discharger, and the above-mentioned light sources and chargers can be used respectively.

Known means can be used for other an original reading process, a paper feeding process, a fixing process, a paper delivering process, etc.

Figure 5:
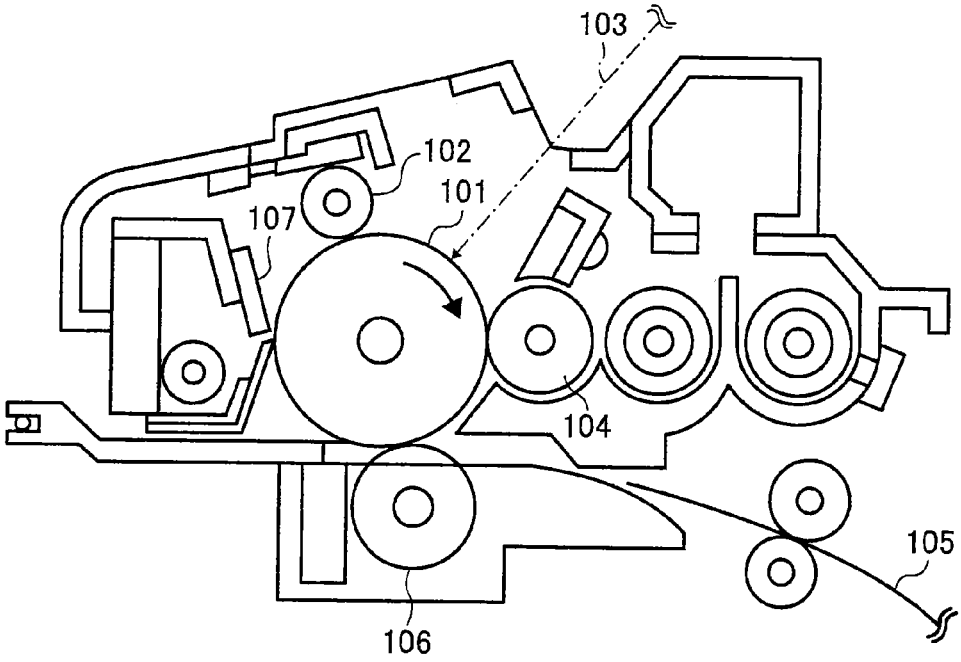
FIG. 5 is a schematic view illustrating an embodiment of the process cartridge of the present invention.

The above-mentioned image forming unit may be fixedly set in a copier, a facsimile or a printer. However, the image forming unit maybe detachably set therein as a process cartridge. FIG. 5 is a schematic view illustrating an embodiment of the process cartridge of the present invention.

The process cartridge means an image forming unit (or device) which includes a photoreceptor (101) and at least one of a charger (102), an image developer (104), a transferer (106), a cleaner (107) and a discharger (not shown).

While the photoreceptor (101) rotates in a direction indicated by an arrow, the photoreceptor (101) is charged by the charger (102) and irradiated by an irradiator (103) to form an electrostatic latent image relevant to imagewise light thereon. The electrostatic latent image is developed by the image developer (104) with a toner to form a form a toner image, and the toner image is transferred by the transferer (106) onto a transfer sheet (105) to be printed out. Next, a surface of the photoreceptor after the toner image is transferred is cleaned by the cleaner (107), discharged by a discharger (not shown) and these processes are repeated again.

The present invention provides a process cartridge for image forming apparatus, including a photoreceptor having a smooth charge transportable crosslinked surface layer, and at least one of s charger, an image developer, a transferer, a cleaner and a discharger.

As is apparent from the explanations mentioned above, the electrophotographic photoreceptor of the present invention can widely be used in electrophotography applied fields such as a laser beam printer, a CRT printer, a LED printer, a liquid crystal printer and a laser engraving.

<Synthesis Example of a Radical Polymerizable Compound Having a Charge Transport Structure>

The compound having a charge transporting structure of the present invention is synthesized by, e.g., a method disclosed in Japanese Patent No. 3164426. The following method is one of the examples thereof.

(1) Synthesis of a Hydroxy Group Substituted Triarylamine Compound Having the Following Formula B 113.85 g (0.3 mol) of a methoxy group substituted triarylamine compound having the formula A, 138 g (0.92 mol) of sodium iodide and 240 ml of sulfolane were mixed to prepare a mixture. The mixture was heated to have a temperature of 60° C. in a nitrogen stream.

A

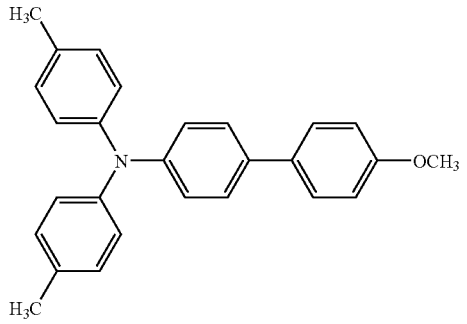

99 g (0.91 mol) of trimethylchlorosilane were dropped therein for 1 hr and the mixture was stirred for 4 hrs at about 60° C. About 1.5 L of toluene were added thereto and the mixture was cooled to have a room temperature, and repeatedly washed with water and an aqueous solution of sodium carbonate. Then, a solvent removed therefrom and refined by a column chromatographic process using silica gel as an absorption medium, and toluene and ethyl acetate (20-to-1) as a developing solvent. Cyclohexane was added to the thus prepared buff yellow oil to separate a crystal out. Thus, 88.1 g (yield of 80.4%) of a white crystal having the following formula B and a melting point of from 64.0 to 66.0° C. was prepared.

B

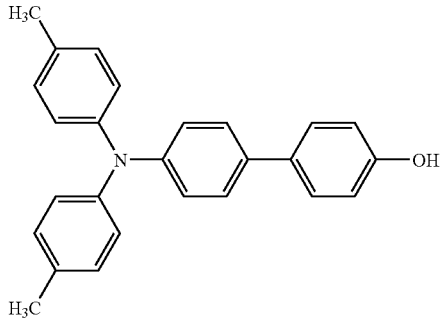

| Elemental Analysis Value (%) | | | |
|---|---|---|---|
| | C | H | N |
| Found value | 85.06 | 6.41 | 3.73 |
| Calculated value | 85.44 | 6.34 | 3.83 |

(2) A Triarylamino Group Substituted Acrylate Compound (Compound No. 54)

82.9 g (0.227 mol) of the hydroxy group substituted triarylamine compound having the formula B prepared in (1) were dissolved in 400 ml of tetrahydrofuran to prepare a mixture, and an aqueous solution of sodium hydrate formed of 12.4 g of NaOH and 100 mil of water was dropped therein in a nitrogen stream. The mixture was cooled to have a temperature of 5° C., and 25.2 g (0.272 mol) of chloride acrylate was dropped therein for 40 min. Then, the mixture was stirred at 5° C. for 3 hrs. The mixture was put in water and extracted with toluene. The extracted liquid was repeatedly washed with water and an aqueous solution of sodium carbonate. Then, a solvent removed therefrom and refined by a column chromatographic process using silica gel as an absorption medium and toluene as a developing solvent. N-hexane was added to the thus prepared colorless oil to separate a crystal out. Thus, 80.73 g (yield of 84.8%) of a white crystal of the compound No. 54 having a melting point of from 117.5 to 119.0° C. was prepared.

| Elemental Analysis Value (%) | | | |
|---|---|---|---|
| | C | H | N |
| Found value | 83.13 | 6.01 | 3.16 |
| Calculated value | 83.02 | 6.00 | 3.33 |

(3) Synthesis Example of an Acrylic Acid Ester Compound (i) Preparation of Diethyl 2-hydroxybenzylphosphonate 38.4 g of 2-hydroxybenzylalcohol from TOKYO KASEI KOGYO Co., Ltd. and 80 ml of o-xylene were put in a reaction reservoir having a mixer, a thermometer and a dropping funnel. Under a nitrogen stream, 62.8 g of triethyl phosphite were slowly dropped therein at 80° C., and the reaction therein is further performed for 1 hr at the same temperature. Then, the produced ethanol, o-xylene and unreacted triethyl phosphite were removed from the reaction by reduced-pressure distillation to prepare 66 g of 2-diethylhydroxybenzylphosphonate at a yield of 90%, having a boiling point of 120.0° C./1.5 mm Hg.

(ii) Preparation of 2-hydroxy-4'-(di-para-tolylamino)stilbene 14.8 g of kalium-tert-butoxide and 50 ml of tetrahydrofuran were put in a reaction reservoir having a mixer, a thermometer and a dropping funnel. Under a nitrogen stream, a solution wherein 9.90 g of the diethyl 2-hydroxybenzylphosphonate and 5.44 g of 4-(di-para-tolylamino)benzaldehyde were dissolved in tetrahydrofuran was slowly dropped therein at a room temperature, and the reaction therein is further performed for 2 hrs at the same temperature. Then, water was added therein while cooling the reaction product with water, a hydrochloric acid solution having a normal concentration of 2 was added therein to acidize the reaction product, and the tetrahydrofuran was removed by an evaporator to extract a crude product with toluene. The toluene phase was washed with water, a sodium hydrogen carbonate solution and a saturated saline in this order, and magnesium sulfate was further added thereto to dehydrate the toluene phase. After filtered, the toluene was removed therefrom to prepare an oily crude product, and the oily crude product was further column-refined with silica gel to crystallize 5.09 g of 2-hydroxy-4'-(di-para-tolylamino)stilbene in hexane at a yield of 72%, having a boiling point of 136.0 to 138.0° C.

(iii) Preparation of 4'-(di-para-tolylamino)stilbene-2-ylacrylate 14.9 g of the 2-hydroxy-4'-(di-para-tolylamino)stilbene. 100 ml of tetrahydrofuran and 21.5 g of sodium hydrogen carbonate solution having a concentration of 12% were put in a reaction reservoir having a mixer, a thermometer and a dropping funnel. Under a nitrogen stream, 5.17 g of chloride acrylate was dropped therein for 30 min at 5° C., and the reaction therein is further performed for 3 hrs at the same temperature. The reaction liquid was put in water, extracted with toluene, condensed and column-refined with silica gel to prepare a crude product. The crude product was recrystallized with ethanol to prepare 13.5 q of a yellow needle crystal 4'-(di-para-tolylamino)stilbene-2-ylacrylate (Exemplified Compound No. 2) at a yield of 79.8%, having a boiling point of 104.1 to 105.2° C. The elemental analysis thereof is as follows.

| Elemental Analysis Value (%) | | | |
|---|---|---|---|
| | C | H | N |
| Found value | 83.46 | 6.06 | 3.18 |
| Calculated value | 83.57 | 6.11 | 3.14 |

2-hydroxybenzylesterphosphonate derivatives and various amino-substituted benzaldehyde derivatives are reacted with each other to synthesize many 2-hydroxystilbene derivatives, and various esteracrylate compounds can be synthesized when the 2-hydroxystilbene derivatives are acrylated or methacrylated.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

An undercoat coating liquid, a charge generation coating liquid and charge transport coating liquid, which have the following formulations, were coated and dried in this order on an aluminum cylinder having a diameter of 30 mm to form an undercoat layer 3.0 μm thick, a charge generation layer 0.2 μm thick, a charge transport layer 20 μm thick thereon.

Undercoat Layer Coating Liquid

| | |
|---|---|
| Alkyd resin (BEKKOZOL 1307-60-EL from Dainippon Ink & Chemicals, Inc.) | 6 |
| Melamine resin (SUPER BEKKAMIN G-821-60 from Dainippon Ink & Chemicals, Inc.) | 4 |
| Titanium dioxide powder | 40 |
| Methyl ethyl ketone | 50 |

CGL Coating Liquid

| | |
|---|---|
| Polyvinyl butyral (XYHL from Union Carbide Corp.) | 0.5 |
| Cyclohexanone | 200 |
| Methyl ethyl ketone | 80 |
| Bisazo pigment having the following formula (I): | 2.5 |

(I)

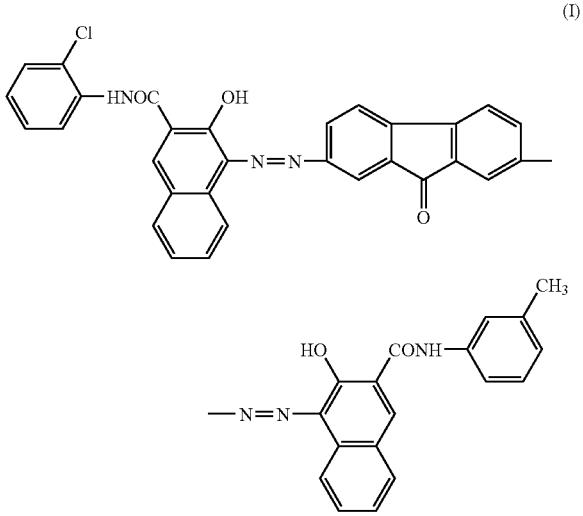

CTL Coating Liquid

| | |
|---|---|
| Bisphenol Z Polycarbonate (Panlite TS-2050 from TEIJIN CHEMICALS LTD.) | 10 |
| Tetrahydrofuran | 100 |
| 1% tetrahydrofuran solution of silicone oil (KF50-100CS from Shin-Etsu Chemical Industry Co., Ltd.) | 0.2 |
| Charge transport material having the following formula (II): | 7 |

(II)

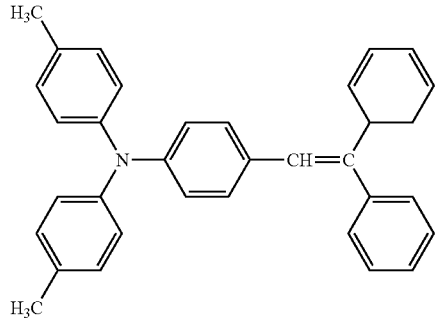

The charge transport layer was further coated with a crosslinked surface layer coating liquid having the following formulation by a spray coating method using a spray gun.

Crosslinked Surface Layer Coating Liquid

| | |
|---|---|
| Monofunctional radical polymerizable compound having a charge transport structure (Above-exemplified compound No. 54 having a molecular weight of 419) | 10 |
| Trifunctional radical polymerizable monomer having no charge transport structure (Trimethylolpropanetriacrylate KAYARAD TMPTA having a molecular weight of 296 from NIPPON KAYAKU CO., LTD.) | 10 |
| Photo polymerization initiator (IRGACURE 184 having a molecular weight of 204 from Nippon Kayaku Co., Ltd.) | 1 |
| Tetrahydrofuran having a boiling point of 66° C. and a saturated vapor pressure of 181.7 mm Hg/20° C. | 120 |

The spray gun was PC308 from OLYMPOS, and which sprayed twice at 20° C. and 50% RH under the following conditions.

The First Spray Coating Conditions

Discharge amount: 0.43 ml/s
Atomization pressure: 1.5 kgf/cm$^2$
Distance between nozzle and substrate: 70 mm
Spray gun traveling speed: 8.0 mm/s
Rotation number of substrate: 160 rpm
D50: 13.4 μm
Aimed thickness: 3 μm The Second Spray Coating Conditions Discharge amount: 0.12 ml/s
Atomization pressure: 4.0 kgf/cm$^2$
Distance between nozzle and substrate: 70 mm
Spray gun traveling speed: 0.8 mm/s
Rotation number of substrate: 160 rpm
D50: 1.5 μm
Aimed thickness: 7 μm The substrate was irradiated with UV light after coated while rotated at 30 rpm with a UV lamp system from FUSION, using a metal halide lamp under the following conditions to harden the surface layer.

Distance between lamp and substrate: 50 mm
Irradiation intensity: 1,000 mW/cm$^2$
Irradiation time: 30 sec After irradiated, the substrate was dried at 90° C. for 10 min to form the crosslinked surface layer having a thickness of 10 μm thereon. Thus, an electrophotographic photoreceptor of the present invention was prepared.

Example 2

The procedure for preparation of the electrophotographic photoreceptor in Example 1 was repeated to prepare an electrophotographic photoreceptor except for changing the spray coating conditions as follows.

The First Spray Coating Conditions
Atomization pressure: 2 kgf/cm$^2$
D50: 7.5 μm The Second Spray Coating Conditions
Atomization pressure: 3.0 kgf/cm$^2$
D50: 4.6 μm Example 3

The procedure for preparation of the electrophotographic photoreceptor in Example 1 was repeated to prepare an electrophotographic photoreceptor including a crosslinked surface layer having a thickness of 14 μm except for spraying three times with the spray gun and changing the spray coating conditions as follows.

The First Spray Coating Conditions
Discharge amount: 0.74 ml/s
Atomization pressure: 1.5 kgf/cm$^2$
Distance between nozzle and substrate: 70 mm
Spray gun traveling speed: 9.3 mm/s
Rotation number of substrate: 160 rpm
D50: 17.3 μm
Aimed thickness: 2 μm The Second and Third Spray Coating Conditions
Discharge amount: 0.10 ml/s
Atomization pressure: 4.0 kgf/cm$^2$
Distance between nozzle and substrate: 70 mm
Spray gun traveling speed: 2.0 mm/s
Rotation number of substrate: 160 rpm
D50: 1.5 μm
Aimed thickness: 6 μm Example 4

The procedure for preparation of the electrophotographic photoreceptor in Example 1 was repeated to prepare an electrophotographic photoreceptor including a crosslinked surface layer having a thickness of 10 μm except for changing the photo polymerization initiator in the crosslinked surface layer coating liquid to a heat polymerization initiator (2,2-bis(4,4-di-t-butylperoxycyclohexy)propane Perkadox 12-EB20 from Kayaku Akzo Corp.); changing the spray coating conditions as follows; and heating the substrate after coated at 150° C. for 30 min.

The First Spray Coating Conditions
Discharge amount: 0.51 ml/s
Atomization pressure: 2.0 kgf/cm$^2$
Distance between nozzle and substrate: 70 mm
Spray gun traveling speed: 7.0 mm/s
Rotation number of substrate: 200 rpm
D50: 15.3 μm
Aimed thickness: 3 μm The Second Spray Coating Conditions
Discharge amount: 0.12 ml/s
Atomization pressure: 4.0 kgf/cm$^2$
Distance between nozzle and substrate: 70 mm
Spray gun traveling speed: 0.8 mm/s
Rotation number of substrate: 160 rpm
D50: 1.5 μm
Aimed thickness: 7 μm Example 5

The procedure for preparation of the electrophotographic photoreceptor in Example 1 was repeated to prepare an electrophotographic photoreceptor except for changing the solvent in the in the crosslinked surface layer coating liquid to acetone having a boiling point of 56° C. and a saturated vapor pressure of 181.7 mm Hg/20° C.

Example 6

The procedure for preparation of the electrophotographic photoreceptor in Example 1 was repeated to prepare an electrophotographic photoreceptor including a crosslinked surface layer having a thickness of 10 μm except for changing the solvent in the in the crosslinked surface layer coating liquid to methanol having a boiling point of 56° C. and a saturated vapor pressure of 181.7 mm Hg/20° C., and changing the spray coating conditions as follows.

The First Spray Coating Conditions
Discharge amount: 0.28 ml/s
Atomization pressure: 2.0 kgf/cm$^2$
Distance between nozzle and substrate: 50 mm
Spray gun traveling speed: 3.0 mm/s
Rotation number of substrate: 160 rpm
D50: 8.8 μm
Aimed thickness: 5 μm The Second Spray Coating Conditions
Discharge amount: 0.21 ml/s
Atomization pressure: 3.0 kgf/cm$^2$
Distance between nozzle and substrate: 50 mm
Spray gun traveling speed: 1.8 mm/s
Rotation number of substrate: 160 rpm
D50: 6.4 μm
Aimed thickness: 7 μm Example 7

The procedure for preparation of the electrophotographic photoreceptor in Example 1 was repeated to prepare an electrophotographic photoreceptor except for changing the monofunctional radical polymerizable compound having a charge transport structure in the crosslinked surface layer coating liquid to above-exemplified compound No. 109 having a molecular weight of 445.

Example 8

The procedure for preparation of the electrophotographic photoreceptor in Example 1 was repeated to prepare an electrophotographic photoreceptor except for changing the trifunctional radical polymerizable monomer having no charge transport structure to a material having the following formula:

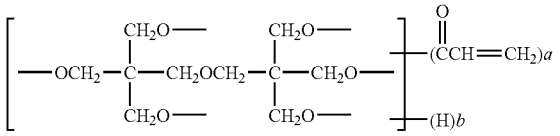

Dipentaerythritolhexaacrylate
(mixture of hexaacrylate a=5 and b=1, and pentaacrylate a=6 and b=0)
KAYARAD DPHA from Nippon Kayaku Co., Ltd. having 5 functional groups and 6 functional groups (1:1)

Example 9

The procedure for preparation of the electrophotographic photoreceptor in Example 1 was repeated to prepare an electrophotographic photoreceptor except for changing the trifunctional radical polymerizable monomer having no charge transport structure to a material having the following formula:

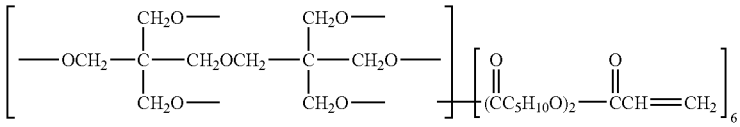

Caprolactone-modified dipentaerythritolhexaacrylate KAYARAD DPCA-120 from Nippon Kayaku Co., Ltd. having 6 function groups;
and spraying three times with the spray gun and changing the spray coating conditions as follows.

The First Spray Coating Conditions
- Discharge amount: 0.51 ml/s
- Atomization pressure: 1.5 kgf/cm$^2$
- Distance between nozzle and substrate: 70 mm
- Spray gun traveling speed: 8.0 mm/s
- Rotation number of substrate: 160 rpm
- D50: 14.2 μm
- Aimed thickness: 3 μm The Second Spray Coating Conditions
- Discharge amount: 0.10 ml/s
- Atomization pressure: 4.0 kgf/cm$^2$
- Distance between nozzle and substrate: 70 mm
- Spray gun traveling speed: 2.0 mm/s
- Rotation number of substrate: 160 rpm
- D50: 4.6 μm
- Aimed thickness: 7 μm The Third Spray Coating Conditions
- Discharge amount: 0.08 ml/s
- Atomization pressure: 4.0 kgf/cm$^2$
- Distance between nozzle and substrate: 70 mm
- Spray gun traveling speed: 2.5 mm/s
- D50: 3.2 μm Example 10

The procedure for preparation of the electrophotographic photoreceptor in Example 1 was repeated to prepare an electrophotographic photoreceptor except for changing the monofunctional radical polymerizable compound having a charge transport structure in the crosslinked surface layer coating liquid to above-exemplified compound No. 109 having a molecular weight of 445, the trifunctional radical polymerizable monomer having no charge transport structure to a material having the following formula:

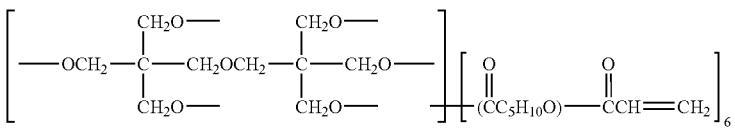

Dipentaerythritolhexaacrylate caprolactone-modified KAYARAD DPCA-60 from Nippon Kayaku Co., Ltd. having 6 function groups;
and changing the spray coating conditions as follows.

The Second Spray Coating Conditions
- Discharge amount: 0.18 ml/s
- Atomization pressure: 4.0 kgf/cm$^2$
- Distance between nozzle and substrate: 70 mm
- Spray gun traveling speed: 1.0 mm/s
- Rotation number of substrate: 160 rpm
- D50: 3.1 μm
- Aimed thickness: 7 μm Example 11

The procedure for preparation of the electrophotographic photoreceptor in Example 1 was repeated to prepare an electrophotographic photoreceptor except for using 50 parts of tetrahydrofuran in the crosslinked surface layer coating liquid, and changing the spray coating conditions as follows.

The First Spray Coating Conditions
- Discharge amount: 0.35 ml/s
- Atomization pressure: 1.2 kgf/cm$^2$
- Distance between nozzle and substrate: 70 mm
- Spray gun traveling speed: 7.0 mm/s
- Rotation number of substrate: 160 rpm
- D50: 10.3 μm
- Aimed thickness: 3 μm The Second Spray Coating Conditions
- Discharge amount: 0.1 ml/s
- Atomization pressure: 3.0 kgf/cm$^2$
- Distance between nozzle and substrate: 70 mm
- Spray gun traveling speed: 4.0 mm/s
- Rotation number of substrate: 160 rpm
- D50: 0.7 μm
- Aimed thickness: 7 μm Comparative Example 1

The procedure for preparation of the electrophotographic photoreceptor in Example 1 was repeated to prepare an electrophotographic photoreceptor including a crosslinked surface layer having a thickness of 10 μm except for spraying once with the spray gun, and changing the spray coating conditions as follows.

Spray Coating Conditions
Discharge amount: 0.43 ml/s
Atomization pressure: 3.0 kgf/cm$^2$
Distance between nozzle and substrate: 70 mm
Spray gun traveling speed: 1.7 mm/s
Rotation number of substrate: 160 rpm
D50: 5.6 μm Comparative Example 2

The procedure for preparation of the electrophotographic photoreceptor in Example 1 was repeated to prepare an electrophotographic photoreceptor including a crosslinked surface layer having a thickness of 10 μm except for spraying once with the spray gun, and changing the spray coating conditions as follows.

Spray Coating Conditions
Discharge amount: 0.84 ml/s
Atomization pressure: 1.5 kgf/cm$^2$
Distance between nozzle and substrate: 70 mm
Spray gun traveling speed: 3.0 mm/s
Rotation number of substrate: 160 rpm
D50: 20.5 μm Comparative Example 3

The procedure for preparation of the electrophotographic photoreceptor in Example 1 was repeated to prepare an electrophotographic photoreceptor including a crosslinked surface layer having a thickness of 10 μm except for making the first and second spray conditions same as follows.

The First and Second Spray Conditions
Discharge amount: 0.51 ml/s
Atomization pressure: 2.0 kgf/cm$^2$
Distance between nozzle and substrate: 70 mm
Spray gun traveling speed: 3.0 mm/s
Rotation number of substrate: 160 rpm
D50: 15.2 μm
Aimed thickness: 4 μm Comparative Example 4

The procedure for preparation of the electrophotographic photoreceptor in Example 1 was repeated to prepare an electrophotographic photoreceptor including a crosslinked surface layer having a thickness of 10 μm except for changing the spray coating conditions as follows.

The First Spray Coating Conditions
Discharge amount: 0.16 ml/s
Atomization pressure: 3.0 kgf/cm$^2$
Distance between nozzle and substrate: 50 mm
Spray gun traveling speed: 4.0 mm/s
Rotation number of substrate: 160 rpm
D50: 3.4 μm
Aimed thickness: 3 μm The Second Spray Coating Conditions
Discharge amount: 0.16 ml/s
Atomization pressure: 3.0 kgf/cm$^2$
Distance between nozzle and substrate: 50 mm
Spray gun traveling speed: 2.2 mm/s
Rotation number of substrate: 160 rpm
D50: 3.4 μm
Aimed thickness: 7 μm Comparative Example 5

The procedure for preparation of the electrophotographic photoreceptor in Example 1 was repeated to prepare an electrophotographic photoreceptor except for making the first and second spray conditions same as follows.

The First and Second Spray Conditions
Discharge amount: 0.28 ml/s
Atomization pressure: 2.0 kgf/cm$^2$
Distance between nozzle and substrate: 50 mm
Spray gun traveling speed: 2.2 mm/s
Rotation number of substrate: 160 rpm
D50: 8.1 μm
Aimed thickness: 6 μm Comparative Example 6

The procedure for preparation of the electrophotographic photoreceptor in Example 1 was repeated to prepare an electrophotographic photoreceptor except for changing the spray coating conditions as follows.

The First Spray Coating Conditions
Discharge amount: 0.10 ml/s
Atomization pressure: 4.0 kgf/cm$^2$
Distance between nozzle and substrate: 70 mm
Spray gun traveling speed: 2.5 mm/s
Rotation number of substrate: 160 rpm
D50: 1.2 μm
Aimed thickness: 3 μm The Second Spray Coating Conditions
Discharge amount: 0.43 ml/s
Atomization pressure: 1.5 kgf/cm$^2$
Distance between nozzle and substrate: 70 mm
Spray gun traveling speed: 3.5 mm/s
Rotation number of substrate: 160 rpm
D50: 10.2 μm
Aimed thickness: 7 μm Comparative Example 7

The procedure for preparation of the electrophotographic photoreceptor in Example 1 was repeated to prepare an electrophotographic photoreceptor except for not forming the crosslinked surface layer and making the CTL 25 μm thick.

Comparative Example 8

The procedure for preparation of the electrophotographic photoreceptor in Example 1 was repeated to prepare an electrophotographic photoreceptor except for changing the trifunctional radical polymerizable monomer having no charge transport structure to a bifunctional acrylate having the following formula:

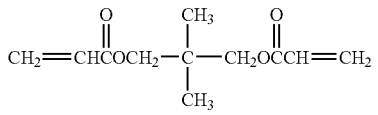

KAYARAD NPGDA from Nippon Kayaku Co., Ltd.

Comparative Example 9

The procedure for preparation of the electrophotographic photoreceptor in Example 1 was repeated to prepare an electrophotographic photoreceptor except for excluding the radical polymerizable compound having a charge transport structure from the crosslinked surface layer coating liquid and changing the parts by weight of the trifunctional radical polymerizable monomer having no charge transport structure to 20 parts therein.

Comparative Example 10

The procedure for preparation of the electrophotographic photoreceptor in Example 1 was repeated to prepare an electrophotographic photoreceptor except for excluding the trifunctional radical polymerizable monomer having no charge transport structure from the crosslinked surface layer coating liquid and changing the parts by weight of the radical polymerizable compound having a charge transport structure to 20 parts therein.

Comparative Example 11

The procedure for preparation of the electrophotographic photoreceptor in Example 1 was repeated to prepare an electrophotographic photoreceptor including a crosslinked surface layer having a thickness of 10 μm except for changing the parts by weight of tetrahydrofuran in the crosslinked surface layer coating liquid to 30 parts and coating the crosslinked surface layer by a ring coat method.

The evaluation test methods for the photoreceptors prepared in Examples and Comparative Examples are as follows.

<Hardenability Test>

The hardenability of the crosslinked surface layer was evaluated by the solubility thereof in an organic solvent. A drop of tetrahydrofuran was put on the photoreceptor, and the change of the surface profile after naturally dried was visually observed. The surface was partially dissolved and had ring-shaped concavities and convexities or clouds when insufficiently hardened.

<Surface Roughness>

The surface roughness Ra of the crosslinked surface layer of the present invention is measured according to JIS B0601-1994, and SURFCOM 1400D from TOKYO SEIMITSU CO., LTD. Two points from both ends and a center of the photoreceptor in the longitudinal direction and 4 points of each thereof in the circumferential direction, totally 12 points were measured. The average of the 12 points was defined as the surface roughness.

<Peel Strength Test>

SAICAS DN-20 from DAIPLAWINTES Co., Ltd., having a cutting blade 0.5 mm wide was used at a horizontal cutting speed of 0.1 μm/sec and a vertical cutting speed of 0.01 μm/sec. The cutting depth was larger than the thickness of the crosslinked surface layer. The peel strength was determined by dividing the horizontal load of the cutting depth with the width of the cutting blade.

<Durability Test>

The crosslinked surface layer of the photoreceptor was abraded by 2.5 μm deep and 10 cm axially wide at a random position thereof with a wrapping film having a surface roughness of 3.0 μm from Sumitomo 3M Ltd. Comparative Example 8 as abraded to have an abraded thickness of 10 μm. The abraded part was observed with an ultradeep shape measurement microscope VK-8500 from KEYENCE to see whether there was a peeling. The photoreceptor was installed in a process cartridge, and the process cartridge was installed in a modified imagio MF2200 using a LD having a wavelength of 655 nm as a imagewise light source and a cleaning blade having 1.5 times contact pressure from Ricoh Company, Ltd.

The dark space (not abraded) potential thereof was set at 700 (−V), 25,000, and further 50,000 A4 images were produced thereby to measure the thickness of the abraded part and evaluate image quality thereof. The initial dark space potential and irradiated part potential after 50,000 images were produced were measured. The thickness of the photoreceptor was measured by an eddy-current film thickness measurer from Fischer Instruments K.K.

The test results of the hardenability of Examples 1 to 11 and Comparative Examples 1 to 11 are shown in Table 1.

TABLE 1

| | |
|---|---|
| Example 1 | Insoluble |
| Example 2 | Insoluble |
| Example 3 | Insoluble |
| Example 4 | Insoluble |
| Example 5 | Insoluble |
| Example 6 | Insoluble |
| Example 7 | Insoluble |
| Example 8 | Insoluble |
| Example 9 | Insoluble |
| Example 10 | Insoluble |
| Example 11 | Insoluble |
| Comparative Example 1 | Insoluble |
| Comparative Example 2 | Insoluble |
| Comparative Example 3 | Insoluble |
| Comparative Example 4 | Insoluble |
| Comparative Example 5 | Insoluble |
| Comparative Example 6 | Insoluble |
| Comparative Example 7 | Soluble |
| Comparative Example 8 | Soluble |
| Comparative Example 9 | Insoluble |
| Comparative Example 10 | Soluble |
| Comparative Example 11 | Insoluble |

The surfaces of Comparative Example 7 having no crosslinked surface layer, Comparative Example 8 having less acrylic functional groups and Comparative Example 10 excluding the trifunctional radical polymerizable monomer having no charge transport structure were dissolved with tetrahydrofuran. Therefore, these did not have high abrasion resistance.

The test results of the surface roughness and peel strength of Examples 1 to 11 and Comparative Examples 1 to 11 are shown in Table 2.

TABLE 2

| | $1^{st}$ D50 [μm] | $2^{nd}$ D50 [μm] | $3^{rd}$ D50 [μm] | Surface roughness Ra [μm] | Peel strength [N/mm] |
|---|---|---|---|---|---|
| Example 1 | 13.4 | 1.5 | — | 0.058 | 0.45 |
| Example 2 | 7.5 | 4.6 | — | 0.140 | 0.25 |
| Example 3 | 17.3 | 1.5 | 1.5 | 0.034 | 0.48 |
| Example 4 | 15.3 | 5.8 | — | 0.170 | 0.67 |
| Example 5 | 13.4 | 1.5 | — | 0.095 | 0.33 |
| Example 6 | 8.8 | 6.4 | — | 0.184 | 0.28 |
| Example 7 | 13.4 | 1.5 | — | 0.035 | 0.34 |
| Example 8 | 13.4 | 1.5 | — | 0.067 | 0.48 |
| Example 9 | 14.2 | 5.6 | 3.2 | 0.086 | 0.36 |
| Example 10 | 13.4 | 3.1 | — | 0.051 | 0.40 |
| Example 11 | 10.3 | 0.7 | — | 0.021 | 0.30 |
| Comparative Example 1 | 5.6 | — | — | 0.162 | 0.14 |
| Comparative Example 2 | 20.5 | — | — | 0.684 | 0.75 |
| Comparative Example 3 | 15.2 | 15.2 | — | 0.451 | 0.62 |
| Comparative Example 4 | 3.4 | 3.4 | — | 0.021 | 0.03 |
| Comparative Example 5 | 8.1 | 8.1 | — | 0.254 | 0.31 |
| Comparative Example 6 | 1.2 | 10.2 | — | 0.451 | 0.02 |
| Comparative Example 7 | — | — | — | 0.142 | — |

TABLE 2-continued

| | 1st D50 [μm] | 2nd D50 [μm] | 3rd D50 [μm] | Surface roughness Ra [μm] | Peel strength [N/mm] |
|---|---|---|---|---|---|
| Comparative Example 8 | 13.4 | 1.5 | — | 0.023 | 0.38 |
| Comparative Example 9 | 13.4 | 1.5 | — | 0.048 | 0.45 |
| Comparative Example 10 | 13.4 | 1.5 | — | 0.041 | 0.34 |
| Comparative Example 11 | | | | 0.545 | 0.23 |

Examples 1 to 11 and Comparative Examples 2, 3, 5, 8 to 10 wherein each of the 1st D50 was not less than 7 μm had a peel strength not less than 0.2 N/mm and can be expected to prevent the surface layer from peeling. Comparative Example 1 wherein only the surface layer is coated just once and D50 thereof was less than 7 μm, resulting in Ra not greater than 0.2 μm. Examples 1 to 11 and Comparative Examples 4, 8 to 10 wherein each of the 2nd D50 was less than 7 μm had a smooth surface having Ra not greater than 0.2 μm and can be expected to have good cleanability. Comparative Example 7 including no crosslinked surface layer had a smooth surface. Comparative Example 11 wherein the crosslinked surface layer was formed by a ring coat method did not have a smooth surface.

The test results of the durability of Examples 1 to 11 and Comparative Examples 1 to 11 are shown in Tables 3-1, 3-2, 3-3 and 3-4.

In Table 3-1, 3-2 and 3-3, the image quality was classified as follows.

○: good
A: partial background fouling
B: partial stripe image
C: slight deterioration of image density
D: slight deterioration of image resolution
AA: whole background fouling
BB: whole stripe image
CC: noticeable deterioration of image density
DD: noticeable deterioration of image resolution

TABLE 3-1

| | Initial | | |
|---|---|---|---|
| | Unabraded part | Abraded part | |
| | Image | Image | Peeling |
| Example 1 | ○ | ○ | None |
| Example 2 | ○ | ○ | None |
| Example 3 | ○ | ○ | None |
| Example 4 | ○ | ○ | None |
| Example 5 | ○ | ○ | None |
| Example 6 | ○ | ○ | None |
| Example 7 | ○ | ○ | None |
| Example 8 | ○ | ○ | None |
| Example 9 | ○ | ○ | None |
| Example 10 | ○ | ○ | None |
| Example 11 | ○ | ○ | None |
| Comparative Example 1 | ○ | ○ | None |
| Comparative Example 2 | AA, BB | ○ | None |
| Comparative Example 3 | B | ○ | None |
| Comparative Example 4 | ○ | ○ | Partially peeled |
| Comparative Example 5 | ○ | ○ | None |
| Comparative Example 6 | B | ○ | Partially peeled |

TABLE 3-1-continued

| | Initial | | |
|---|---|---|---|
| | Unabraded part | Abraded part | |
| | Image | Image | Peeling |
| Comparative Example 7 | ○ | ○ | None |
| Comparative Example 8 | DD | DD | None |
| Comparative Example 9 | CC | C | None |
| Comparative Example 10 | AA | A | None |
| Comparative Example 11 | BB | ○ | None |

TABLE 3-2

| | 25,000 images | | |
|---|---|---|---|
| | Unabraded part | Abraded part | |
| | Image | Image | Peeling |
| Example 1 | ○ | ○ | None |
| Example 2 | ○ | ○ | None |
| Example 3 | ○ | ○ | None |
| Example 4 | ○ | ○ | None |
| Example 5 | ○ | ○ | None |
| Example 6 | ○ | ○ | None |
| Example 7 | ○ | ○ | None |
| Example 8 | ○ | ○ | None |
| Example 9 | ○ | ○ | None |
| Example 10 | ○ | ○ | None |
| Example 11 | ○ | ○ | None |
| Comparative Example 1 | ○ | B | Partially peeled |
| Comparative Example 2 | — | — | — |
| Comparative Example 3 | BB | B | None |
| Comparative Example 4 | ○ | BB | Mostly peeled |
| Comparative Example 5 | B | ○ | None |
| Comparative Example 6 | BB | BB | Mostly peeled |
| Comparative Example 7 | ○ | ○ | None |
| Comparative Example 8 | — | — | — |
| Comparative Example 9 | — | — | — |
| Comparative Example 10 | — | — | — |
| Comparative Example 11 | — | — | — |

TABLE 3-3

| | 50,000 images | | |
|---|---|---|---|
| | Unabraded part | Abraded part | |
| | Image | Image | Peeling |
| Example 1 | ○ | ○ | None |
| Example 2 | ○ | B | Partially peeled |
| Example 3 | C | ○ | None |
| Example 4 | B | ○ | None |
| Example 5 | ○ | ○ | None |
| Example 6 | B | ○ | Partially peeled |

TABLE 3-3-continued

| | 50,000 images | | |
|---|---|---|---|
| | Unabraded part | Abraded part | |
| | Image | Image | Peeling |
| Example 7 | ○ | ○ | None |
| Example 8 | ○ | ○ | None |
| Example 9 | ○ | ○ | None |
| Example 10 | ○ | ○ | None |
| Example 11 | ○ | ○ | None |
| Comparative Example 1 | ○ | BB | Mostly peeled |
| Comparative Example 2 | — | — | — |
| Comparative Example 3 | A, BB | BB | None |
| Comparative Example 4 | ○ | BB | Mostly peeled |
| Comparative Example 5 | BB | ○ | Partially peeled |
| Comparative Example 6 | BB | BB | Mostly peeled |
| Comparative Example 7 | ○ | A | None |
| Comparative Example 8 | — | — | — |
| Comparative Example 9 | — | — | — |
| Comparative Example 10 | — | — | — |
| Comparative Example 11 | — | — | — |

TABLE 3-4

| | Abraded amount | Potential [−V] | |
|---|---|---|---|
| | [μm] | Initial | 50,000 images |
| Example 1 | 0.80 | 110 | 130 |
| Example 2 | 0.85 | 130 | 120 |
| Example 3 | 0.65 | 120 | 170 |
| Example 4 | 1.21 | 150 | 160 |
| Example 5 | 0.80 | 120 | 130 |
| Example 6 | 0.65 | 140 | 140 |
| Example 7 | 0.55 | 140 | 150 |
| Example 8 | 0.50 | 120 | 130 |
| Example 9 | 1.05 | 130 | 150 |
| Example 10 | 0.90 | 130 | 150 |
| Example 11 | 0.75 | 120 | 120 |
| Comparative Example 1 | 0.80 | 110 | 110 |
| Comparative Example 2 | — | 150 | — |
| Comparative Example 3 | 0.94 | 120 | 140 |
| Comparative Example 4 | 0.75 | 130 | 130 |
| Comparative Example 5 | 0.84 | 120 | 120 |
| Comparative Example 6 | — | 130 | — |
| Comparative Example 7 | 6.20 | 100 | 120 |
| Comparative220 Example 8 | — | 180 | — |
| Comparative Example 9 | — | 220 | — |
| Comparative Example 10 | — | 130 | — |
| Comparative Example 11 | — | 160 | — |

Each of Examples 1 to 11 having the crosslinked surface layer of the present invention had good electrical properties and produced quality images before and after 50,000 images were produced. Further, each had a small abraded amount, no peeling and can be expected to have abrasion resistance for long periods. Comparative Examples 2, 3, 5, 6 and 11 each having a surface roughness Ra not less than 0.2 μm produced abnormal images due to the surfaceness. Comparative Examples 1, 4 and 6 each having a peel strength not greater than 0.2 N/mm had the surface layer peel, resulting in production of abnormal images. Comparative Example 7 had a large abraded amount and cannot be expected to have high durability though producing quality images. Comparative Examples 8 and 10 not having crosslinked surface layer because of including no tri- or more functional radical polymerizable monomer produced abnormal images. Comparative Example 9 including no radical polymerizable compound having a charge transport structure had a high bright part potential, resulting in production of images having lower image density.

This application claims priority and contains subject matter related to Japanese Patent Application No. 2006-217667 filed on Aug. 10, 2006, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by letters patent of the United States is:

1. A method of preparing an electrophotographic photoreceptor comprising:

an electroconductive substrate, a photosensitive layer located overlying the electroconductive substrate, and a crosslinked surface layer located overlying the photosensitive layer, comprising:

a tri- or more functional radical polymerizable monomer having no charge transport structure; and a radical polymerizable compound having a charge transport structure, wherein the crosslinked surface layer has a surface roughness (Ra) not greater than 0.2 μm and a peel strength not less than 0.2 N/mm, the method comprising:

performing two or more oscillation spray coatings, and hardening the coatings with heat or optical energy to form the crosslinked surface layer, wherein a droplet diameter (D50) of the first spray coating is not less than 7 μm and that of the second or subsequent spray coating is less than 7 μm, and wherein D50 is an average of half cumulative curve of 100 droplet diameter distributions when measured at an interval of 0.1 sec of sprayed droplets.

2. The method of claim 1, wherein D50 of the first spray coating is from 10 to 15 μm, and that of the second or subsequent spray coating is not greater than 5 μm.

3. The method of claim 1, wherein the crosslinked surface layer has a surface roughness not greater than 0.15 μm and a peel strength not less than 0.3 N/mm.

4. The method of claim 1, wherein the charge transport structure is a member selected from the group consisting of a triarylamine structure, a hydrazone structure, a pyrazoline structure and a carbazole structure.

5. The method of claim 1, wherein the charge transport structure is a triarylamine structure.

6. The method of claim 1,wherein the radical polymerizable compound is a member selected from the group consisting of an acryloyloxy group and a methacryloyloxy group.

7. The method of claim 1, wherein the radical polymerizable compound is monofunctional.

8. The method of claim 1, wherein the tri- or more functional radical polymerizable monomer is a member selected from the group consisting of a tri- or more functional acryloyloxy group and a tri- or more functional methacryloyloxy group.

9. The method of claim 1, wherein the crosslinked surface layer is crosslinked with a light energy irradiator.

10. The method of claim 1, wherein the photosensitive layer comprises:

a charge generation layer located overlying the electroconductive substrate;

a charge transport layer located overlying the charge generation layer; and the crosslinked surface layer located overlying the charge transport layer.

* * * * *